US010565826B2

(12) United States Patent
Wolf et al.

(10) Patent No.: US 10,565,826 B2
(45) Date of Patent: Feb. 18, 2020

(54) GAMING SYSTEM AND METHOD PROVIDING A CLASS II BINGO GAME WITH AN INTERIM VIDEO POKER GAME

(71) Applicant: IGT, Las Vegas, NV (US)

(72) Inventors: Bryan Wolf, Reno, NV (US); Kevin Kuran, Reno, NV (US)

(73) Assignee: IGT, Las Vegas, NV (US)

( * ) Notice: Subject to any disclaimer, the term of this patent is extended or adjusted under 35 U.S.C. 154(b) by 57 days.

(21) Appl. No.: 15/832,975

(22) Filed: Dec. 6, 2017

(65) Prior Publication Data

US 2019/0172302 A1 Jun. 6, 2019

Related U.S. Application Data

(63) Continuation of application No. 15/831,571, filed on Dec. 5, 2017.

(51) Int. Cl.
*G07F 17/32* (2006.01)

(52) U.S. Cl.
CPC ..... *G07F 17/329* (2013.01); *G07F 17/3211* (2013.01); *G07F 17/3244* (2013.01); *G07F 17/3272* (2013.01); *G07F 17/3276* (2013.01); *G07F 17/3293* (2013.01)

(58) Field of Classification Search
None
See application file for complete search history.

(56) References Cited

U.S. PATENT DOCUMENTS

| | | | | |
|---|---|---|---|---|
| 6,749,500 | B1 | 6/2004 | Nelson et al. | |
| 7,128,650 | B2 | 10/2006 | Saffari | |
| 7,524,243 | B2 | 4/2009 | Bansemer et al. | |
| 7,658,672 | B1 | 2/2010 | Wolf et al. | |
| 7,837,545 | B2 | 11/2010 | Blair, Jr. et al. | |
| 7,857,693 | B1 | 12/2010 | Johnson et al. | |
| 7,959,507 | B2 | 6/2011 | Cannon | |
| 8,057,292 | B2 | 11/2011 | Gail et al. | |
| 8,123,607 | B2 | 2/2012 | Van Asdale | |
| 8,752,838 | B2 * | 6/2014 | Weingardt | G07F 17/3286 273/269 |
| 8,758,106 | B2 | 6/2014 | Wolf et al. | |
| 8,764,540 | B2 | 7/2014 | Hollibaugh et al. | |
| 9,728,046 | B2 * | 8/2017 | Forman | G07F 17/329 |
| 2005/0059469 | A1 * | 3/2005 | Gail | G07F 17/32 463/19 |
| 2005/0101387 | A1 * | 5/2005 | Wolf | G07F 17/3286 463/42 |
| 2005/0221883 | A1 * | 10/2005 | Lind | G07F 17/32 463/19 |
| 2005/0233798 | A1 * | 10/2005 | Van Asdale | G07F 17/32 463/19 |
| 2006/0025189 | A1 * | 2/2006 | Hollibaugh | G07F 17/32 463/11 |
| 2006/0025199 | A1 * | 2/2006 | Harkins | G07F 17/32 463/19 |

(Continued)

*Primary Examiner* — Tramar Y Harper
(74) *Attorney, Agent, or Firm* — Neal, Gerber & Eisenberg LLP

(57) ABSTRACT

The gaming system of the present disclosure provides a Class II bingo game with an interim video poker game. In various embodiments, the interim video poker game is a single-hand video poker game. In various embodiments, the interim video poker game is a multi-hand video poker game.

31 Claims, 26 Drawing Sheets

(56) References Cited

U.S. PATENT DOCUMENTS

| | | | | |
|---|---|---|---|---|
| 2006/0035700 | A1* | 2/2006 | Van Asdale | G07F 17/32 463/19 |
| 2007/0123329 | A1* | 5/2007 | Frank | G07F 17/32 463/16 |
| 2012/0122534 | A1 | 5/2012 | Montross et al. | |
| 2015/0024834 | A1* | 1/2015 | Lewis | G07F 17/3244 463/25 |
| 2015/0105143 | A1 | 4/2015 | Powell et al. | |
| 2018/0078847 | A1* | 3/2018 | Sorreta | G07F 17/326 |

* cited by examiner

1000

GAMING SYSTEM AND METHOD PROVIDING A CLASS II BINGO GAME WITH AN INTERIM VIDEO POKER GAME

PRIORITY CLAIM

This application claims priority to and the benefit of U.S. Non-Provisional patent application Ser. No. 15/831,571, filed on Dec. 5, 2017, the entire contents of which are incorporated herein by reference.

COPYRIGHT NOTICE

A portion of the disclosure of this patent document contains or may contain material that is subject to copyright protection. The copyright owner has no objection to the photocopy reproduction by anyone of the patent document or the patent disclosure in exactly the form it appears in the U.S. Patent and Trademark Office patent file or records, but otherwise reserves all copyright rights whatsoever.

BACKGROUND

Wager-based gaming in the United States is divided into Class I, Class II, and Class III games. Class I games generally include social games played for minimal prizes, or traditional ceremonial games. Class II games generally include bingo and bingo-like games (as well as central determination games). Class III games generally include any games that are not Class I or Class II games, such as games of chance typically offered in non-Indian, state-regulated casinos.

For a play of a traditional Class II bingo game, each player purchases one or more bingo cards that bear multiple bingo numbers of a set of a plurality of bingo numbers. The bingo numbers of the set are then sequentially drawn at random (e.g., selected via a random number generator). If a drawn bingo number matches a bingo number on a player's bingo card, that bingo number is marked (which is often referred to as "daubing") on the player's bingo card. The draw continues until the marks on one of the player's bingo cards form a game-winning pattern (which is sometimes called a game-ending pattern). At that point, the play of the Class II bingo game ends, and the player whose marked bingo card forms the game-winning pattern is provided an award.

Some Class II bingo games also include one or more interim patterns. If the marks on a player's bingo card form an interim pattern, the player wins an interim award. Unlike a game-winning pattern match, an interim pattern match does not end the bingo number draw. Some Class II bingo games require an interim pattern to be marked within a particular quantity of bingo number draws (e.g., within the first five or ten bingo number draws). Class II bingo systems typically rank interim patterns from highest to lowest priority (e.g., highest to lowest associated interim award). If multiple interim patterns are marked on a single bingo card, the Class II bingo system usually provides the interim award for the highest priority marked interim pattern and ignores the other (lower priority) marked interim patterns.

SUMMARY

The gaming system and method of the present disclosure provide a Class II bingo game with an interim video poker game. In various such embodiments, the gaming system and method of the present disclosure provides a Class II bingo game with an interim single-hand video poker game. In various other embodiments, the gaming system and method of the present disclosure provides a Class II bingo game with an interim multi-hand video poker game.

Generally, for a play of the Class II bingo game (referred to herein as the "bingo game"), the bingo game is played on a bingo card with 52 bingo spots. Each spot on the bingo card is assigned (or associated with) a different card from a conventional or standard deck of 52 playing cards (e.g., such as one of the four suits (Diamond, Spade, Club, and Heart), and one of the 13 card values (Ace, Two, Three, Four, Five, Six, Seven, Eight, Nine, Ten, Jack, Queen, and King)). Each playing card (sometimes referred to herein as a "poker card" or "card") is static so that, for example, the Two of Spades always appears in or is associated with the same position on all bingo cards during the play. The bingo game has 52 bingo balls/numbers that map to the 52 bingo spots on each bingo card. The numbers on the bingo card are randomly chosen so that each different playing card is associated with a different random bingo number.

The gaming system then randomly draws five initial bingo numbers from the set of 52 bingo numbers and releases them as a single ball release (e.g., all five bingo numbers are presented or displayed to the player at the same time). The gaming system maps the five bingo numbers to the playing cards based on the bingo card and displays a poker hand including poker cards based on the mapped playing cards.

The player may choose to daub any quantity of the five bingo numbers (including none of the bingo numbers and all of the bingo numbers). In the present disclosure, the player chooses which, if any, bingo numbers to daub by selecting any of the poker cards of the poker hand to hold. In response to receiving a hold selection for a poker card, the gaming system daubs the bingo spot on the bingo card corresponding to the held poker card. In the present disclosure, the gaming system daubs the bingo spot(s) corresponding to the held poker card(s), if any, using a first daubing pattern (such as shading the respective bingo spots a blue color). Once the player has identified or selected which poker cards to hold, the gaming system designates the remaining poker cards, if any, as non-held cards. In the present disclosure, the gaming system daubs the bingo spot(s) corresponding to the non-held card(s), if any, using a second different daubing pattern (such as drawing an "X" through the respective bingo spots).

The gaming system then draws at least five more bingo numbers from the numbers remaining in the set of 52 bingo numbers. In various embodiments of the present disclosure, if the quantity of bingo spots daubed using the first daubing pattern is less than five bingo spots, the gaming system automatically and sequentially daubs the bingo spots corresponding to the additionally drawn bingo numbers using the first daubing pattern until the total quantity of bingo spots using the first daubing pattern is five bingo spots. In various embodiments of the present disclosure, after the initial bingo number draw, the gaming system automatically daubs the additional bingo numbers using the first daubing pattern in the order that the bingo numbers are drawn (e.g., sequentially). Once the quantity of bingo spots daubed using the first daubing pattern is five bingo spots, the gaming system daubs the bingo spots corresponding to the additionally drawn bingo numbers using a third different daubing pattern (such as shading the respective bingo spots using an orange color). The gaming system then continues drawing additional bingo numbers until a bingo card matches a game-winning pattern. In various embodiments of the present disclosure, to match a game-winning pattern, the gaming system compares the bingo spots on the bingo card that are daubed using either the first daubing pattern or the third daubing pattern to the game-winning pattern, such as all the bingo spots in a row of the bingo card. In the present disclosure, the game-winning pattern includes at least ten bingo spots. Once a bingo card matches a game-winning pattern, the bingo game ends and the gaming system determines any awards to issue or provide to the players.

In various embodiments of the present disclosure, the first player whose bingo card matches the game-winning pattern is issued a game-winning award, while the other players are not issued a game-winning award. The gaming system also determines any interim bingo award to issue or provide based on (1) bingo spots marked using the first daubing pattern and (2) interim bingo patterns. In various embodiments of the present disclosure, the interim bingo patterns correspond to winning poker hands. For example, a four-spot pattern of bingo spots in the same column of the bingo card that were marked using the first daubing pattern corresponds to a Four of a Kind poker hand. In various embodiments of the present disclosure, the gaming system issues (to each player) a single interim bingo award for the highest paying interim bingo pattern, if any, that is matched by the first five bingo spots daubed using the first daubing pattern on that player's bingo card. Thus, while only the first player to match the game-winning pattern is issued the game-winning award, any quantity or subset of the players included in the play of the bingo game (including none of the players and all of the players) may be issued their respective interim bingo award, if any.

By comparing the first five bingo spots daubed using the first daubing pattern to the interim bingo patterns, the gaming system enables each player the choices they are generally provided when playing five-card video poker. This solves an existing problem with prior bingo games that match the first five bingo numbers drawn or the first five bingo numbers matched on the bingo card. Furthermore, because the player has the choice to hold or discard any quantity of the poker cards of the initial poker hand, the outcome of the interim poker game is not predetermined and the gaming system does not need to store various data tables associated with different poker paytables. Additionally, since the interim bingo awards are based on any interim bingo patterns that are matched by the bingo card, the interim poker game gives the player an impression of a real poker game. That is, the player gets the choice to hold or discard each of the cards, and then discarded cards are replaced with subsequently drawn "cards" until their poker hand is complete.

For a play of a Class II bingo game including an interim multi-hand video poker game, the gaming system includes one or more variations including, for example, a primary bingo card and a plurality of poker bingo cards, overlapping the primary card with each of the poker bingo cards and daubing the bingo spots corresponding to the same held cards on the poker bingo cards, generating poker hands associated with the respective poker bingo cards based on the daubed bingo spots, drawing additional random bingo numbers and automatically daubing the corresponding bingo spots on the primary bingo card until a game-winning patter is detected on the primary bingo card, adding poker cards to the respective poker hands based on the order of the bingo numbers drawn until each of the respective poker hands is complete, and issuing any awards, for each poker hand, to the player based on the highest paying poker winning hands that they hold.

Additional features and advantages are described herein and will be apparent from the Detailed Description and the Figures.

DETAILED DESCRIPTION

Figure 1A:
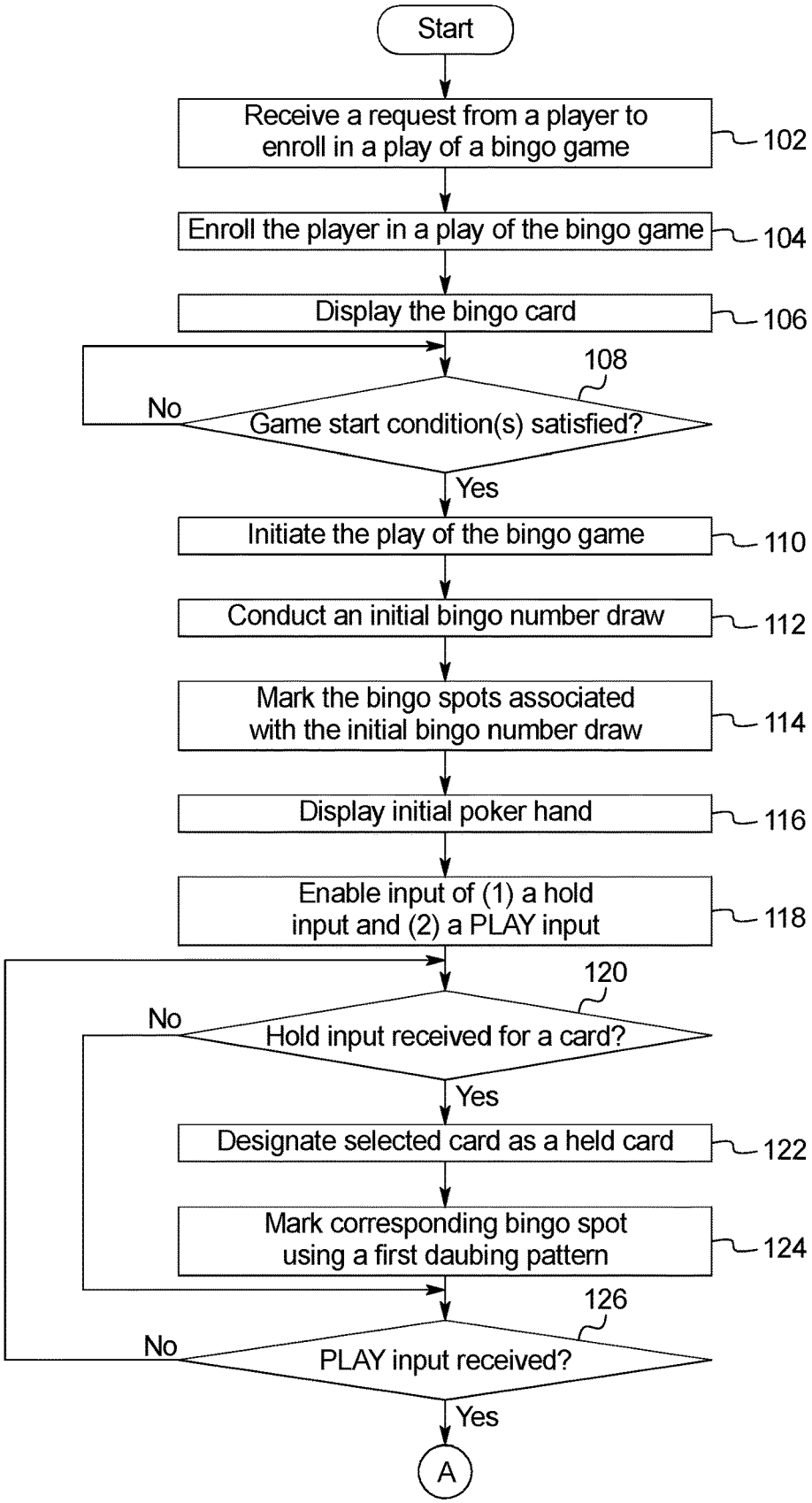
FIGS. 1A and 1B are flowcharts of an example process or method of operating a gaming system of the present disclosure to provide an example Class II bingo game with an interim video poker game.

The Detailed Description uses numbered headings for clarity. These headings do not limit the scope of the present disclosure.

Example embodiments of a Class II bingo game with an interim single-hand video poker game are described in more detail in Sections 1, 2 and 3 below.

Example embodiments of a Class II bingo game with an interim multi-hand video poker game are described in more detail in Sections 4, 5 and 6 below.

1. General Explanation of Class II Bingo Game with Interim Single-Hand Video Poker Game In various embodiments, the gaming system creates a set of different bingo cards for a play of a bingo game by multiple players. Each bingo card has a set of different bingo spots that respectively correspond to different playing cards of a deck of playing cards. For example, each bingo card can have 52 bingo spots that correspond to 52 playing cards of a standard deck of playing cards. In this example, the upper right hand bingo spot on each of the bingo cards may be assigned the playing card "Ace of Spades." For each bingo card, the gaming system also randomly assigns different bingo numbers to the different bingo spots on the bingo cards. For example, the upper right hand bingo spot on a bingo card may be assigned bingo number "20" from 52 bingo numbers. Thus, in this example, the Ace of Spades is associated on this specific bingo card with the bingo number "20." For the play of the bingo game, the gaming system assigns the different bingo cards (that have the associated playing cards and bingo numbers) to different players.

The gaming system then randomly draws five initial bingo numbers from the set of bingo numbers. For each bingo card for each different player, the gaming system uses these five initial bingo numbers to determine and display to that player the corresponding five initial bingo spots on that player's bingo card and the corresponding five initial poker cards that correspond to those five initially drawn bingo numbers.

Thus, each player may (and likely will) have different initial poker cards. The gaming system then enables each player to select from zero to five of their displayed poker cards to hold. For each player, for each poker card held by that player, the gaming system daubs the corresponding bingo spot on that player's bingo card. For example, if a player holds two of their five poker cards, the gaming system daubs the two spots on the player's bingo card corresponding to the two held poker cards.

The gaming system then randomly draws at least five additional bingo numbers from the set of remaining bingo numbers and automatically daubs the corresponding bingo spots for each of the bingo cards. For each bingo card for each different player, the gaming system replaces any displayed non-held poker cards with poker cards corresponding to the additionally drawn bingo numbers in the order that the additional bingo numbers are drawn until their respective poker hand is complete. For example, if a player selects to hold two of their five initial poker cards, the gaming system then replaces the three non-held poker cards with poker cards corresponding to the three next drawn bingo numbers based on their respective bingo card. Similarly, if a player selects to hold zero of their five initial poker cards, the gaming system then replaces the five non-held poker cards with poker cards corresponding to the five next drawn bingo numbers based on their respective bingo card.

In this example embodiment, the gaming system continues drawing additional bingo numbers until one of the bingo cards of the play of the bingo game satisfies a game-winning pattern based on the bingo spots daubed on that bingo card. For example, a game-winning pattern may include having all thirteen spots of a row of the bingo card daubed. Once a game-winning pattern is detected, the gaming system issues any first award(s) to the player whose bingo card satisfied the game-winning pattern. For each of the bingo cards and their corresponding poker hands, the gaming system then issues any second (or interim) awards to the respective players based on the highest paying poker winning hand, if any, that they have. For example, if a player holds two of their initial five poker cards, the gaming system issues any second awards based on the two held cards and the three replacement poker cards the player is issued. Thus, while the first player (or players) to satisfy the game-winning pattern are issued any first awards (e.g., for their bingo cards satisfying the game-winning pattern), each of the players of the play of the bingo game may win any second awards (e.g., for their final (or complete) poker hand).

This gaming system is advantageous because since the same bingo numbers are available to all players of a play of a bingo game, then all of the players are playing with the same ball draw. Additionally, because the poker cards correspond to physical positions on the bingo card, every winning poker hand corresponds to a physical pattern on the bingo card. Thus, all players are playing with the same patterns, and each pattern has the same pay and probability for all players. The gaming system also does not need to determine, using memory intensive poker paytables, which poker hands can be dealt for which win amounts or attempt to approximate their actual probability of occurrence in poker.

Figure 1B:
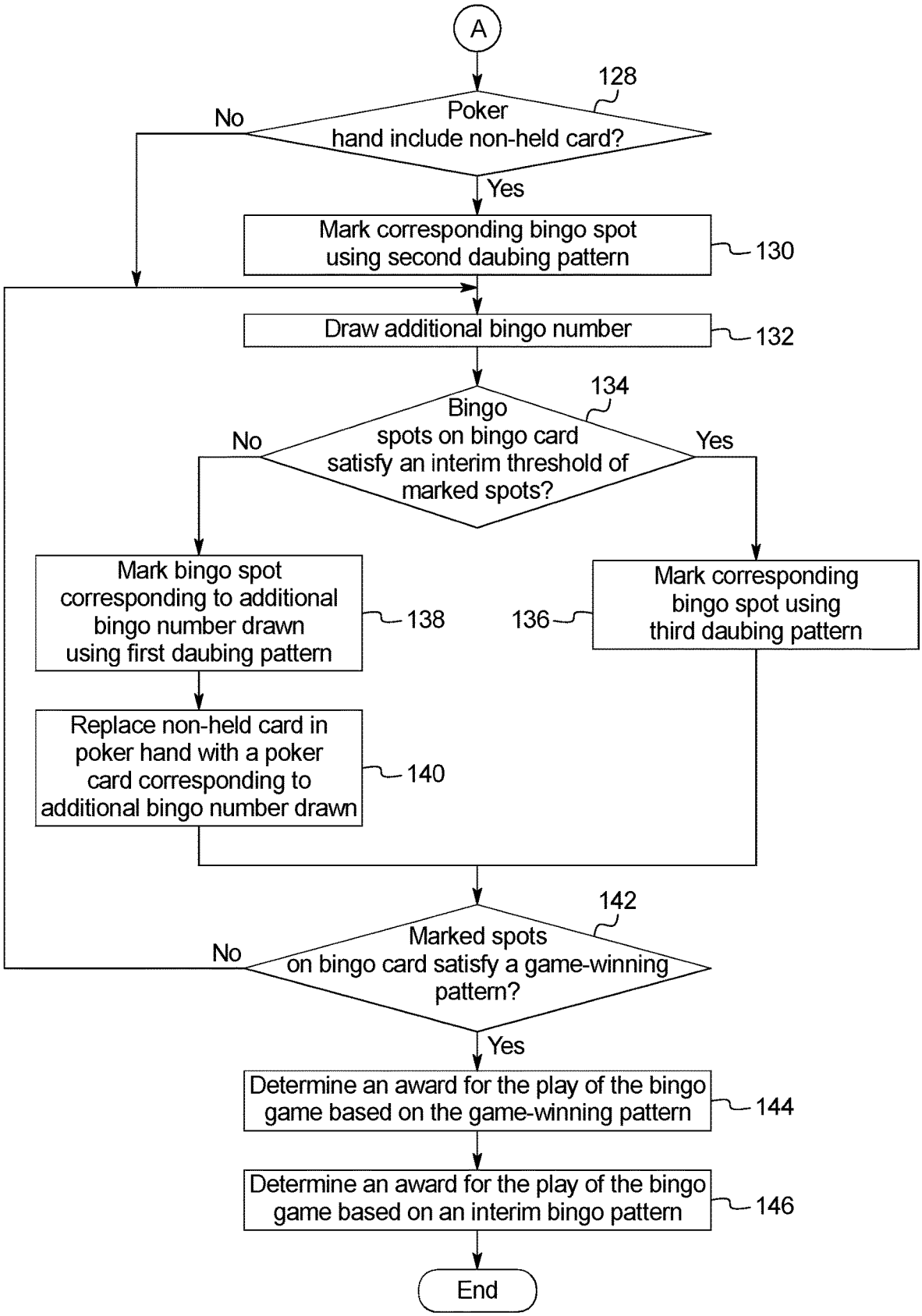

2. Example Method of Class II Bingo Game with Interim Single-Hand Video Poker Game FIGS. 1A and 1B are flowcharts of an example process or method 100 of operating a gaming system of various embodiments of the present disclosure to provide an example bingo game with an interim video poker game. In various embodiments, a set of instructions stored in one or more memories and executed by one or more processors represents the process 100. Although the process 100 is described with reference to the flowcharts shown in FIGS. 1A and 1B, many other processes of performing the acts associated with this process 100 may be employed. For example, the order of certain of the blocks or diamonds may be changed, certain of the blocks or diamonds may be optional, or certain of the blocks or diamonds may not be employed.

In operation of this example embodiment, the process 100 begins after the gaming system receives an enrollment request from a player who desires to enroll in a play of a bingo game, as block 102 indicates. Responsive to receiving the request, the gaming system enrolls the player in the play of the bingo game, as block 104 indicates. For example, the gaming system randomly determines a bingo card for the player. The bingo card includes a matrix (e.g., a plurality) of bingo spots or bingo number display areas (such as a 4 by 13 array of bingo spots or any other suitable array of bingo spots). In this example embodiment, each different bingo spot corresponds to a different playing card. For example, each row of the bingo card corresponds to a respective card suit (e.g., Diamonds, Spades, Clubs, and Hearts) and each column of the bingo card corresponds to a respective card value (e.g., Ace, Two, Three, Four, Five, Six, Seven, Eight, Nine, Ten, Jack, Queen and King) so that each bingo spot of the bingo card is associated with a different playing card (e.g., Two of Spades, Three of Clubs, etc.). The gaming system randomly associates or maps multiple bingo numbers of a set of a plurality of different bingo numbers (such as bingo numbers 1-52 or any other suitable quantity of bingo numbers (which may have any suitable values)) to the spots such that each bingo spot of the bingo card (1) is associated with a different one of the bingo numbers of the set of bingo numbers and (2) is associated with a different playing card. Thus, using the bingo card, each bingo number of the set of different bingo numbers maps to a different playing card. In various embodiments, the bingo cards may be prepared in advance instead of responsive to receipt of a player request to enroll in the bingo game. The gaming system displays the bingo card, as block 106 indicates. The gaming system also displays five placeholders for poker cards that will be populated during play of the bingo game.

The gaming system determines whether game start condition(s) are satisfied to initiate play of the bingo game, as diamond 108 indicates. For example, the gaming system determines whether (1) a designated period of time since the first player enrollment has expired and/or (2) a minimum quantity of players has been enrolled in the play of the bingo game (depending on the embodiment). If neither the designated period of time has expired nor the minimum quantity of players has been enrolled in the play of the bingo game, the gaming system continues to wait for requests to enroll in the play of the bingo game. If either the designated period of time has expired or the minimum quantity of players has been enrolled in the play of the bingo game, the gaming system initiates the play of the bingo game, as block 110 indicates.

The gaming system conducts an initial bingo number draw by randomly selecting five bingo numbers of the set of bingo numbers, as block 112 indicates. For each bingo card of each player, the gaming system marks any bingo spot associated with the initial bingo number draw, as block 114 indicates. For example, the gaming system circles each bingo spot corresponding to each of the respective bingo numbers of the initial bingo number draw. The gaming system then displays an initial poker hand based on the bingo numbers of the initial bingo number draw, as block 116 indicates. For example, the gaming system uses the bingo card to map each of the bingo numbers of the initial bingo number draw to a playing card. The gaming system then populates the initial poker hand by displaying playing cards mapped to the initial bingo number draw in the placeholders.

After displaying the initial poker hand, the gaming system enables player input of (1) a hold input for each poker card of the initial poker hand, and (2) a PLAY input, as block 118 indicates. As diamond 120 and diamond 126 indicate, the gaming system monitors for receipt of the card hold input (or inputs) or the PLAY input. This enables the player to choose which of the poker cards of the initial poker hand (if any) to hold and which poker card (or cards) to discard (if any).

Responsive to the gaming system determining at diamond 120 that a card hold input identifying a particular poker card of the poker hand has been received, the gaming system designates that poker card as a held card, as block 122 indicates. For example, the player may select (e.g., via an input device) to hold the first poker card, the second poker card, the fourth poker card, and the fifth poker card of the initial poker hand. In such a case, the gaming system then designates each of the first poker card, the second poker card, the fourth poker card, and the fifth poker card of the initial poker hand as held cards. The gaming system then marks the bingo spot(s) on the bingo card corresponding to each of the held cards, as block 124 indicates. For example, the gaming system may apply a first daubing pattern to each of the respective bingo spots of the bingo card that correspond to the first poker card, the second poker card, the fourth poker card, and the fifth poker card of the initial poker hand. In this example embodiment, marking the bingo spot using the first daubing pattern includes shading the bingo spot of the bingo card a blue color. However, the gaming system may additionally or alternatively use other techniques for marking the bingo spot using a first daubing pattern.

The process 100 then proceeds to diamond 126. Responsive to the gaming system determining at diamond 126 that a PLAY input has not been received, the process 100 returns to diamond 120.

Responsive to the gaming system determining at diamond 126 that the PLAY input has been received, the gaming system determines whether the poker hand includes any non-held cards, as diamond 128 indicates. For example, the gaming system may designate poker card(s) that were not selected to be held card(s) by the player as non-held cards. In the above example in which the first poker card, the second poker card, the fourth poker card and the fifth poker card were designated as held cards in the poker hand, the gaming system designates the third poker card of the poker hand as a non-held card.

Responsive to the gaming system determining at diamond 128 that the poker hand does not include any non-held cards (e.g., all of the poker cards of the poker hand were selected to be held cards), the process 100 proceeds to block 132, as described below. But, responsive to the gaming system determining at diamond 128 that the poker hand includes at least one non-held card, the gaming system marks the bingo spot(s) corresponding to each of the non-held card(s), as block 130 indicates. For example, the gaming system applies a second daubing pattern to the bingo spot on the bingo card that corresponds to the third poker card of the poker hand. In this example embodiment, marking the bingo spot using the second daubing pattern includes drawing an "X" through the bingo spot on the bingo card. However, the gaming system may additionally or alternatively use other techniques for marking a bingo spot using the second daubing pattern. As disclosed below, in this example embodiment, bingo spots marked using the second daubing pattern are not considered when determining whether the bingo card satisfies a game-winning pattern and/or an interim bingo pattern.

The gaming system then draws an additional bingo number from the remaining numbers of the set of bingo numbers, as block 132 indicates. As block 132 and diamond 142 indicate, the gaming system continues drawing additional bingo numbers from the remaining numbers of the set of bingo numbers until the gaming system detects a game-winning pattern. After an additional bingo number is drawn, at block 132, the gaming system determines whether the quantity of bingo spots of the bingo card that are marked using the first daubing pattern (e.g., shaded a blue color) satisfy an interim pattern threshold, as diamond 134 indicates. For example, the gaming system may determine whether five bingo spots of the bingo card are marked using the first daubing pattern. Responsive to the gaming system determining at diamond 134 that the quantity of bingo spots of the bingo card marked using the first daubing pattern satisfies the interim pattern threshold (e.g., five bingo spots of the bingo card are marked using the first daubing pattern), then the gaming system marks the bingo spot of the bingo card corresponding to the additional bingo number drawn using a third daubing pattern, as block 136 indicates. In this example embodiment, marking the bingo spot using the third daubing pattern includes shading the bingo spot on the bingo card an orange color. However, the gaming system may additionally or alternatively use other techniques for marking a bingo spot on the bingo card using the third daubing pattern. Example process 100 then proceeds to diamond 142, described below.

Responsive to the gaming system determining at diamond 134 that the quantity of bingo spots of the bingo card marked using the first daubing pattern does not satisfy the interim pattern threshold (e.g., less than five bingo spots of the bingo card are marked using the first daubing pattern), then the gaming system marks the bingo spot of the bingo card corresponding to the drawn bingo number using the first daubing pattern, as block 138 indicates. For example, the gaming system marks the corresponding bingo spot by shading the bingo spot on the bingo card a blue color. The gaming system then replaces a non-held card in the poker hand with a poker card corresponding to the bingo spot, as block 140 indicates. For example, in the above example where the third poker card is designated a non-held card, the gaming system replaces the third poker card of the poker hand with a playing card that maps to the bingo number and the corresponding bingo spot on the bingo card.

The gaming system then determines, for each player of the play of the bingo game, whether the marked spots on their respective bingo cards satisfy a game-winning pattern, as diamond 142 indicates. For example, the gaming system may compare the bingo spots that are marked with either the first daubing pattern or the third daubing pattern on each of the bingo cards to the game-winning pattern. In this example embodiment, the game-winning pattern is all of the bingo spots of a row of the bingo card being marked using either the first daubing pattern or the third daubing pattern. However, it should be appreciated that other game-winning patterns may additionally or alternatively be used by the gaming system. Responsive to the gaming system determining, at diamond 142, that the marked spots on each of the bingo cards do not satisfy the game-winning pattern, the process 100 returns to block 132 to draw an additional bingo number from the remaining number of the set of bingo numbers.

Responsive to the gaming system determining, at diamond 142, that the marked spots on a bingo card satisfy the game-winning pattern, then the gaming system determines an award for the play of the bingo game based on the game-winning pattern, as block 144 indicates. In this example embodiment, the first player (or players) whose bingo card satisfies the game-winning pattern is awarded a game-winning award, while other players of the play of the bingo game are not awarded any game-winning award.

The gaming system then determines an award for the play of the bingo game based on an interim bingo pattern, as block 146 indicates. In this example embodiment, interim bingo patterns correspond to winning poker hands. For example, the gaming system may determine that a four-spot pattern on the bingo card, where each bingo spot is in the same column of the bingo card, corresponds to a Four of a Kind winning poker hand. In this example embodiment, when comparing the marked spots on the bingo card to the interim bingo patterns, the gaming system uses the first five bingo spots that were marked (e.g., daubed) using the first daubing pattern. The gaming system then determines any interim bingo award to issue or award to the player based on the highest poker win, if any. In this example embodiment, the bingo card of each player included in the play of the bingo game is assessed against the interim bingo patterns for respective interim bingo awards. Accordingly, up to all of the players of the bingo game may be issued or provided any interim bingo award (e.g., corresponding to and based on their poker hand).

The process 100 then ends for this play of the bingo game.

3. Example Gaming System Operation for a Class II Bingo Game with an Interim Single-Hand Video Poker Game Class II bingo games include two or more players participating in a same bingo game for a game-winning prize. The first player to complete the game-winning pattern wins the game-winning prize. To make the bingo game more interesting, examples disclosed herein enable each player to also win an interim bingo award (sometimes referred to herein as an "interim prize," an "interim award" or an "interim poker award"). The interim bingo award is paid to a player for completing an interim bingo pattern on their bingo card. Thus, while the game-winning prize is paid to the first player (or players) to complete the game-winning pattern, the interim award may be paid out to any quantity of players (e.g., zero players, one player, etc.) who complete the interim bingo pattern. Interim awards, if any, are paid to each player based solely upon their bingo card and does not depend on any outcomes hit (e.g., satisfied) or not hit (e.g., not satisfied) by other players and their respective bingo cards.

In the example embodiments disclosed herein, the interim bingo patterns are based on winning poker hands. Thus, the interim bingo patterns are matched by enabling the player to play an interim poker game while also playing the bingo game. Operation of a play of one example Class II bingo game with an interim poker game is described below.

In this example embodiment, for each player for the play of the bingo game, the gaming system displays a bingo card 210. The bingo card 210 is a 4 by 13 matrix in this example embodiment. Each row of the example bingo card 210 represents a respective card suit. In this example embodiment, a first row 212 of the bingo card 210 represents Spades, a second row 214 of the bingo card 210 represents Hearts, a third row 216 of the bingo card 210 represents Clubs, and a fourth row 218 of the bingo card 210 represents Diamonds. Each column of the example bingo card 210 represents a respective card value. In this example embodiment, the card values Two, Three, Four, Five, Six, Seven, Eight, Nine, Ten, Jack, Queen, King and Ace are represented by columns 220, 222, 224, 226, 228, 230, 232, 234, 236, 238, 240, 242 and 244, respectively, of the bingo card 210. Thus, in this example embodiment, each bingo spot on the bingo card 210 maps to a playing card having (1) a card suit and (2) a card value.

Each spot on the bingo card 210 corresponds to a column and a row, and is assigned a different playing card. Each playing card is static so that the same playing card appears in the same position (e.g., column position and row position) on all bingo cards for the play of the bingo game. For example, for each bingo card of the instant play of the bingo game, the Two of Spades is located at row 212 (e.g., Spades suit) and column 220 (e.g., card value "Two") of the bingo card 210.

In this example embodiment, the bingo spots on the bingo card 210 are associated with playing cards. While the bingo numbers and the order of the bingo numbers drawn on each bingo card may vary, the positioning of the playing cards remain the same. Thus, while the Two of Spades is located at row 212 and column 220 of the bingo card 210, the bingo number associated with that bingo spot is randomly selected from a set of bingo numbers 1-52.

In this example embodiment, five random bingo numbers are initially drawn and the playing cards that map to those bingo numbers on the bingo card are displayed to the player as a poker hand. The player may then choose which, if any, of the initial poker cards to hold. The gaming system then daubs the bingo spots on the bingo card that correspond to the selected poker cards using a first daubing pattern. If a poker card is not selected for holding (e.g., is designated as a non-held card), the gaming system does not daub the corresponding bingo spot on the bingo card (or, alternatively, the gaming system marks the corresponding bingo spot using a second daubing pattern). The gaming system then randomly draws additional bingo numbers from the set of bingo numbers 1-52 until: (1) five bingo spots are daubed using the first daubing pattern, and (2) a game-winning pattern is identified on a bingo card of the play of the bingo game. The gaming system also replaces any non-held poker cards with poker cards that match the additional bingo numbers until the poker hand contains five poker cards. Thus, the five bingo spots that are daubed using the first daubing pattern are also the same poker cards of the poker hand. In this example embodiment, the gaming system then issues any first awards to the first player for hitting the game-winning pattern. The gaming system then issues any second awards to each player for the highest interim bingo pattern that matches the first five bingo spots daubed by the gaming system on their respective bingo cards.

At various points during the play of the bingo game, the gaming system displays one or more of a plurality of buttons (actuatable via a touch screen) including: (1) a SEE PAYS button 271, (2) BET DOWN button 272, (3) a BET UP button 273, and (4) a PLAY button 274. Responsive to the gaming system receiving an actuation of the SEE PAYS button 271, the gaming system displays the paytable for the bingo game. Responsive to the gaming system receiving an actuation of the BET DOWN button 272, the gaming system reduces the player wager by a predetermined amount. Responsive to the gaming system receiving an actuation of the BET UP button 273, the gaming system increases the player wager by a predetermined amount. Responsive to the gaming system receiving an actuation of the PLAY button 274, the gaming system places a wager and enrolls the player in the bingo game.

The gaming system also displays a plurality of meters including: (1) a credit meter 281 that indicates the player credit balance, (2) a wager meter 282 that displays the player total wager for a play of the bingo game, and (3) an award meter 283 that displays any awards the player won for a play of the bingo game. In this illustrated example embodiment, the awards for the play of the bingo game include any game-winning awards associated with the bingo game and any interim awards associated with the poker game (e.g., the interim bingo game). While in this example embodiment the gaming system indicates the player credit balance, the player wager, and any awards in credits, the gaming system may also indicate them in currency (e.g., U.S. dollars).

Figure 2A:
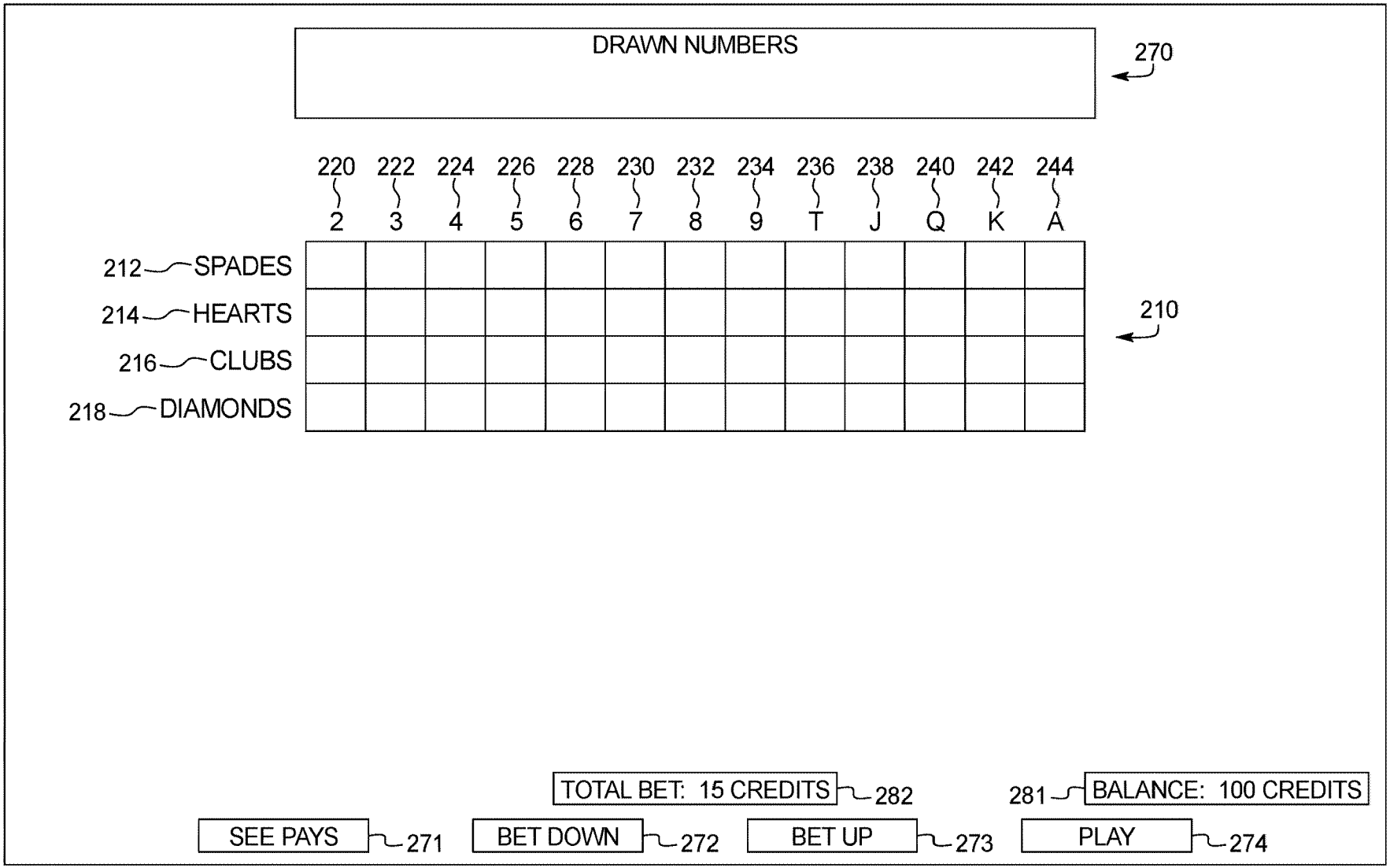
FIGS. 2A to 2G illustrate screen shots of one example Class II bingo game with an interim video poker game.

As illustrated in FIG. 2A, in this example embodiment, the gaming system receives a value (e.g., a monetary value), such as physical currency (or its equivalent), via an acceptor. Here, the gaming system provides the player 100 credits, which represents the received value, and displays the player credit balance of 100 credits in the credit meter 281. The gaming system receives an actuation of the PLAY button 274.

Figure 2B:
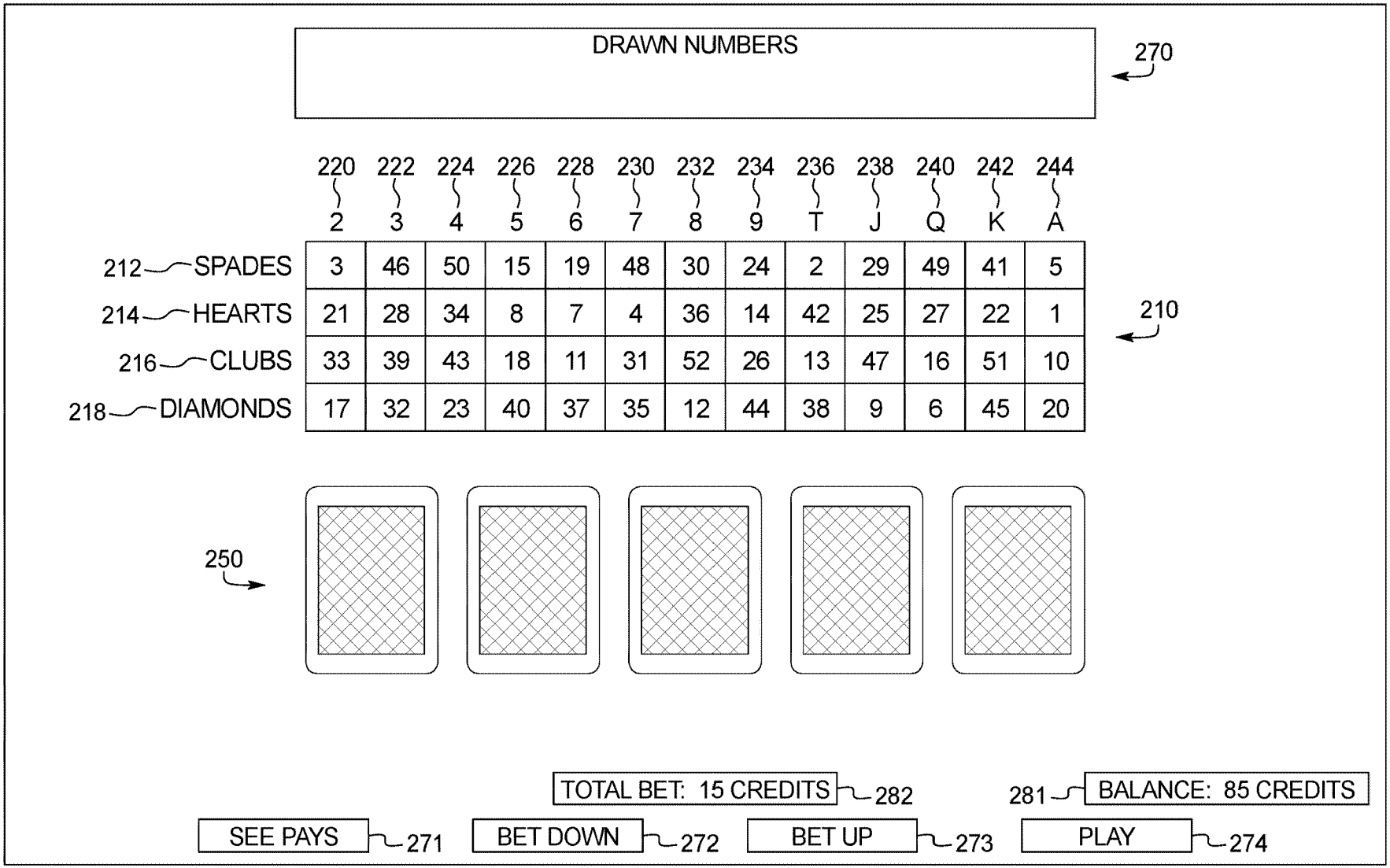

Responsive to the actuation of the PLAY button 274, the gaming system: (1) places a 15 credit bet on a play of the bingo game and deducts the 15 credit bet from the credit balance; (2) enrolls the player in the play of the bingo game; (3) as best shown in FIG. 2B, randomly determines a bingo card 210 for the player; and (4) displays a poker hand 250 with five placeholders for cards to eventually be in the poker hand (e.g., when the poker hand 250 is completed).

In this example embodiment, the bingo card 210 includes a 4 by 13 array of bingo spots, and each bingo spot includes a different bingo number of a set of bingo numbers 1-52. Each bingo spot on the bingo card 210 is associated with a different playing card that is static. For example, in this illustrated example embodiment, the Two of Spades "playing card" is assigned to the top-left spot on the bingo card 210 (e.g., row 212 and column 220 of the bingo card 210). While the playing card is assigned to the same bingo spot on the bingo card, the bingo numbers are randomly selected and distributed for each bingo card. Thus, in this example embodiment, the bingo number "3" corresponds to the Two of Spades "playing card," but in a different example embodiment, the bingo number "3" may correspond to a different playing card.

Figure 2C:
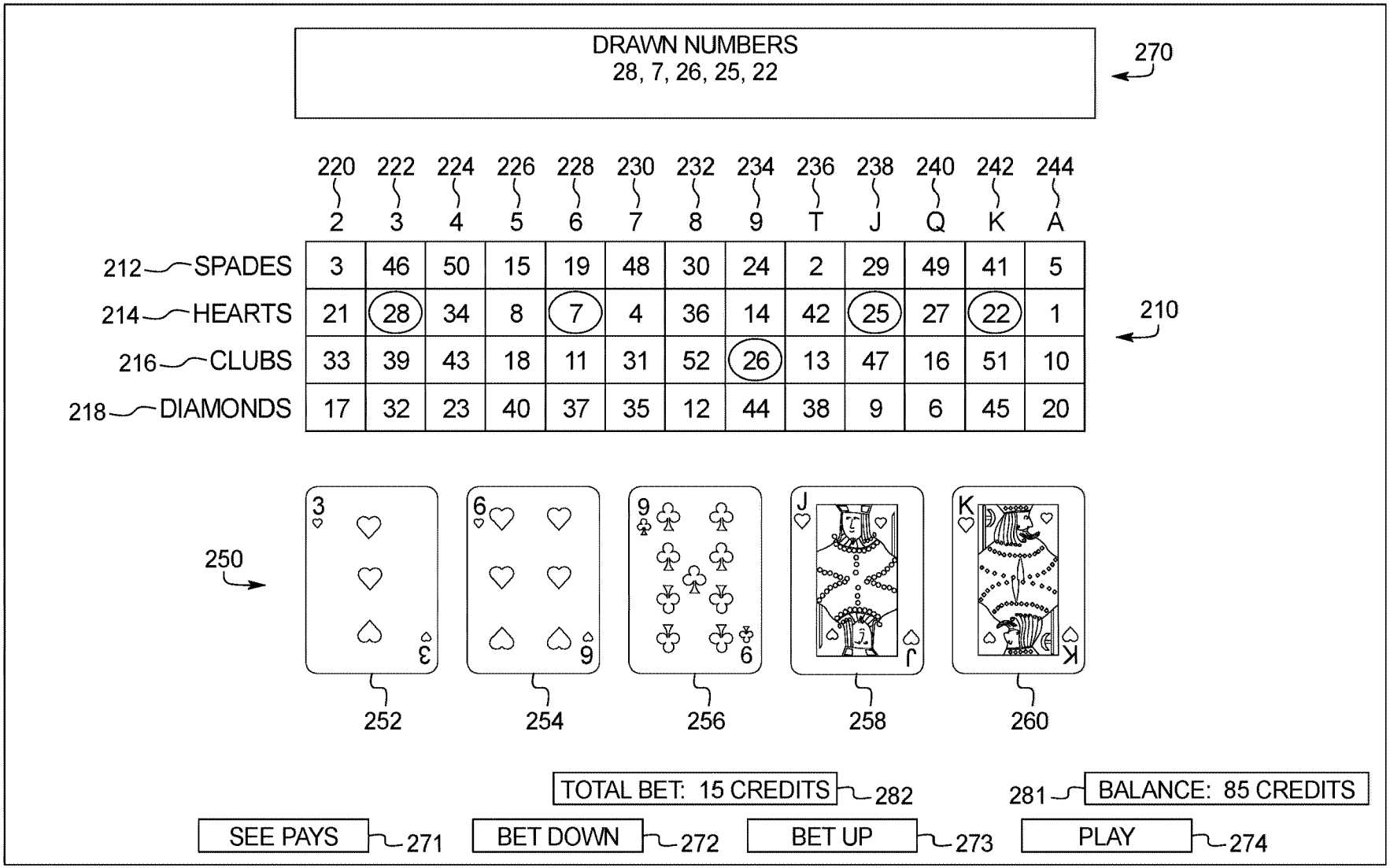

After the gaming system determines to initiate the play of the bingo game (e.g., by determining that a designated period of time since the first enrollment has expired or a minimum quantity of players has been enrolled in the play of the bingo game, the gaming system conducts a bingo number draw. In this example embodiment, the gaming system conducts an initial bingo number draw including five bingo numbers selected from the set of bingo numbers 1-52. As best shown in FIG. 2C, the gaming system randomly draws these initial bingo numbers from the set of bingo numbers 1-52 in the following order and displays them at a drawn bingo number display area 270: 28, 7, 26, 25, and 22. As also shown in FIG. 2C, the gaming system marks the spots on the bingo card 210 that are associated with the initial bingo number draw by circling the numbers in the bingo card 210.

In this example embodiment, the gaming system also populates the poker hand 250 by displaying playing cards corresponding to the marked bingo spots of the initial bingo number draw. For example, the first bingo number drawn by the gaming system is a "28," which corresponds to a Three of Hearts on the bingo card 210 (e.g., row 214 and column 222 of the bingo card 210). The gaming system then displays a 3♥ card 252 as the first card in the poker hand 250.

The second bingo number drawn by the gaming system is a "7," which corresponds to a Six of Hearts on the bingo card 210 (e.g., row 214 and column 228 of the bingo card 210). The gaming system then displays a 6♥ card 254 as the second card in the poker hand 250.

The third bingo number drawn by the gaming system is a "26," which corresponds to a Nine of Clubs on the bingo card 210 (e.g., row 216 and column 234 of the bingo card 210). The gaming system then displays a 9♣ card 256 as the third card in the poker hand 250.

The fourth bingo number drawn by the gaming system is a "25," which corresponds to a Jack of Hearts on the bingo card 210 (e.g., row 214 and column 238 of the bingo card 210). The gaming system then displays a J♥ card 258 as the fourth card in the poker hand 250.

The fifth bingo number drawn by the gaming system is a "22," which corresponds to a King of Hearts on the bingo card 210 (e.g., row 214 and column 242 of the bingo card 210). The gaming system then displays a K♥ card 260 as the fifth card in the poker hand 250.

Figure 2D:
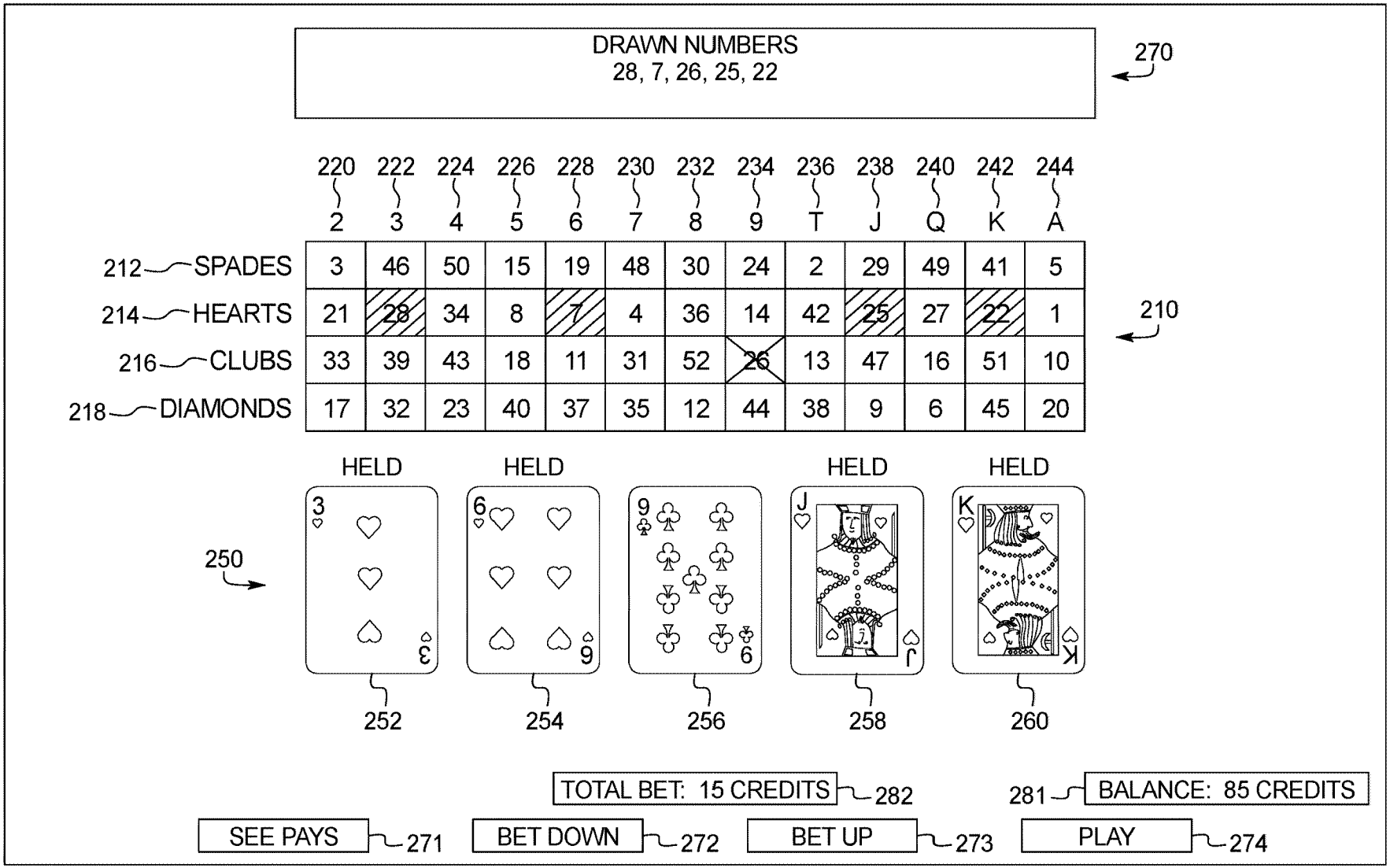

The gaming system then enables the player to choose zero, one or more of the poker cards 252, 254, 256, 258, and 260 corresponding to the initial bingo numbers drawn to hold. The player may choose to hold up to all of the cards 252, 254, 256, 258, and 260 of the poker hand 250. As best shown in FIG. 2D, the gaming system receives a selection (e.g., via a display associated with the gaming system) of the 3♥ card 252, the 6♥ card 254, the J♥ card 258 and the K♥ card 260 of the poker hand 250 to hold and designates those poker cards 252, 254, 258 and 260 as held cards.

In this example embodiment, when a poker card in the poker hand 250 is designated as a held-card (e.g., selected to be held by a player), the gaming system marks (or "daubs") the corresponding bingo spots on the bingo card 210. As show in FIG. 2D, the gaming system daubs the bingo spots corresponding to the 3♥ card 252 (e.g., bingo number "28"), the 6♥ card 254 (e.g., bingo number "7"), the J♥ card 258 (e.g., bingo number "25"), and the K♥ card 260 (e.g., bingo number "22") by filling in the respective bingo spots using a first daubing pattern. For example, the gaming system daubs the bingo spots using the first daubing pattern by shading the respective bingo spots with a blue color.

In this example embodiment, when the player completes their selections for held cards, the gaming system receives an actuation of the PLAY button 274. In response to the actuation of the PLAY button 274, the gaming system determines if the poker hand 250 includes any non-held cards and marks the corresponding bingo spots on the bingo card 210 using a second daubing pattern. As shown in FIG. 2D, the gaming system marks the bingo spot on the bingo card 210 corresponding to the 9♣ card 256 (e.g., bingo number "26") by filling in the respective bingo spot (e.g., row 216 and column 224 of the bingo card 210) using the second daubing pattern. For example, the gaming system marks the bingo spot on the bingo card 210 using the second daubing pattern by drawing an "X" in the respective spot.

Figure 2E:
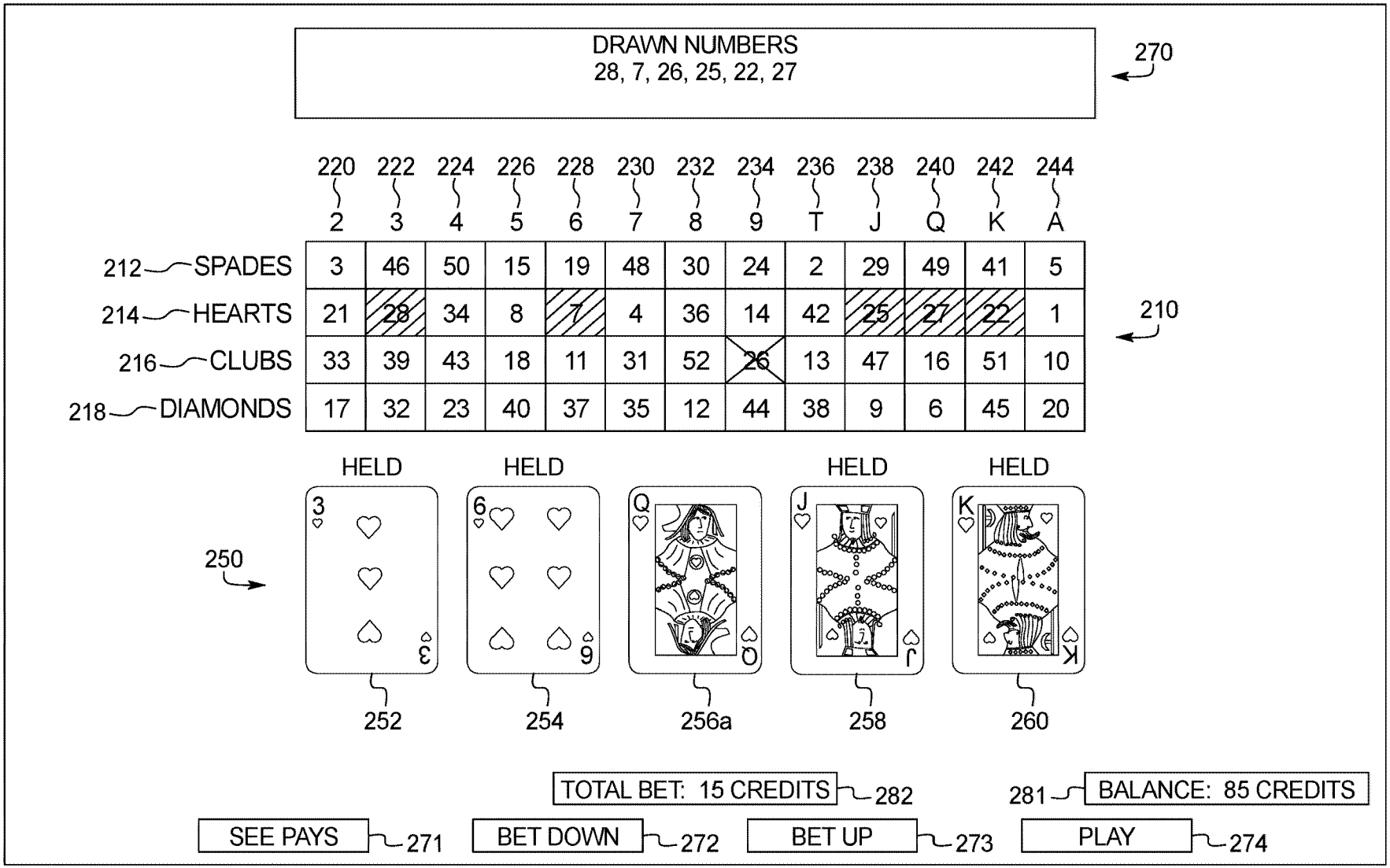

The gaming system then draws five additional bingo numbers from the set of bingo numbers 1-52 and daubs the corresponding bingo spots on the bingo card 210 using the first daubing pattern until five bingo spots on the bingo card 210 are daubed using the first daubing pattern. In this example embodiment, the gaming system daubs the bingo spots corresponding to the additional bingo numbers drawn using the first daubing pattern in the order that the additional bingo numbers are drawn (e.g., sequentially). As shown in the drawn bingo number display area 270 of FIG. 2E, the first additional bingo number drawn is a "27," which corresponds to a Queen of Hearts on the bingo card 210 (e.g., row 214 and column 240 of the bingo card 210). Because the total quantity of bingo spots daubed using the first daubing pattern is less than five bingo spots (e.g., four bingo spots currently daubed using the first daubing pattern), the gaming system accordingly automatically daubs the bingo spot on the bingo card 210 corresponding to the bingo number "27" using the first daubing pattern. As also shown in FIG. 2E, the gaming system replaces a non-held card from the poker hand 250 with a poker card that corresponds to the bingo number and the spot on the bingo card 210. In this example embodiment, the gaming system replaces the non-held 9♣ card 256 with a Q♥ card 256*a* in the poker hand 250 by mapping the bingo number "27" to the Queen of Hearts at row 214 and column 240 of the bingo card 210.

In this example embodiment, once the gaming system daubs five bingo spots on the bingo card 210 using the first daubing pattern, the gaming system daubs bingo spots corresponding to any additionally drawn bingo numbers using a third daubing pattern. For example, the gaming system daubs the additional bingo spots using the third daubing pattern by shading the respective bingo spots with an orange color. In this example embodiment, bingo spots daubed using the third daubing pattern do not contribute to the interim poker game, but may contribute towards a game-winning pattern associated with the bingo game.

Figure 2F:
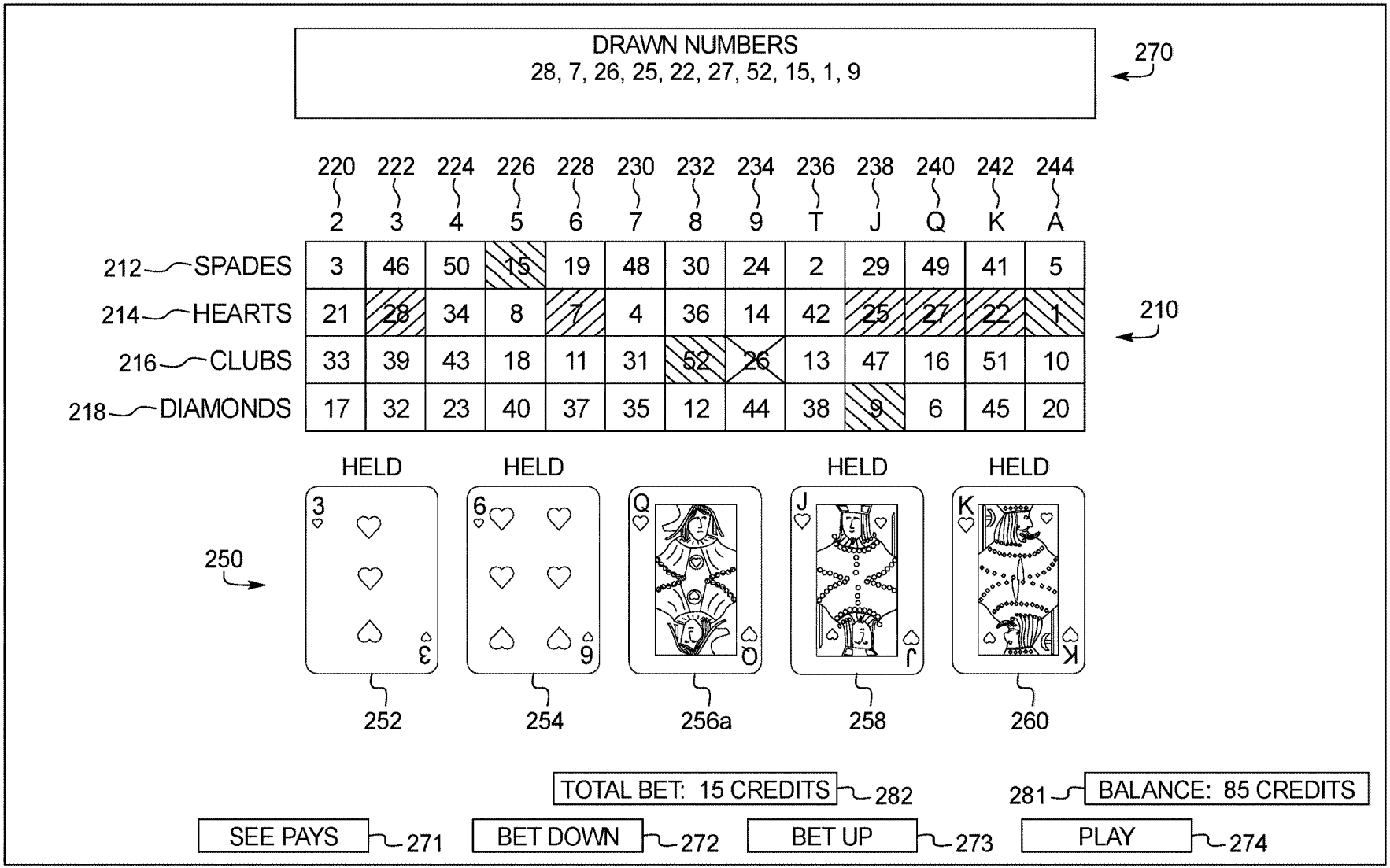

As shown in the drawn bingo number display area 270 of FIG. 2F, the second additional bingo number drawn by the gaming system is a "52," which corresponds to an Eight of Clubs on the bingo card 210 (e.g., row 216 and column 222 of the bingo card 210). The gaming system then daubs the bingo spot on the bingo card 210 corresponding to the bingo number "52" using the third daubing pattern.

The third additional bingo number drawn by the gaming system is a "15," which corresponds to a Five of Spades on the bingo card 210 (e.g., row 212 and column 226 of the bingo card 210). The gaming system then daubs the bingo spot on the bingo card 210 corresponding to the bingo number "15" using the third daubing pattern.

The fourth additional bingo number drawn by the gaming system is a "1," which corresponds to an Ace of Hearts on the bingo card 210 (e.g., row 214 and column 244 of the bingo card 210). The gaming system then daubs the bingo spot on the bingo card 210 corresponding to the bingo number "1" using the third daubing pattern.

The fifth additional bingo number drawn by the gaming system is a "9," which corresponds to a Jack of Diamonds on the bingo card 210 (e.g., row 218 and column 228 of the bingo card 210). The gaming system then daubs the bingo spot on the bingo card 210 corresponding to the bingo number "9" using the third daubing pattern.

In this example embodiment, the gaming system continues drawing additional bingo numbers from the remaining numbers in the set of bingo numbers 1-52 until a bingo card satisfies a game-winning pattern. In this example embodiment, the game-winning pattern is any single row on the bingo card being completely daubed out (e.g., all bingo spots of a row on the bingo card 210 are daubed using the first daubing pattern and/or the third daubing pattern). It should be appreciated that other game-winning patterns may additionally or alternatively be used.

Figure 2G:
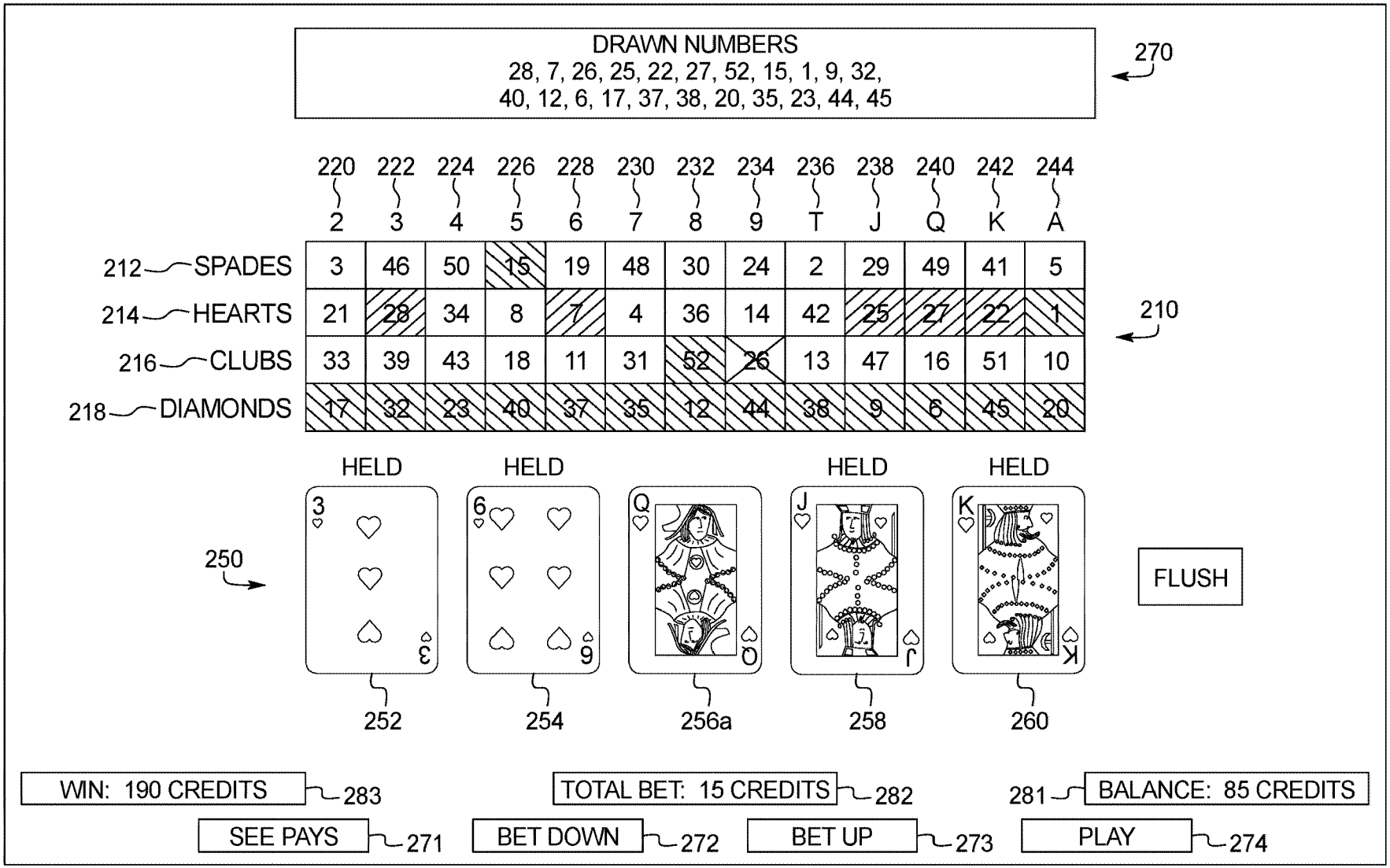

As shown in FIG. 2G, the gaming system drew the following additional bingo numbers from the set of bingo numbers 1-52 before the gaming system determined that a game-winning pattern was satisfied: 32, 40, 12, 6, 17, 37, 38, 20, 35, 23, 44, and 45. In this example embodiment, the bingo card 210 satisfies the game-winning pattern when the gaming system daubed each bingo spot of the Diamonds row 218 of the bingo card 210 with either the first daubing pattern or the third daubing pattern based on the drawn bingo numbers.

In this example embodiment, once the gaming system determines a bingo card satisfies a game-winning pattern, the gaming system determines whether to issue any awards to the players of the bingo game. In this example embodiment, the gaming system determines (1) whether to issue any first awards for the bingo game, and (2) whether to issue any second awards for the interim poker game.

The gaming system issues or provides the player any awards for the bingo game. In this example embodiment, the game-winning pattern is associated with a 100 credit award. It should be appreciated that other credit awards may additionally or alternatively by issued or provided to the player for the game-winning pattern and/or additional game-winning patterns.

To determine whether to issue any second awards for the interim poker game, the gaming system compares the bingo spots of the bingo card 210 that are daubed using the first daubing pattern to interim bingo patterns that represent wins in the poker game, such as some of the example interim bingo patterns illustrated in FIGS. 3A to 3I and disclosed below. In this example embodiment, the gaming system determines that the bingo spots of the bingo card 210 daubed using the first daubing pattern satisfy an interim bingo pattern corresponding to a Flush winning hand. In particular, the bingo spots of the bingo card 210 daubed using the first daubing pattern (e.g., the bingo spots associated with the bingo numbers "28," "7," "25," "22" and "27") satisfy a Flush (e.g., a five-spot pattern covering five playing cards of a single suit (e.g., five bingo spots in the Hearts row 214 of the bingo card 210)).

The poker hand 250 including the 3♥ card 252, the 6♥ card 254, the Q♥ card 256*a*, the J♥ card 258 and the K♥ card 260 also represents a Flush winning hand for the player. In this example embodiment, the gaming system issues the player a credit award in accordance with a poker paytable. The poker paytable is determined based on the wager (or in other embodiments, the wagering game's denomination). Table 1 below includes an example paytable for a 15 credit wager on the bingo game. The example paytable of Table 1 includes different example winning hand categories, example winning hands associated with the different winning hand categories, and example awards associated with the wining hand categories. The winning hand categories are listed from highest to lowest ranking. Although not shown in Table 1, winning hands are also ranked within the different winning hand categories as is known in the art. In this example embodiment, the winning hands of the "Jacks or Better" winning hand category include a pair of Jacks, a pair of Queens, a pair of Kings, and a pair of Aces. In this example embodiment, using the poker paytable shown in Table 1, the gaming system issues the player a 90 credit award for their bingo card 210 matching the Flush interim bingo pattern.

TABLE 1

Winning hand categories, example winning hands, and awards for example Jacks or Better Five Card Draw Poker (15 credit wager)

| Winning Hand Category | Example Winning Hand | Award (15 credit bet) |
|---|---|---|
| Royal Flush | A♣K♣Q♣J♣10♣ | 12000 |
| Straight Flush | 10♣9♣8♣7♣6♣ | 750 |
| Four of a Kind | J♣J♥ J♦ J♣3♠ | 375 |
| Full House | A♥ A♦ A♣6♦ 6♣ | 135 |
| Flush | A♣J♣8♣6♣2♣ | 90 |
| Straight | 8♦ 7♣6♠5♠4♣ | 60 |
| Three of a Kind | Q♠Q♥ Q♦ 6♦ 2♠ | 45 |
| Two Pair | 8♦ 8♥ 5♥ 5♣2♠ | 30 |
| Jacks or Better | K♦ K♠8♣7♣2♥ | 15 |

In this example embodiment, the gaming system determines to award the player associated with the bingo card 210 190 credits (e.g., 100 credits for the game-winning pattern and 90 credits for the interim bingo pattern) and displays the 190 credit award in the award meter 283.

FIGS. 3A to 3I illustrate portions of example interim bingo patterns that represent wins or winning hands in the poker game. The example interim bingo patterns of FIGS. 3A to 3I do not include numbers in the bingo spots because an interim bingo pattern win is based on the position of the bingo spot hits (e.g., bingo spots daubed using the first daubing pattern) and not the numbers that each bingo spot contains. For example, a Four of a Kind (Queens) is satisfied when any combination of drawn bingo numbers from the set of bingo numbers 1-52 results in the four bingo spots of the Queen column 240 of the bingo card 210 are daubed using the first daubing pattern.

Figure 3A:
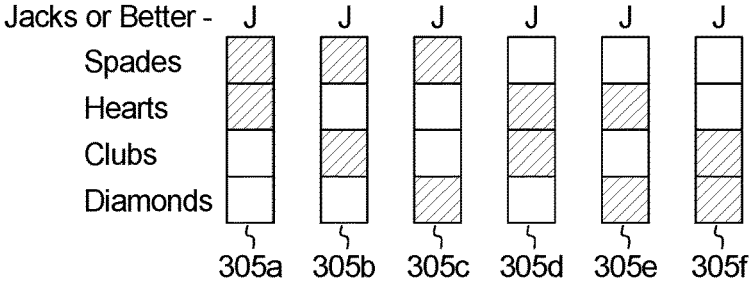
FIGS. 3A to 3I show portions of bingo cards with example interim bingo patterns marked.

FIG. 3A shows interim bingo patterns 305*a*, 305*b*, 305*c*, 305*d*, 305*e*, and 305*f* that represent example two-spot patterns for winning a Jacks or Better hand. Example ways to win a Jacks or Better interim bingo pattern can be represented as a two-spot pattern covering two playing cards with the same face value, such as Jack, Queen, King or Ace. Six example winning patterns for Jacks are shown in FIG. 3A, though other interim patterns exist for winning with Queens, Kings or Aces.

Figure 3B:
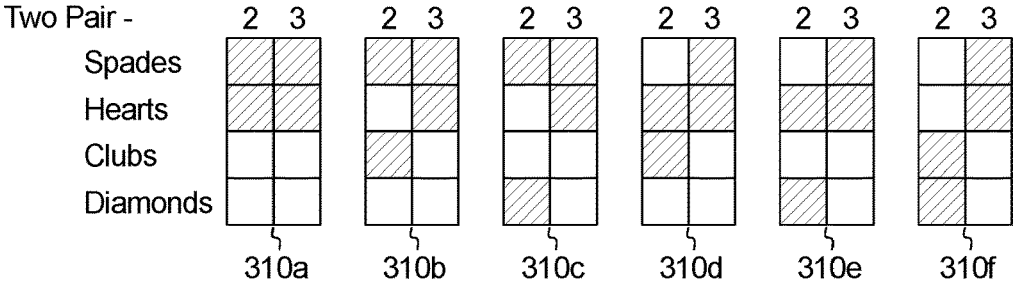

FIG. 3B shows interim bingo patterns 310*a*, 310*b*, 310*c*, 310*d*, 310*e*, and 310*f* that represent example four-spot patterns for winning a Two Pair hand. Example ways to win a Two Pair interim bingo pattern can be represented as a four-spot pattern covering two sets of two playing cards with the same face value (e.g., two bingo spots within the same row). FIG. 3B illustrates six of the possible thirty-six interim bingo patterns that correspond to a Two Pair win including a pair of Twos and a pair of Threes. It should be appreciated that other interim bingo patterns exist that correspond to a Two Pair win including other combinations of pairs.

Figure 3C:
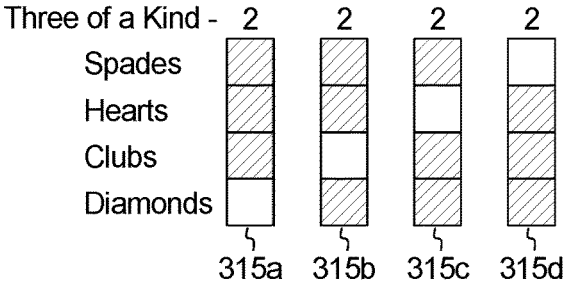

FIG. 3C shows interim bingo patterns 315*a*, 315*b*, 315*c*, and 315*d* that represent example three-spot patterns for winning a Three of a Kind hand. Example ways to win a Three of a Kind interim bingo pattern can be represented as a three-spot pattern covering three playing cards with the same card value, including face cards. Four example winning patterns for a Three of a Kind interim bingo pattern with Twos are shown in FIG. 3C, though other interim bingo patterns exist for winning with other card values.

Figure 3D:
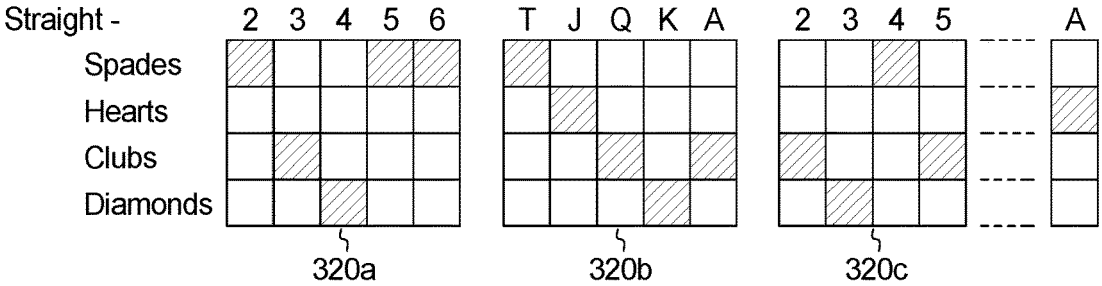

FIG. 3D shows interim bingo patterns 320*a*, 320*b*, and 320*c* that represent example five-spot patterns for winning a Straight hand. Example ways to win a Straight interim bingo pattern can be represented as a five-spot pattern covering five consecutive playing card values (e.g., five consecutive columns of the bingo card). FIG. 3D illustrates three example interim bingo patterns for winning a Straight hand, though other interim bingo patterns exist for winning with other card values.

Figure 3E:
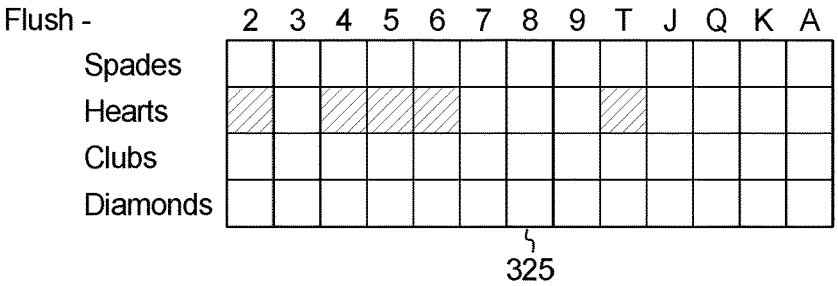

FIG. 3E shows an interim bingo pattern 325 that represents an example five-spot pattern for winning a Flush hand. Example ways to win a Flush interim bingo pattern can be represented as a five-spot pattern covering five playing cards in a single suit (e.g., five bingo spots in the same row of the bingo card). It should be appreciated that other interim bingo patterns exist for winning a Flush hand with other card values.

Figure 3F:
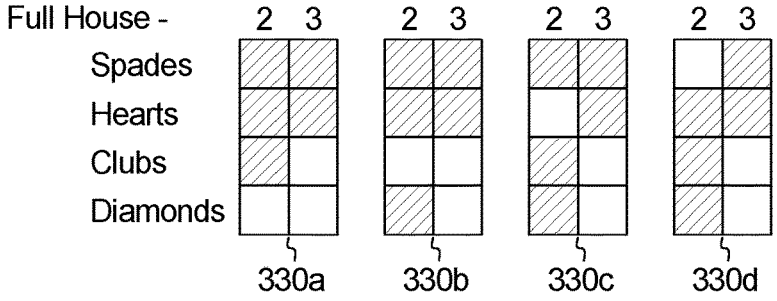

FIG. 3F shows interim bingo patterns 330*a*, 330*b*, 330*c*, and 330*d* that represent example five-spot patterns for winning a Full House hand. Example ways to win a Full House interim bingo pattern can be represented as a five-spot pattern covering three playing cards having a first card value (e.g., three bingo spots in a first column of a bingo card) and two playing cards having a second card value (e.g., two bingo spots in a second column of the bingo card). FIG. 3F illustrates four of the possible forty-eight interim bingo patterns that correspond to a Full House win including three Twos and a pair of Threes. It should be appreciated that other interim bingo patterns exist that correspond to a Full House win including other combinations of card values.

Figure 3G:
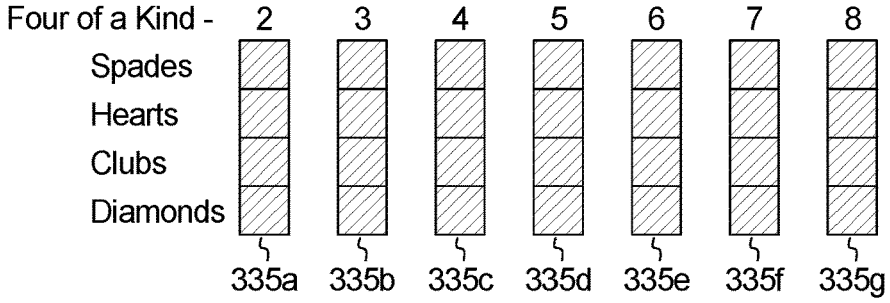

FIG. 3G shows interim bingo patterns 335*a*, 335*b*, 335*c*, 335*d*, 335*e*, 335*f*, and 335*g* that represent example four-spot patterns for winning a Four of a Kind hand. Example ways to win a Four of a Kind interim bingo pattern can be represented as a four-spot pattern covering four playing cards with the same card value, including face cards. FIG. 3G illustrates seven of the possible 13 winning interim bingo patterns for a Four of a Kind hand.

Figure 3H:
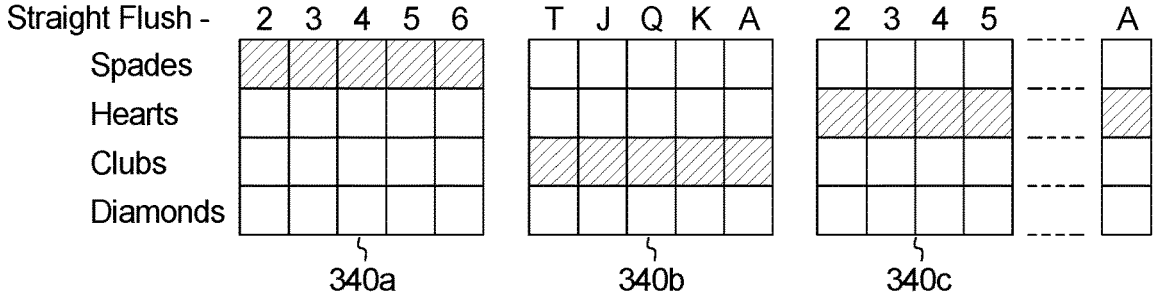

FIG. 3H shows interim bingo patterns 340*a*, 340*b*, and 340*c* that represent example five-spot patterns for winning a Straight Flush hand. Example ways to win a Straight Flush interim bingo pattern can be represented as a five-spot pattern covering five consecutive playing cards of the same card suit (e.g., five consecutive (e.g., adjacent) bingo spots within the same row of a bingo card). FIG. 3H illustrates three example interim bingo patterns for winning a Straight Flush hand, though other interim bingo patterns exist for winning with other card values.

Figure 3I:
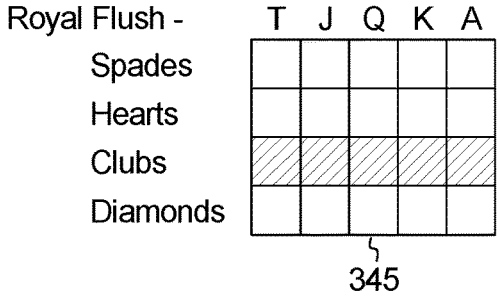

FIG. 3I shows an interim bingo pattern 345 that represents an example five-spot pattern for winning a Royal Flush hand. Example ways to win a Royal Flush interim bingo pattern can be represented as a five-spot pattern covering the Ten, the Jack, the Queen, the King and the Ace playing cards in a single suit (e.g., five bingo spots in the same row of a bingo card). It should be appreciated that other interim bingo patterns exist for winning a Royal Flush hand with other card values.

The number of different ways to hit each poker win is well-known in the industry. Accordingly, it should be appreciated that creating interim bingo patterns for each poker win should be straight-forward for one of ordinary skill in the art.

It should be appreciated from the above that the present disclosure provides that, in various embodiments, the gaming system and method of the present disclosure provides a Class II bingo game with an interim single-hand video poker game. In one such illustrative example embodiment, the gaming system initially draws five random bingo numbers and displays playing cards that map to those bingo numbers on the bingo card as a poker hand. The gaming system then enables the player to choose which, if any, of the initial poker cards to hold. The gaming system then daubs the bingo spots on the bingo card that correspond to the selected poker cards using a first daubing pattern. If a poker card is not selected for holding (e.g., is designated as a non-held card), the gaming system does not daub the corresponding bingo spot on the bingo card (or, alternatively, the gaming system marks the corresponding bingo spot using a second daubing pattern). In this example embodiment, the gaming system then randomly draws additional bingo numbers from the set of bingo numbers 1-52 until: (1) five bingo spots are daubed using the first daubing pattern, and (2) a game-winning pattern is identified on a bingo card of the play of the bingo game. The gaming system also replaces any non-held poker cards with poker cards that match the additional bingo numbers until the poker hand contains five poker cards. Thus, the five bingo spots that are daubed using the first daubing pattern are also the same poker cards of the poker hand. In this example embodiment, the gaming system then issues any first awards to the first player for hitting the game-winning pattern. The gaming system then issues any second awards to each player for the highest interim bingo pattern that matches the first five bingo spots daubed by the gaming system on their respective bingo cards.

4. General Explanation of Class II Bingo Game with Interim Multi-Hand Video Poker Game In various embodiments, the gaming system facilitates a bingo game with an interim multi-hand poker game. For example, for a play of the bingo game having an interim three-hand poker game, the gaming system assigns four bingo cards (that have the associated playing cards and bingo numbers) to different players. In this example, the gaming system uses a first one of the four bingo cards towards satisfying the game-winning pattern (e.g., a primary bingo card) and uses the remaining three bingo cards towards satisfying, if any, poker winning hands (e.g., poker bingo cards).

In this example, once the bingo cards are assigned to the different players, the gaming system randomly draws five initial bingo numbers from the set of 52 bingo numbers. For each primary bingo card for each different player, the gaming system uses these five initial bingo numbers to determine and display to that player the corresponding five initial bingo spots on that player's primary bingo card and the corresponding five initial poker cards that correspond to those five initially drawn bingo numbers. The gaming system then enables each player to select from zero to five of their displayed poker cards to hold. For each player, for each poker card held by that player, the gaming system daubs the corresponding bingo spot on that player's primary bingo card. For each player, the gaming system then daubs the bingo spots corresponding to the playing cards on the poker bingo cards that correspond to the held cards. For example, the gaming system overlaps the player's primary bingo card with each of their poker bingo cards and daubs the bingo spots on each of the poker bingo cards so that the same bingo spots are daubed on each of the poker bingo cards. For example, if the player holds the Ace of Spades card from their displayed poker cards, the gaming system daubs the bingo spots on each of the poker bingo spots that correspond to the Ace of Spades card. The gaming system then displays, to each player, poker hands including the held cards, if any, for each of the poker bingo cards. For example, if the player holds two cards of their displayed five playing cards, for each poker bingo card associated with the player, the gaming system displays a corresponding poker hand including the two held cards (e.g., the held cards of the displayed five playing cards are duplicated into the poker hands associated with the poker bingo cards).

The gaming system then randomly draws at least five additional bingo numbers from the set of remaining numbers and automatically daubs the corresponding bingo spots for each of the primary bingo cards. For each poker bingo card, the gaming system also determines whether the quantity of bingo spots daubed on the poker bingo card is less than a threshold (e.g., five daubed bingo spots). If the quantity of bingo spots daubed on the poker bingo card is less than the threshold (e.g., less than five daubed bingo spots), the gaming system automatically daubs the corresponding bongo spot on the poker bingo card. The gaming system also adds and displays (to each player) a poker card corresponding to the daubed bingo spot to the poker hand corresponding to the poker bingo card. In this example, once the quantity of bingo spots daubed on a poker bingo card satisfies the threshold (e.g., the poker bingo card has five daubed bingo spots), the gaming system stops daubing bingo spots on that poker bingo card.

In this example embodiment, the gaming system continues drawing additional bingo numbers until one of the primary bingo cards of the play of the bingo game satisfies a game-winning pattern (e.g., all thirteen spots of a row of the primary bingo card are daubed) based on the bingo spots daubed on that primary bingo card. Once the gaming system detects a game-winning pattern, the gaming system issues any first award(s) to the player whose primary bingo card satisfied the game-winning pattern. For each of the poker bingo cards and their corresponding poker hands, the gaming system then issues any second (or interim) awards to the respective players based on the highest paying poker winning hand, if any, that they have. Thus, while the first player (or players) to satisfy the game-winning pattern are issued any first awards (e.g., for their primary bingo cards satisfying the game-winning pattern), each of the players of the play of the bingo game may win any second awards (e.g., for their final (or complete) poker hands).

This gaming system is advantageous because the same bingo numbers are available to or daubable by all players of a play of a bingo game, and all of the players are playing with the same ball draw. For example, each bingo number drawn is available to all of the players to daub. Additionally, because the poker cards correspond to physical positions on the bingo card, every winning poker hand corresponds to a physical pattern on the bingo card. For example, a Four of a Kind winning poker hand may correspond to all four bingo spots of a column of the bingo card being daubed. Thus, all players are playing with the same patterns, and each pattern has the same pay and probability for all players. The gaming system also does not need to determine, using memory intensive poker paytables, which poker hands can be dealt for which win amounts or attempt to approximate their actual probability of occurrence in poker.

Figure 4A:
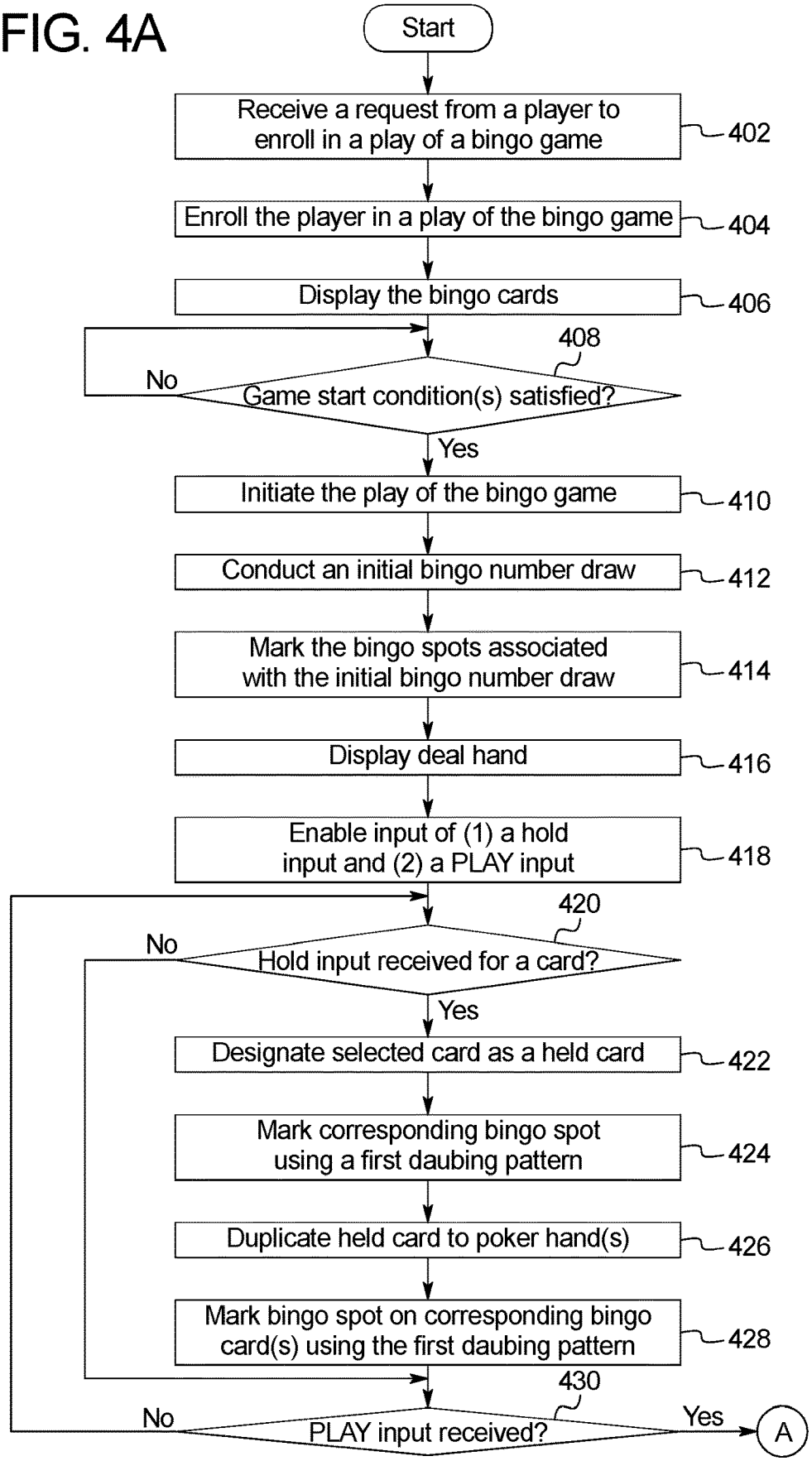
FIGS. 4A and 4B are flowcharts of an example process or method of operating a gaming system of the present disclosure to provide an example Class II bingo game with an interim video multi-hand poker game.
Figure 4B:
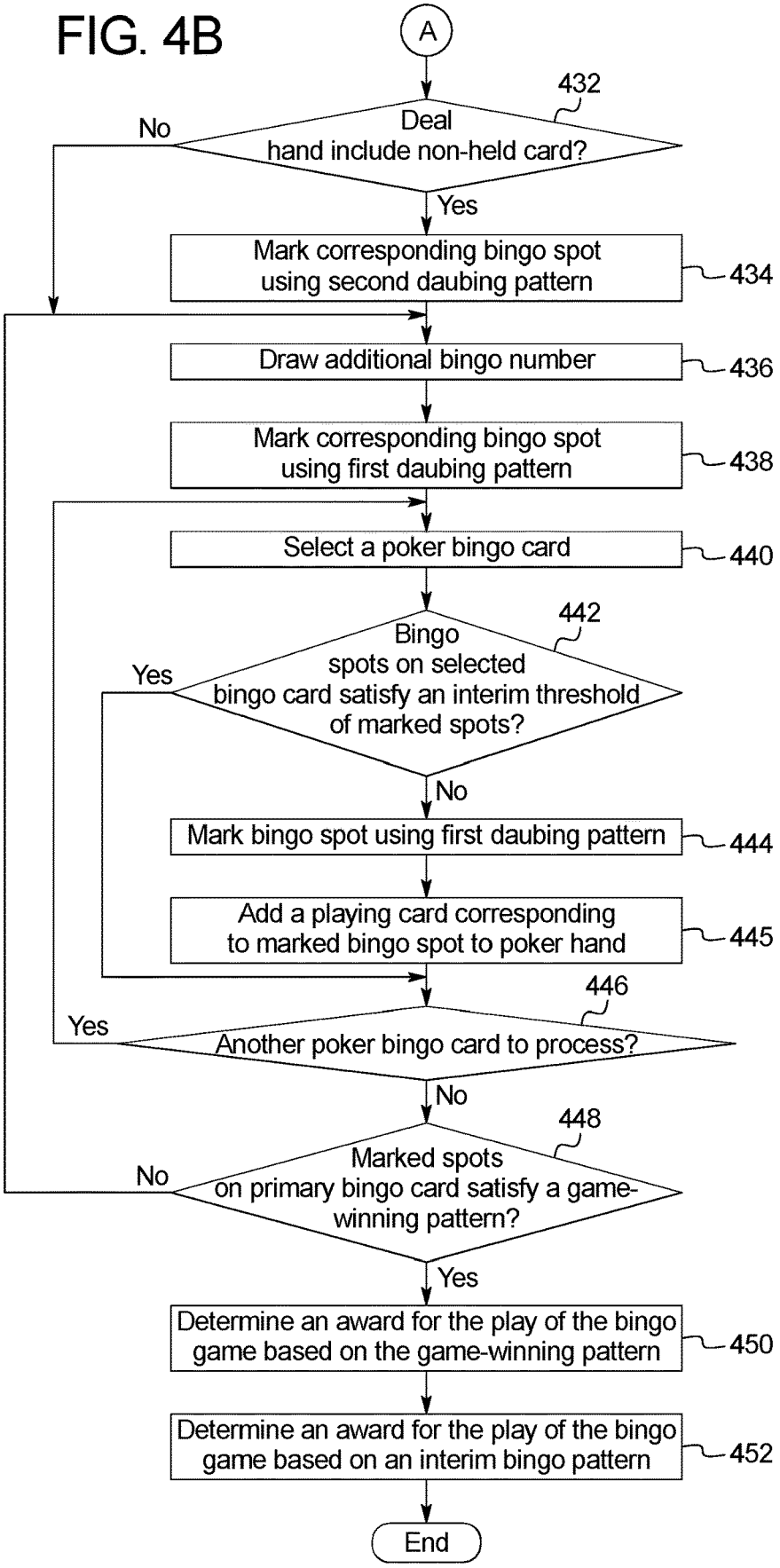

5. Example Method of Class II Bingo Game with Interim Multi-Hand Video Poker Game FIGS. 4A and 4B are flowcharts of an example process or method 400 of operating a gaming system of various embodiments of the present disclosure to provide an example bingo game with an interim video multi-hand poker game. In various embodiments, a set of instructions stored in one or more memories and executed by one or more processors represents the process 400. Although the process 400 is described with reference to the flowcharts shown in FIGS. 4A and 4B, many other processes of performing the acts associated with this process 400 may be employed. For example, the order of certain of the blocks or diamonds may be changed, certain of the blocks or diamonds may be optional, or certain of the blocks or diamonds may not be employed.

In operation of this example embodiment, the process 400 begins after the gaming system receives an enrollment request from a player who desires to enroll in a play of a bingo game, as block 402 indicates. In this example embodiment, the bingo game also includes play of an interim video multi-hand poker game (e.g., Three Hand Poker). Responsive to receiving the enrollment request, the gaming system enrolls the player in the play of the bingo game, as block 404 indicates. For example, the gaming system randomly determines a primary bingo card and three poker bingo cards for the player. In this example embodiment, the primary bingo card is used to determine any game-winning award, and each of the poker bingo cards is used to determine any interim awards. The bingo cards include a matrix of spots or bingo number display areas (such as a 4 by 13 array of bingo spots or any other suitable array of bingo spots). In this example embodiment, each different bingo spot of the respective bingo cards corresponds to a different playing card of a standard 52-card deck of cards. For example, each row of the bingo cards corresponds to a respective card suit (e.g., Diamonds, Spades, Clubs, and Hearts) and each column of the bingo cards corresponds to a respective card value (e.g., Ace, Two, Three, Four, Five, Six, Seven, Eight, Nine, Ten, Jack, Queen and King) so that each bingo spot of the bingo cards is associated with a different playing card (e.g., Two of Spades, Three of Clubs, etc.). The gaming system randomly associates or maps multiple bingo numbers of a set of a plurality of different bingo numbers (such as bingo numbers 1-52 or any other suitable quantity of bingo numbers (which may have any suitable values)) to the bingo spots such that each bingo spot of each of the bingo cards (1) is associated with a different one of the bingo numbers of the set of bingo numbers and (2) is associated with a different playing card. Thus, using the bingo cards, each bingo number of the set of different bingo numbers maps to a different playing card. In various embodiments, the bingo cards may be prepared in advance instead of responsive to receipt of a player request to enroll in the bingo game. The gaming system displays the bingo cards, as block 406 indicates. The gaming system also displays five placeholders for poker cards that will be populated during play of the bingo game for each of the primary bingo card and the three poker bingo cards.

The gaming system determines whether game start condition(s) are satisfied to initiate play of the bingo game, as diamond 408 indicates. For example, the gaming system determines whether (1) a designated period of time since the first player enrollment has expired and/or (2) a minimum quantity of players has been enrolled in the play of the bingo game (depending on the embodiment). If neither the designated period of time has expired nor the minimum quantity of players has been enrolled in the play of the bingo game, the gaming system continues to wait for requests to enroll in the play of the bingo game. If either the designated period of time has expired or the minimum quantity of players has been enrolled in the play of the bingo game, the gaming system initiates the play of the bingo game, as block 410 indicates.

The gaming system conducts an initial bingo number draw by randomly selecting five bingo numbers of the set of bingo numbers, as block 412 indicates. For the primary bingo card of each player, the gaming system marks any bingo spot(s) associated with the initial bingo number draw, as block 414 indicates. For example, the gaming system circles, on the primary bingo card, each bingo spot corresponding to each of the respective bingo numbers of the initial bingo number draw. The gaming system then displays a deal hand based on the bingo numbers of the initial bingo number draw, as block 416 indicates. For example, the gaming system uses the primary bingo card to map each of the bingo numbers of the initial bingo number draw to a playing card. The gaming system then populates the deal hand by displaying playing cards mapped to the initial bingo number draw in the placeholders associated with the primary bingo card.

After displaying the deal hand, the gaming system enables player input of (1) a hold input for each playing card of the deal hand, and (2) a PLAY input, as block 418 indicates. As diamond 420 and diamond 430 indicate, the gaming system monitors for receipt of the card hold input (or inputs) or the PLAY input. This enables the player to choose which of the playing cards of the deal hand (if any) to hold and which poker card (or cards) to discard (if any).

Responsive to the gaming system determining at diamond 420 that a card hold input identifying a particular playing card of the deal hand has been received, the gaming system designates that playing card as a held card, as block 122 indicates. For example, the player may select (e.g., via an input device) to hold the second playing card, the fourth playing card, and the fifth playing card of the deal hand. In such a case, the gaming system then designates each of the second playing card, the fourth playing card, and the fifth playing card of the deal hand as held cards. The gaming system then marks the bingo spot(s) on the primary bingo card corresponding to each of the held cards, as block 424 indicates. For example, the gaming system may apply a first daubing pattern to each of the respective bingo spots of the primary bingo card that correspond to the second playing card, the fourth playing card, and the fifth playing card of the deal hand. In this example embodiment, marking the bingo spot using the first daubing pattern includes shading the bingo spot of the primary bingo card a blue color. However, the gaming system may additionally or alternatively use other techniques for marking the bingo spot using a first daubing pattern.

The gaming system then duplicates each of the held cards from the deal hand to the poker hands in this illustrated example embodiment, as block 426 indicates. For example, the gaming system reveals a face-up playing card in each of the poker hands having the same suit and card value as the held card in the deal hand. In the above example in which the second playing card, the fourth playing, and the fifth playing card are designated as held cards, the example gaming system duplicates the second playing card, the fourth playing card, and the fifth playing card of the deal hand to each of the respective poker hands.

The gaming system then marks the bingo spots on the corresponding poker bingo cards using the first daubing pattern as block 428 indicates. In this example embodiment, the gaming system overlaps the primary bingo card and a first poker bingo card and then mark bingo spots on the first poker bingo card using the first daubing pattern so that the same bingo spots are marked on both the primary bingo card and the first poker bingo card. For example, if the gaming system daubed the bingo spot on the primary bingo card that corresponds to a Two of Spades, the gaming system then daubs the bingo spot on the first poker bingo card that also corresponds to the Two of Spades. The process 400 then proceeds to diamond 430. Responsive to the gaming system determining at diamond 430 that a PLAY input has not been received, the process 400 returns to diamond 420.

Responsive to the gaming system determining at diamond 430 that the PLAY input has been received, the gaming system determines whether the deal hand includes any non-held cards, as diamond 432 indicates. For example, the gaming system may designate playing card(s) that were not selected to be held card(s) by the player as non-held cards. In the above example in which the second playing card, the fourth poker card, and the fifth playing card were designated as held cards in the deal hand, the gaming system designates the first playing card and the third playing card of the deal hand as non-held cards.

Responsive to the gaming system determining at diamond 432 that the deal hand does not include any non-held cards (e.g., all of the playing cards of the deal hand were selected to be held cards), the process 400 proceeds to block 436, as described below. But, responsive to the gaming system determining at diamond 432 that the deal hand includes at least one non-held card, the gaming system marks the bingo spot(s) corresponding to each of the non-held card(s), as block 434 indicates. For example, the gaming system applies a second daubing pattern to the bingo spots that correspond to the first playing card and the third playing card of the deal hand on each of the primary bingo card and the poker bingo cards. In this example embodiment, marking the bingo spot using the second daubing pattern includes drawing an "X" through the bingo spot on the bingo card. However, the gaming system may additionally or alternatively use other techniques for marking a bingo spot using the second daubing pattern. As disclosed below, in this example embodiment, bingo spots marked using the second daubing pattern are not considered when determining whether the bingo card satisfies a game-winning pattern and/or an interim bingo pattern.

The gaming system then draws an additional bingo number from the remaining numbers of the set of bingo numbers, as block 436 indicates. As block 436 and diamond 448 indicate, the gaming system continues drawing additional bingo numbers from the remaining numbers of the set of bingo numbers until the gaming system detects a game-winning pattern on the primary bingo card. After an additional bingo number is drawn, at block 436, the gaming system marks the corresponding bingo spot on the primary bingo card, as block 438 indicates. For example, the gaming system marks the bingo spot on the primary bingo card using the first daubing pattern.

The gaming system then selects a poker bingo card to process, as block 440 indicates. After the gaming system selects a poker bingo card to process, the gaming system determines whether the quantity of bingo spots of the selected poker bingo card that are marked using the first daubing pattern (e.g., shaded a blue color) satisfy an interim pattern threshold, as diamond 442 indicates. For example, the gaming system may determine whether five bingo spots of the selected poker bingo card are marked using the first daubing pattern. Responsive to the gaming system determining at diamond 442 that the quantity of bingo spots of the selected poker bingo card marked using the first daubing pattern does not satisfy the interim pattern threshold (e.g., the selected poker bingo card includes less than five bingo spots that are marked using the first daubing pattern), then the gaming system marks the bingo spot of the selected bingo card corresponding to the additional bingo number drawn using the first daubing pattern, as block 444 indicates. The gaming system then adds a playing card corresponding to the marked bingo spot to the poker hand associated with the selected poker bingo card, as block 445 indicates. Example process 400 then proceeds to diamond 446, described below.

Responsive to the gaming system determining at diamond 442 that the quantity of bingo spots of the selected poker bingo card marked using the first daubing pattern satisfies the interim pattern threshold (e.g., the selected poker bingo card includes five bingo spots that are marked using the first daubing pattern), then the process 400 proceeds to diamond 446 to determine whether there is another poker bingo card to process. Responsive to the gaming system determining at diamond 446 that there is another poker bingo card to process, the example process 400 returns to block 440 to select another poker bingo card to process.

Responsive to the gaming system determining at diamond 446 that there is not another poker bingo card to process (e.g., in this example embodiment, the gaming system has processed all three poker bingo cards), the gaming system then determines, for each player of the play of the bingo game, whether the marked spots on their respective primary bingo cards satisfy a game-winning pattern, as diamond 448 indicates. For example, the gaming system may compare the bingo spots that are marked with the first daubing pattern on each of the primary bingo cards to the game-winning pattern. In this example embodiment, the game-winning pattern is all of the bingo spots of a row of the primary bingo card being marked using either the first daubing pattern. However, it should be appreciated that other game-winning patterns may additionally or alternatively be used by the gaming system. Responsive to the gaming system determining, at diamond 448, that the marked spots on each of the primary bingo cards do not satisfy the game-winning pattern (e.g., no primary bingo card of the play of the bingo game has all bingo spots of a row marked using the first daubing pattern), the process 400 returns to block 436 to draw an additional bingo number from the remaining number of the set of bingo numbers.

Responsive to the gaming system determining, at diamond 448, that the marked spots on a primary bingo card of the instant play of the bingo game satisfy the game-winning pattern, then the gaming system determines an award for the play of the bingo game based on the game-winning pattern, as block 450 indicates. In this example embodiment, the first player (or players) whose primary bingo card satisfies the game-winning pattern is awarded a game-winning award, while other players of the play of the bingo game are not awarded any game-winning award.

The gaming system then determines an award for the play of the bingo game based on an interim bingo pattern identified on the poker bingo cards, as block 452 indicates. In this example embodiment, interim bingo patterns correspond to winning poker hands. For example, the gaming system may select the first poker bingo card and then determine that a four-spot pattern on the first poker bingo card, where each bingo spot is in the same column of the first poker bingo card, corresponds to a Four of a Kind winning poker hand. In this example embodiment, when comparing the marked spots on the first poker bingo card to the interim bingo patterns, the gaming system uses the five bingo spots that were marked (e.g., daubed) on the first poker bingo card using the first daubing pattern. The gaming system then determines any interim bingo award to issue or award to the player based on the highest poker win associated with the first poker bingo card, if any.

The gaming system then repeats the determining of any interim bingo awards based on the respective additional poker bingo cards. In this example embodiment, the poker bingo cards of each player included in the play of the bingo game is assessed against the interim bingo patterns for respective interim bingo awards. Accordingly, up to all of the players of the bingo game may be issued or provided any interim bingo award (e.g., corresponding to and based on their poker hands).

The process 400 then ends for this play of the bingo game.

6. Example Gaming System Operation for a Class II Bingo Game with an Interim Multi-Hand Video Poker Game As described above in connection with Section 2 (Example gaming system operation), Class II bingo games include two or more players participating in a same bingo game for a game-winning prize. The first player to complete the game-winning pattern wins the game-winning prize. To make the bingo game more interesting, examples disclosed herein enable each player to also win an interim bingo award (sometimes referred to herein as an "interim prize," an "interim award" or an "interim bingo prize"). The interim bingo award is paid to a player for completing an interim bingo pattern on their bingo card. Thus, while the game-winning award is paid to the first player (or players) to complete the game-winning pattern, the interim bingo award may be paid out to any quantity of players (e.g., zero players, one player, etc.) who complete the interim bingo pattern. Interim bingo awards, if any, are paid to each player based solely upon their bingo cards and does not depend on any outcomes hit (e.g., satisfied) or not hit (e.g., not satisfied) by other players and their respective bingo cards.

In the example embodiments disclosed herein, the interim bingo patterns are based on winning poker hands. Thus, the interim bingo patterns are matched by enabling the player to play an interim poker game while also playing the bingo game. Operation of a play of one example Class II bingo game with an interim poker game is described below. In the example embodiments disclosed herein, the interim poker game is a Three-Hand Jacks or Better Five Card Draw Poker game (referred to below as the "poker game" for brevity).

In this example embodiment, for each player for the play of the bingo game, the gaming system displays a primary bingo card 510 that is associated with the game-winning award. The gaming system also displays a first poker bingo card 510A, a second poker bingo card 510B and a third poker bingo card 510C that are each associated with any interim awards. The bingo cards 510, 510A, 510B and 510C are each a 4 by 13 matrix in this example embodiment. Each row of the example bingo cards 510, 510A, 510B and 510C represents a respective card suit. In this example embodiment, a first row 512 of the primary bingo card 510 represents Spades, a second row 514 of the primary bingo card 510 represents Hearts, a third row 516 of the primary bingo card 510 represents Clubs, and a fourth row 518 of the primary bingo card 510 represents Diamonds. Each column of the example primary bingo card 510 represents a respective card value. In this example embodiment, the card values Two, Three, Four, Five, Six, Seven, Eight, Nine, Ten, Jack, Queen, King, and Ace are represented by columns 520, 522, 524, 526, 528, 530, 532, 534, 536, 538, 540, 542, and 544, respectively, of the primary bingo card 510. Thus, in this example embodiment, each bingo spot on the primary bingo card 510 maps to a playing card of a standard 52-card deck having (1) a card suit and (2) a card value.

Similarly, in this example embodiment, a first row 512A of the first poker bingo card 510A represents Spades, a second row 514A of the first poker bingo card 510A represents Hearts, a third row 516A of the first poker bingo card 510A represents Clubs, and a fourth row 518A of the first poker bingo card 510A represents Diamonds. Each column of the example first poker bingo card 510A represents a respective card value. In this example embodiment, the card values Two, Three, Four, Five, Six, Seven, Eight, Nine, Ten, Jack, Queen, King, and Ace are represented by columns 520A, 522A, 524A, 526A, 528A, 530A, 532A, 534A, 536A, 538A, 540A, 542A, and 544A, respectively, of the first poker bingo card 510A. Thus, in this example embodiment, each bingo spot on the first poker bingo card 510A maps to a playing card of a standard 52-card deck having (1) a card suit and (2) a card value.

Similarly, in this example embodiment, a first row 512B of the second poker bingo card 510B represents Spades, a second row 514B of the second poker bingo card 510B represents Hearts, a third row 516B of the second poker bingo card 510B represents Clubs, and a fourth row 518B of the second poker bingo card 510B represents Diamonds. Each column of the example second poker bingo card 510B represents a respective card value. In this example embodiment, the card values Two, Three, Four, Five, Six, Seven, Eight, Nine, Ten, Jack, Queen, King, and Ace are represented by columns 520B, 522B, 524B, 526B, 528B, 530B, 532B, 534B, 536B, 538B, 540B, 542B, and 544B, respectively, of the second poker bingo card 510B. Thus, in this example embodiment, each bingo spot on the second poker bingo card 510B maps to a playing card of a standard 52-card deck having (1) a card suit and (2) a card value.

Similarly, in this example embodiment, a first row 512C of the third poker bingo card 510C represents Spades, a second row 514C of the third poker bingo card 510C represents Hearts, a third row 516C of the third poker bingo card 510C represents Clubs, and a fourth row 518C of the third poker bingo card 510C represents Diamonds. Each column of the example third poker bingo card 510C represents a respective card value. In this example embodiment, the card values Two, Three, Four, Five, Six, Seven, Eight, Nine, Ten, Jack, Queen, King, and Ace are represented by columns 520C, 522C, 524C, 526C, 528C, 530C, 532C, 534C, 536C, 538C, 540C, 542C, and 544C, respectively, of the third poker bingo card 510C. Thus, in this example embodiment, each bingo spot on the third poker bingo card 510C maps to a playing card of a standard 52-card deck having (1) a card suit and (2) a card value.

Each bingo spot on the bingo cards 510, 510A, 510B and 510C corresponds to a respective column and a respective row, and is assigned a different playing card of a standard 52-card deck. Each playing card is static so that the same playing card appears in the same position (e.g., same column position and same row position) on all primary bingo cards and all poker bingo cards for the play of the bingo game. For example, for each bingo card of the instant play of the bingo game, the Two of Spades is located at the first row (e.g., Spades suit row) and the first column (e.g., card value "Two") of the respective bingo cards 510, 510A, 510B, and 510C.

In this example embodiment, the bingo spots on the primary bingo card 510 are associated with playing cards. While the bingo numbers and the order of the bingo numbers drawn on the primary bingo card 510 may vary, the positioning of the playing cards remain static. Thus, while the Two of Spades is located at the first row 512 and the first column 520 of the primary bingo card 510, the bingo number associated with that bingo spot is randomly selected from a set of bingo numbers. In this example embodiment, the set of bingo numbers associated with the primary bingo card 510 is a set of bingo numbers 1-52. As a result, each bingo number of the set of bingo numbers 1-52 maps to a different playing card of the standard 52-card deck represented by the bingo spots on the primary bingo card 510.

Similarly, while the bingo numbers and the order of the bingo numbers drawn on the poker bingo cards 510A, 510B, and 510C may vary, the positioning of the playing cards remain static. Thus, for example, on each of the poker bingo cards 510A, 510B, and 510C, the Two of Spades is located at the first row 512A, 512B, and 512C, and the first column 520A, 520B, and 520C, respectively, of each of the poker bingo cards 510A, 510B, and 510C. Additionally, the bingo number associated with that bingo spot is randomly selected from a set of bingo numbers 1-52. In this example embodiment, the set of bingo numbers associated with the poker bingo cards 510A, 510B, and 510C is the set of bingo numbers 1-52. As a result, each bingo number of the set of bingo numbers 1-52 maps to a different playing card of the standard 52-card deck represented by the bingo spots on the respective poker bingo cards 510A, 510B, and 510C.

In this example embodiment, five random bingo numbers are initially drawn from the set of bingo numbers 1-52 and the playing cards that map to those initially drawn bingo numbers on the primary bingo card are displayed to the player as a deal hand. The player may then choose which, if any, of the playing cards of the deal hand to hold. The gaming system then daubs the bingo spots on the primary bingo card that correspond to the selected playing cards of the deal hand using a first daubing pattern. If a playing card of the deal hand is not selected for holding (e.g., is designated as a non-held card), the gaming system does not daub the corresponding bingo spot on the primary bingo card (or, alternatively, the gaming system marks the corresponding bingo spot using a second daubing pattern).

The gaming system then overlaps the primary bingo card with each of the poker bingo cards so that the bingo spots and playing cards align (e.g., the bingo spot corresponding to the Two of Spades on the primary bingo card is aligned with the bingo spot corresponding to the Two of Spades on the first poker bingo card, etc.). The gaming system then marks any bingo spots on each of the poker bingo cards that were also marked on the primary bingo card. For example, if the gaming system marked the bingo spot on the primary bingo card corresponding to the Two of Spades using the first daubing pattern (e.g., the Two of Spades was designated a held card), the gaming system then marks the bingo spots corresponding to the Two of Spades on the respective poker bingo cards using the first daubing pattern. In this manner, the gaming system duplicates any held cards from the deal hand to the poker hands. Additionally, in this example embodiment, the gaming system marks any bingo spots corresponding to non-held playing cards of the deal hand using a second daubing pattern on the primary bingo card and each of the poker bingo cards. For example, if the gaming system designated a Three of Hearts of the deal hand as a non-held card, the gaming system then marks the respective bingo spots of the primary bingo card and each of the poker bingo cards that correspond to the Three of Hearts using the second daubing pattern.

The gaming system then randomly draws additional bingo numbers from the set of bingo numbers 1-52 until: (1) five bingo spots are daubed using the first daubing pattern on each of the poker bingo cards, and (2) a game-winning pattern is identified on a primary bingo card of the play of the bingo game. When the gaming system daubs a bingo spot on a poker bingo card using the first daubing pattern, the gaming system also adds a poker card to the associated poker hand that maps to the daubed bingo spot until each of the poker hands contains five poker cards. Thus, the five bingo spots that are daubed using the first daubing pattern for each poker bingo card are also the same poker cards of the poker hand associated with that poker bingo card.

In this example embodiment, the gaming system then issues any first awards to the first player for hitting the game-winning pattern. The gaming system then issues any second awards to each player for the highest interim bingo pattern that matches the five bingo spots daubed by the gaming system on their respective poker bingo cards.

At various points during the play of the bingo game, the gaming system displays one or more of a plurality of buttons (actuatable via a touch screen) including: (1) a SEE PAYS button 571, (2) BET DOWN button 572, (3) a BET UP button 573, and (4) a PLAY button 574. Responsive to the gaming system receiving an actuation of the SEE PAYS button 571, the gaming system displays the paytable for the bingo game. Responsive to the gaming system receiving an actuation of the BET DOWN button 572, the gaming system reduces the player wager by a predetermined amount. Responsive to the gaming system receiving an actuation of the BET UP button 573, the gaming system increases the player wager by a predetermined amount. Responsive to the gaming system receiving an actuation of the PLAY button 574, the gaming system places a wager and enrolls the player in the bingo game.

The gaming system also displays a plurality of meters including: (1) a credit meter 581 that indicates the player credit balance, (2) a wager meter 582 that displays the player total wager for a play of the bingo game, and (3) an award meter 583 that displays any awards the player won for a play of the bingo game. In this illustrated example embodiment, the awards for the play of the bingo game include any game-winning awards associated with the bingo game and any interim awards associated with the poker game (e.g., the interim bingo game). While in this example embodiment the gaming system indicates the player credit balance, the player wager, and any awards in credits, the gaming system may also indicate them in currency (e.g., U.S. dollars).

Figure 5A:
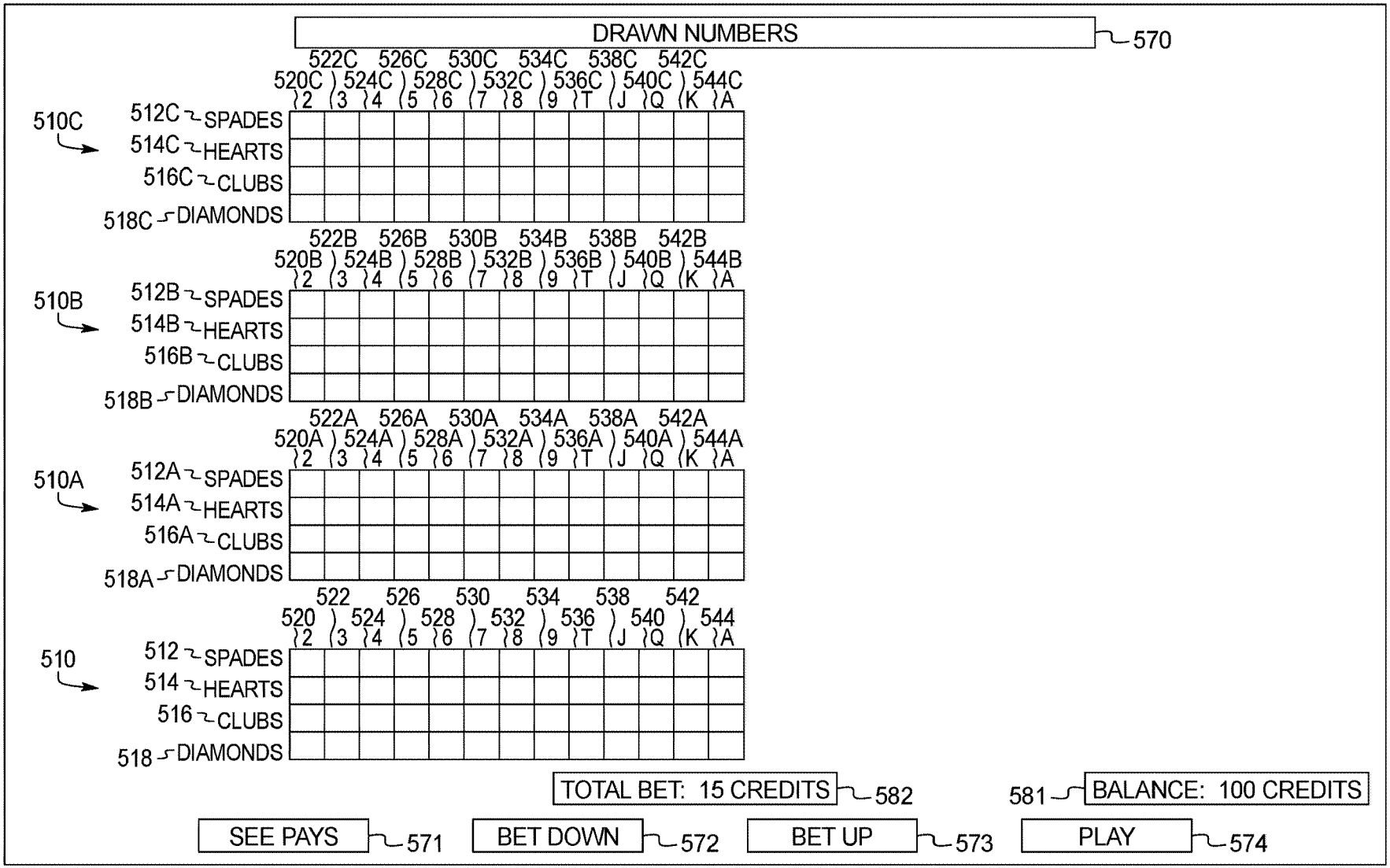
FIGS. 5A to 5H illustrate screen shots of one example Class II bingo game with an interim video multi-hand poker game.

As illustrated in FIG. 5A, in this example embodiment, the gaming system receives a value (e.g., a monetary value), such as physical currency (or its equivalent), via an acceptor. Here, the gaming system provides the player 100 credits, which represents the received value, and displays the player credit balance of 100 credits in the credit meter 581. The gaming system receives an actuation of the PLAY button 574.

Figure 5B:
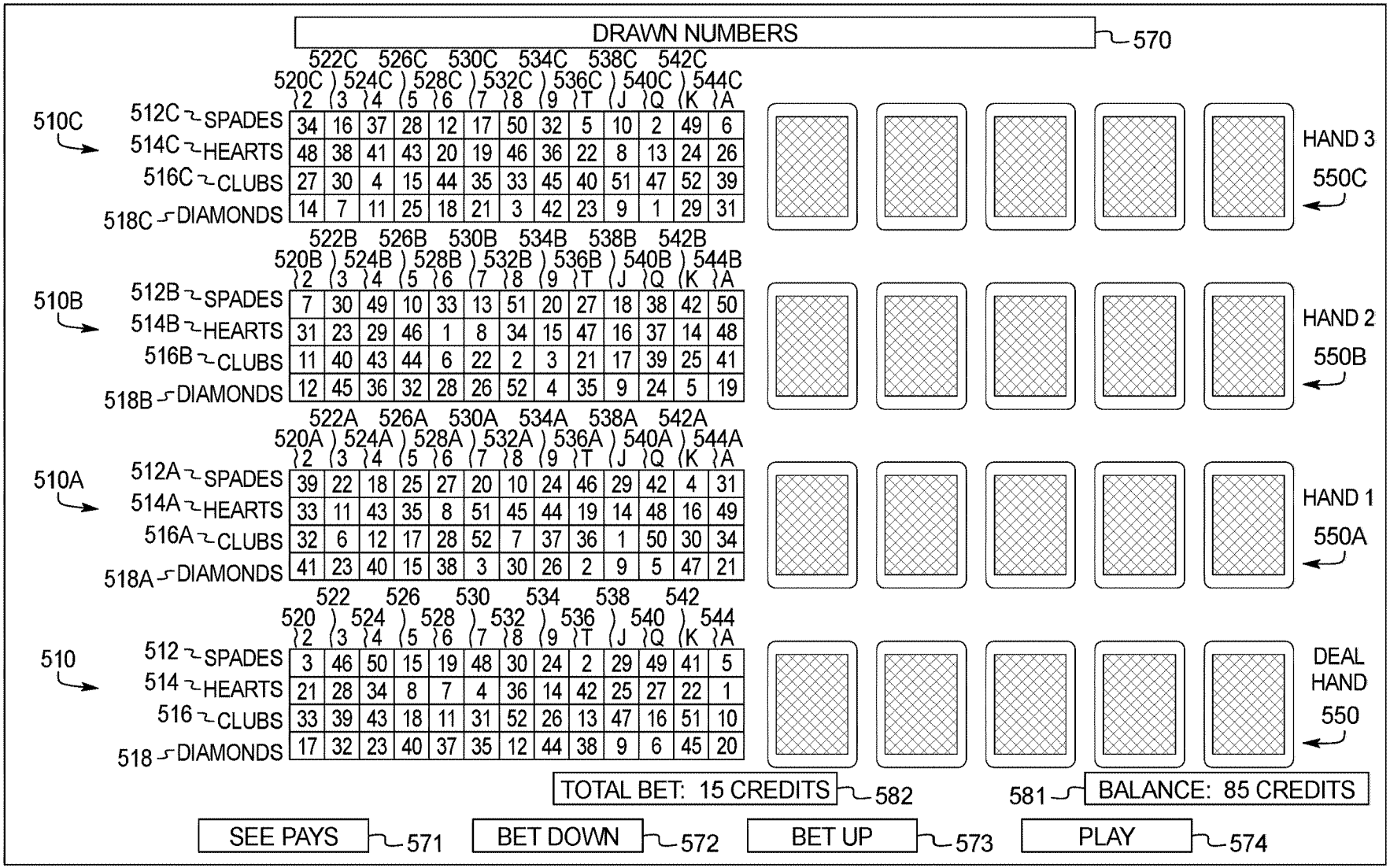

Responsive to the actuation of the PLAY button 574, the gaming system: (1) places a 15 credit bet on a play of the bingo game and deducts the 15 credit bet from the credit balance; (2) enrolls the player in the play of the bingo game; (3) as best shown in FIG. 5B, randomly determines a primary bingo card 510 for the player; (4) displays a deal hand 550 with five placeholders for cards to eventually be in the deal hand; (5) randomly determines a first poker bingo card 510A for the player; (6) displays a first poker hand 550A with five placeholders for cards to eventually be in the first poker hand (e.g., when the first poker hand 550A is completed); (7) randomly determines a second poker bingo card 510B for the player; (8) displays a second poker hand 550B with five placeholders for cards to eventually be in the second poker hand (e.g., when the second poker hand 550B is completed); (9) randomly determines a third poker bingo card 510C for the player; and (10) displays a third poker hand 550C with five placeholders for cards to eventually be in the third poker hand (e.g., when the third poker hand 550C is completed).

In this example embodiment, each of the bingo cards 510, 510A, 510B, and 510C includes a 4 by 13 array of bingo spots, and each bingo spot includes a different bingo number of a set of bingo numbers 1-52. Each bingo spot on each of the bingo cards 510, 510A, 510B, and 510C is associated with a different playing card that is static. For example, in this illustrated example embodiment, the Two of Spades "playing card" is (1) assigned to the top-left spot on the primary bingo card 510 (e.g., row 512 and column 520 of the primary bingo card 510), (2) assigned to the top-left spot on the first poker bingo card 510A (e.g., row 512A and column 520A of the first poker bingo card 510A), (3) assigned to the top-left spot on the second poker bingo card 510B (e.g., row 512B and column 520B of the second poker bingo card 510), and (4) assigned to the top-left spot on the third poker bingo card 510C (e.g., row 512C and column 520C of the third poker bingo card 510C). While the playing card is assigned to the same bingo spot on each of the bingo cards, the bingo numbers are randomly selected and distributed for each bingo card. Thus, in this example embodiment, the bingo number "3" corresponds to the Two of Spades "playing card" on the primary bingo card 510, but corresponds to the Seven of Diamonds "playing card" on the first poker bingo card 510A, corresponds to the Nine of Clubs "playing card" on the second poker bingo card 510B, and corresponds to the Eight of Diamonds "playing card" on the third poker bingo card 510C.

Figure 5C:
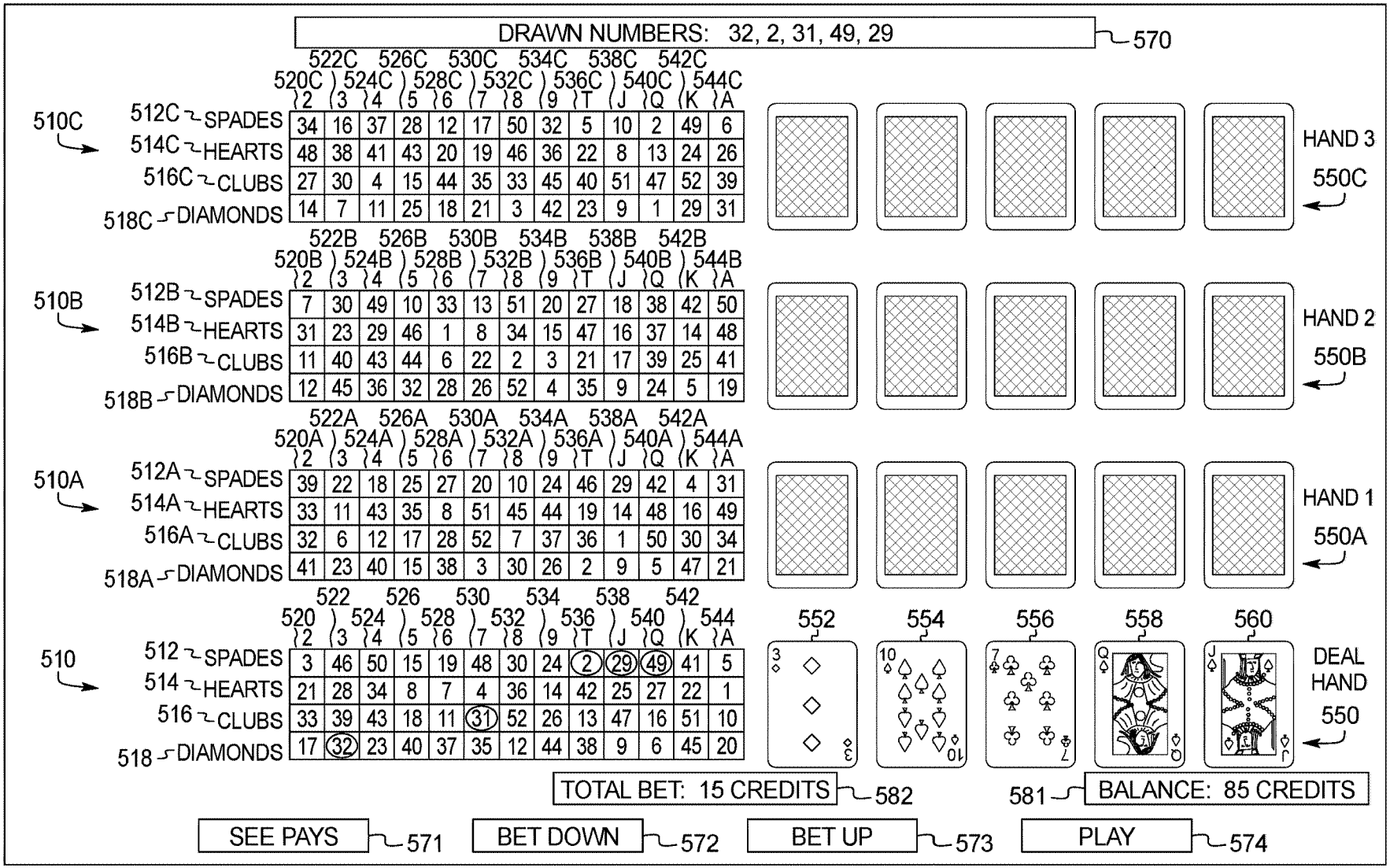

After the gaming system determines to initiate the play of the bingo game (e.g., by determining that a designated period of time since the first enrollment has expired or a minimum quantity of players has been enrolled in the play of the bingo game, the gaming system conducts a bingo number draw. In this example embodiment, the gaming system conducts an initial bingo number draw including five bingo numbers selected from the set of bingo numbers 1-52. As best shown in FIG. 5C, the gaming system randomly draws these initial bingo numbers from the set of bingo numbers 1-52 in the following order and displays them at a drawn bingo number display area 570: 32, 2, 31, 49, and 29. As also shown in FIG. 5C, the gaming system marks the spots on the primary bingo card 510 that are associated with the initial bingo number draw by circling the numbers in the primary bingo card 510.

In this example embodiment, the gaming system also populates the deal hand 550 by displaying playing cards corresponding to the marked bingo spots of the initial bingo number draw. For example, the first bingo number drawn by the gaming system is a "32," which corresponds to a Three of Diamonds on the primary bingo card 510 (e.g., row 518 and column 522 of the primary bingo card 510). The gaming system then displays a 3♦ card 552 as the first playing card in the deal hand 550.

The second bingo number drawn by the gaming system is a "2," which corresponds to a Ten of Spades on the primary bingo card 510 (e.g., row 512 and column 536 of the primary bingo card 510). The gaming system then displays a 10♠ card 554 as the second playing card in the deal hand 550.

The third bingo number drawn by the gaming system is a "31," which corresponds to a Seven of Clubs on the primary bingo card 510 (e.g., row 516 and column 530 of the primary bingo card 510). The gaming system then displays a 7♣ card 556 as the third playing card in the deal hand 550.

The fourth bingo number drawn by the gaming system is a "49," which corresponds to a Queen of Spades on the primary bingo card 510 (e.g., row 512 and column 540 of the primary bingo card 510). The gaming system then displays a Q♠ card 558 as the fourth playing card in the deal hand 550.

The fifth bingo number drawn by the gaming system is a "29," which corresponds to a Jack of Spades on the primary bingo card 510 (e.g., row 512 and column 538 of the primary bingo card 510). The gaming system then displays a J♠ card 560 as the fifth playing card in the deal hand 550.

Figure 5D:
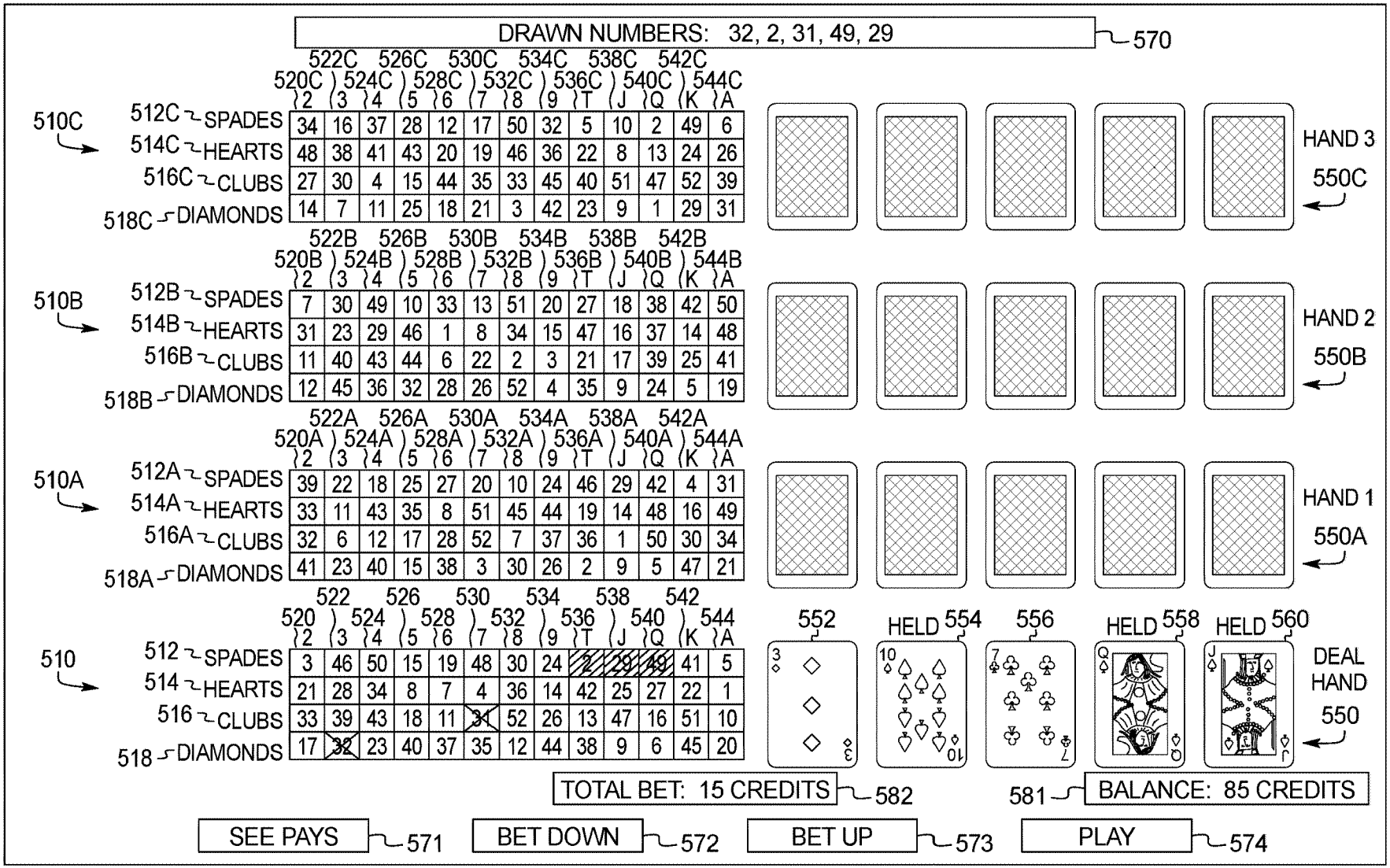

The gaming system then enables the player to choose zero, one or more of the playing cards 552, 554, 556, 558, and 560 corresponding to the initial bingo numbers drawn to hold. The player may choose to hold up to all of the cards 552, 554, 556, 558, and 560 of the deal hand 550. As best shown in FIG. 5D, the gaming system receives a selection (e.g., via a display device associated with the gaming system) of the 10♠ card 554, the Q♠ card 558, and the J♠ card 560 of the deal hand 550 to hold and designates those playing cards 554, 558, and 560 as held cards.

In this example embodiment, when a playing card in the deal hand 550 is designated as a held-card (e.g., selected to be held by a player), the gaming system marks (or "daubs") the corresponding bingo spots on the primary bingo card 510. As show in FIG. 5D, the gaming system daubs the bingo spots corresponding to the 10♠ card 554 (e.g., bingo number "2"), the Q♠ card 558 (e.g., bingo number "49"), and the J♠ card 560 (e.g., bingo number "29") by filling in the respective bingo spots using a first daubing pattern. For example, the gaming system daubs the bingo spots using the first daubing pattern by shading the respective bingo spots with a blue color.

Figure 5E:
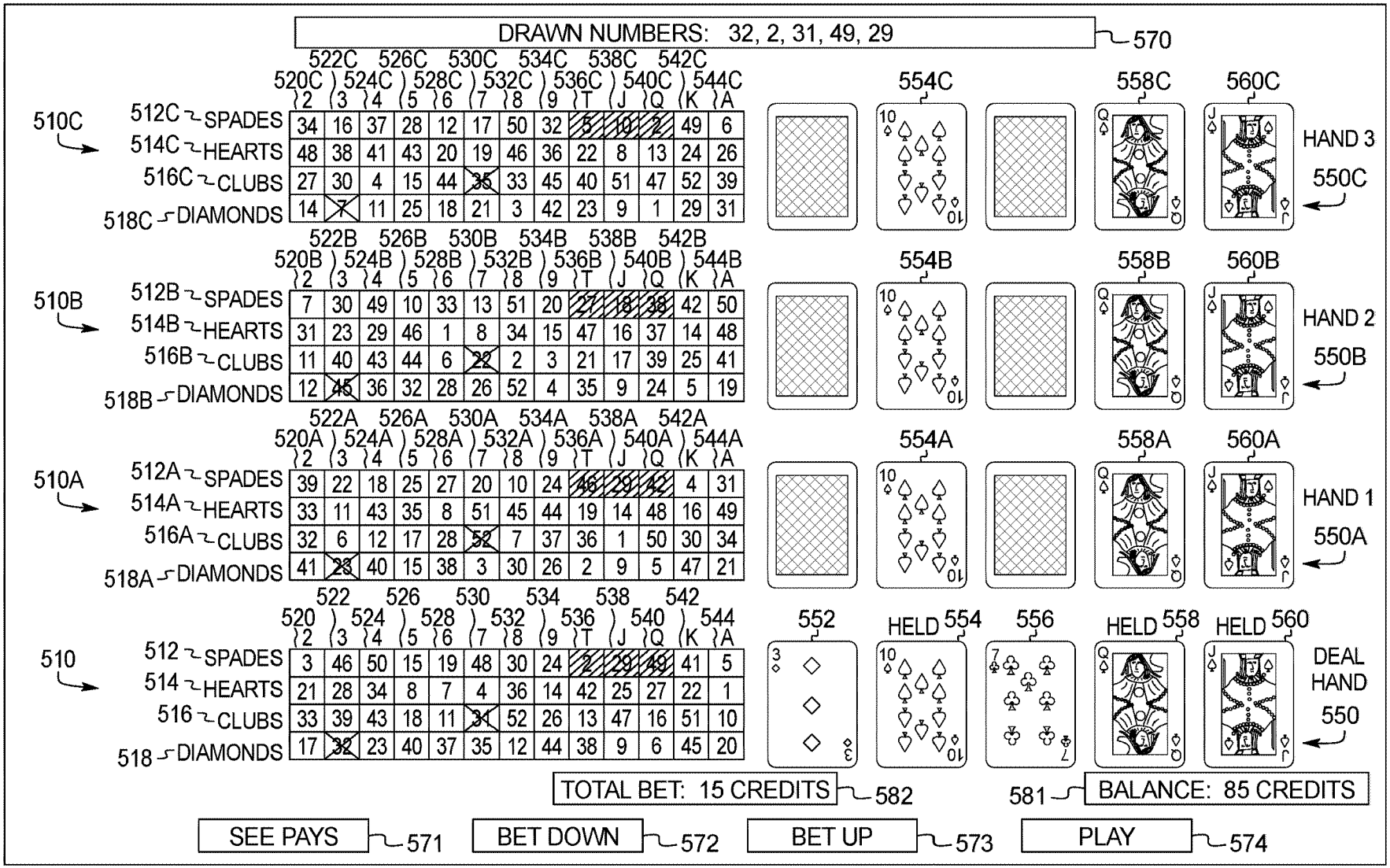

In this example embodiment, when a playing card in the deal hand 550 is designated as a held-card, the gaming system also duplicates each held from the deal hand 550 to each of the poker hands 550A, 550B, and 550C. As shown in FIG. 5E, the gaming system displays (or causes a display device of the gaming system to display) the first poker hand 550A including a 10♠ card 554A, a Q♠ card 558A, and a J♠ 560A. The gaming system also daubs the bingo spots corresponding to the 10♠ card 554A, the Q♠ card 558A, and the J♠ card 560A on the first poker bingo card 510A. For example, the gaming system may overlay the first poker bingo card 510A on top of the primary bingo card 510 and mark using the first daubing pattern the same spots on the first poker bingo card 510A that were daubed using the first daubing pattern.

The gaming system displays the second poker hand 550B including a 10♠ card 554B, a Q♠ card 558B, and a J♠ card 560B. The gaming system also daubs the bingo spots corresponding to the 10♠ card 554B, the Q♠ card 558B, and the J♠ card 560B on the second poker bingo card 510B. For example, the gaming system may overlay the second poker bingo card 510B on top of the primary bingo card 510 and mark using the first daubing pattern the same spots on the second poker bingo card 510B that were daubed using the first daubing pattern.

The gaming system displays the third poker hand 550C including a 10♠ card 554C, a Q♠ card 558C, and a J♠ card 560C. The gaming system also daubs the bingo spots corresponding to the 10♠ card 554C, the Q♠ card 558C, and the J♠ card 560C on the third poker bingo card 510C. For example, the gaming system may overlay the third poker bingo card 510C on top of the primary bingo card 510 and mark using the first daubing pattern the same spots on the third poker bingo card 510C that were daubed using the first daubing pattern.

In this example embodiment, when the player completes their selections for held cards, the gaming system receives an actuation of the PLAY button 574. In response to the actuation of the PLAY button 574, the gaming system determines if the deal hand 550 includes any non-held cards and marks the corresponding bingo spots on the primary bingo card 510 using a second daubing pattern. As shown in FIG. 5E, the gaming system marks the bingo spot on the primary bingo card 510 corresponding to the 3♦ card 552 (e.g., bingo number "32") and the 7♠ card 556 (e.g., bingo number "31") by filling in the respective bingo spots on the primary bingo card 510 using the second daubing pattern. For example, the gaming system marks the bingo spots on the primary bingo card 510 using the second daubing pattern by drawing an "X" in the respective spot. The gaming system also marks the bingo spots on each of the respective poker bingo cards 510A, 510B, and 510C that corresponds to the non-held cards (if any) using the second daubing pattern. For example, the gaming system marks the bingo spots on the poker bingo cards 510A, 510B, and 510C that correspond to a 3♦ playing card and a 7♠ playing card using the second daubing pattern by drawing an "X" in the respective spots.

Figure 5F:
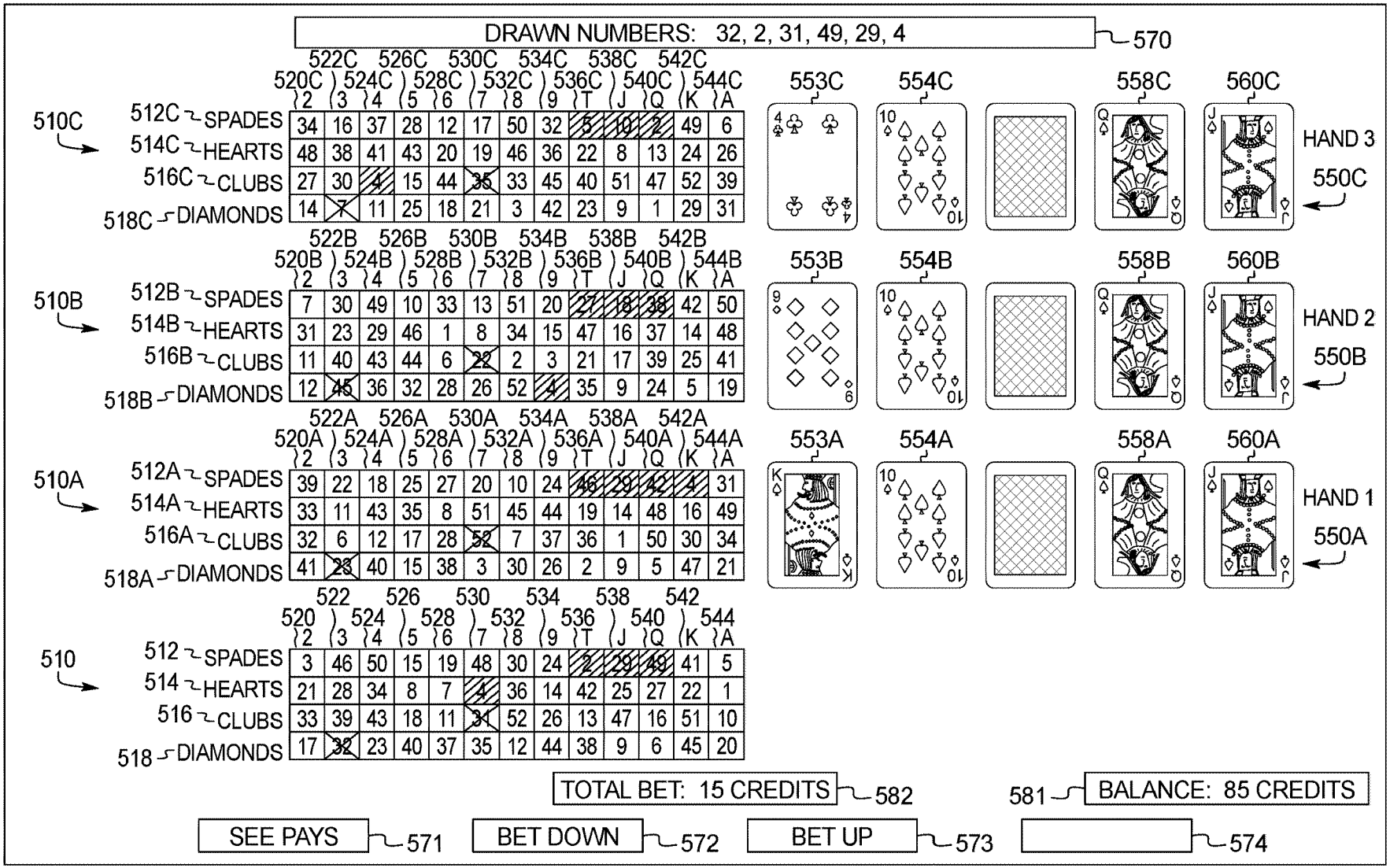

The gaming system then draws additional bingo numbers from the set of bingo numbers 1-52 and automatically daubs the corresponding bingo spots on the primary bingo card 510 using the first daubing pattern. As shown in FIG. 5F, the gaming system also daubs the corresponding bingo spots on the poker bingo cards 510A, 510B, and 510C using the first daubing pattern and adds a poker card corresponding to the daubed bingo spot to the respective poker hands 550A, 550B, and 550C. In this example embodiment, the gaming system marks bingo spots on a poker bingo card until the selected poker bingo card includes five bingo spots daubed using the first daubing pattern. When the gaming system determines that the quantity of bingo spots marked on a selected poker bingo card is five bingo spots, the gaming system stops daubing bingo spots on the selected poker bingo card.

It should be appreciated that there may be instances where a specific bingo spot on a poker bingo card is marked and that is not marked on the primary bingo card 510. For example, as shown in FIG. 5F, the bingo spot corresponding to the bingo number "5" on the third poker bingo card 510C is marked using the first daubing pattern even though the bingo number "5" has not been drawn yet (e.g., is not displayed in the drawn bingo number display area 570) during the play of the bingo game. This is because the bingo spot corresponding to the bingo number "5" on the third poker bingo card 510C was marked when the third poker bingo card 510C was overlaid with the primary bingo card 510 and the marked bingo spots on the primary bingo card 510 were also marked on the third poker bingo card 510C. Thus, if the gaming system draws a bingo number that has already been marked on a poker bingo card, the gaming system ignores (or disregards) that bingo number with respect to that poker bingo card. Thus, each of the poker cards that are displayed in each of the poker hands 550A, 550B, and 550C is a unique poker card for that respective poker hand.

In this example embodiment, the gaming system daubs the bingo spots corresponding to the additional bingo numbers drawn using the first daubing pattern in the order that the additional bingo numbers are drawn (e.g., sequentially). As shown in the drawn bingo number display area 570 of FIG. 5F, the first additional bingo number drawn is a "4," which corresponds to a Seven of Hearts on the primary bingo card 510 (e.g., row 514 and column 530 of the primary bingo card 510).

Because the total quantity of bingo spots daubed using the first daubing pattern is less than five bingo spots (e.g., three bingo spots currently daubed using the first daubing pattern) on each of the poker bingo cards 510A, 510B, and 510C, the gaming system accordingly automatically daubs the bingo spot on each of the poker bingo cards 510A, 510B, and 510C corresponding to the bingo number "4" using the first daubing pattern. As also shown in FIG. 5F, the gaming system also adds a playing card that corresponds to the bingo number and the bingo spot on each of the poker bingo cards 510A, 510B, and 510C to the respective poker hands 550A, 550B, and 550C.

In this example embodiment, the bingo number "4" corresponds to a King of Spades on the first poker bingo card 510A (e.g., row 512A and column 542A of the first poker bingo card 510A). The gaming system then displays a K♠ card 553A as the first playing card in the first poker hand 550A.

The bingo number "4" corresponds to a Nine of Diamonds on the second poker bingo card 510B (e.g., row 518B and column 534B of the second poker bingo card 510B). The gaming system then displays a 9♦ card 553B as the first playing card in the second poker hand 550B.

The bingo number "4" corresponds to a Four of Clubs on the third poker bingo card 510C (e.g., row 516C and column 542C of the third poker bingo card 510C). The gaming system then displays a 4♣ card 553C as the first playing card in the third poker hand 550C.

Figure 5G:
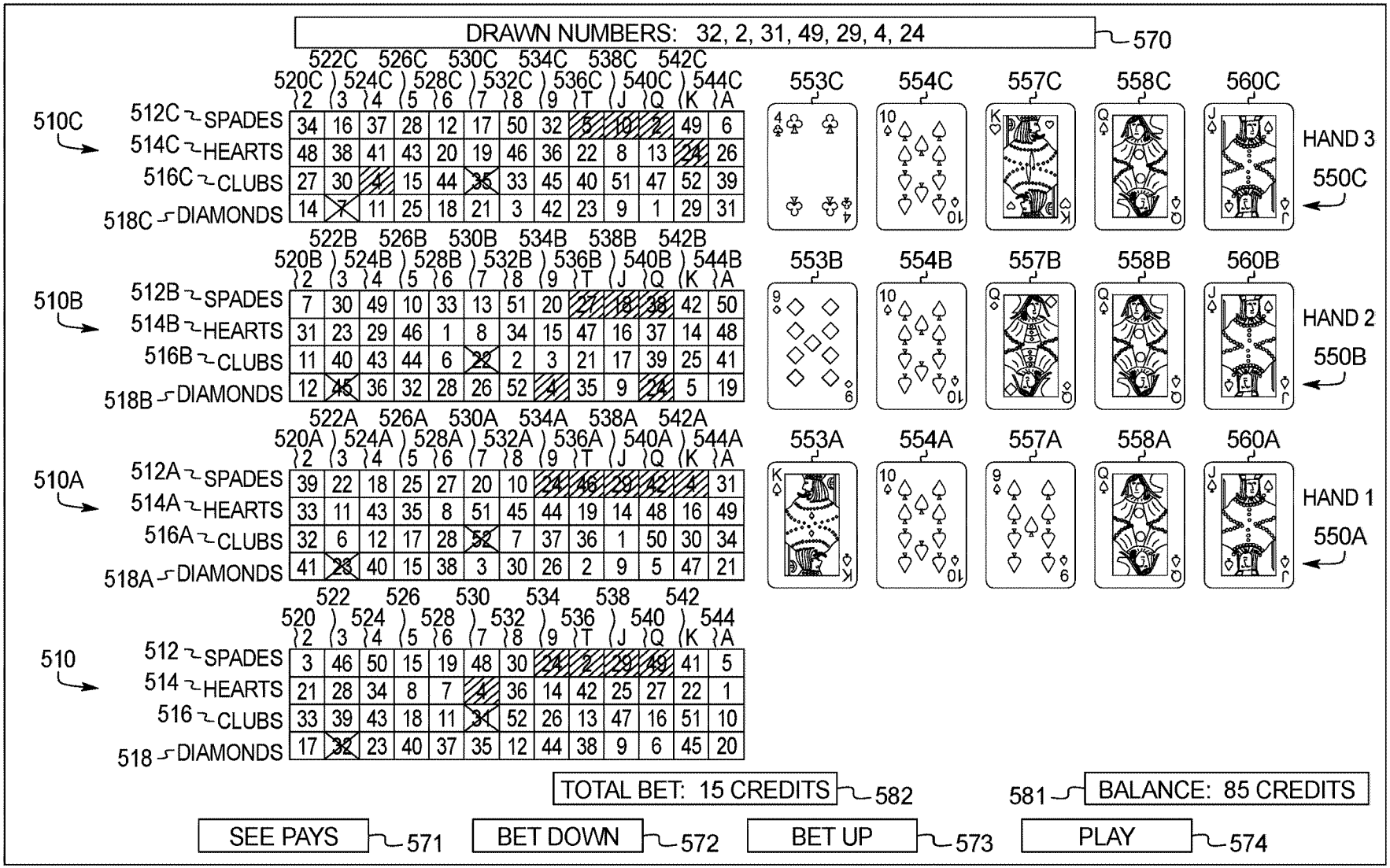

As shown in the drawn bingo number display area 570 of FIG. 5G, the second additional bingo number drawn by the gaming system is a "24," which corresponds to a Nine of Spades on the primary bingo card 510 (e.g., row 512 and column 534 of the primary bingo card 510). The gaming system then daubs the bingo spot on the primary bingo card 510 corresponding to the bingo number "24" using the first daubing pattern.

In this example embodiment, the bingo number "24" corresponds to a Nine of Spades on the first poker bingo card 510A (e.g., row 512A and column 534A of the first poker bingo card 510A). The gaming system then displays a 9♠ card 557A as the third poker card in the first poker hand 550A.

The bingo number "24" corresponds to a Queen of Diamonds on the second poker bingo card 510B (e.g., row 518B and column 540B of the second poker bingo card 510B). The gaming system then displays a Q♦ card 557B as the third poker card in the second poker hand 550B.

The bingo number "24" corresponds to a King of Hearts on the third poker bingo card 510C (e.g., row 514C and column 542C of the third poker bingo card 510C). The gaming system then displays a K♥ card 557C as the third playing card in the third poker hand 550C.

In this example embodiment, once a poker bingo card includes five bingo spots that are marked using the first daubing pattern (e.g., the corresponding poker hands include five poker cards), the gaming system stops marking bingo spots on that poker bingo card.

In this example embodiment, the gaming system continues drawing additional bingo numbers from the remaining numbers in the set of bingo numbers 1-52 until a primary bingo card satisfies a game-winning pattern. In this example embodiment, the game-winning pattern is any single row on the primary bingo card being completely daubed out (e.g., all bingo spots of a row on the primary bingo card 510 are daubed using the first daubing pattern). It should be appreciated that other game-winning patterns may additionally or alternatively be used.

Figure 5H:
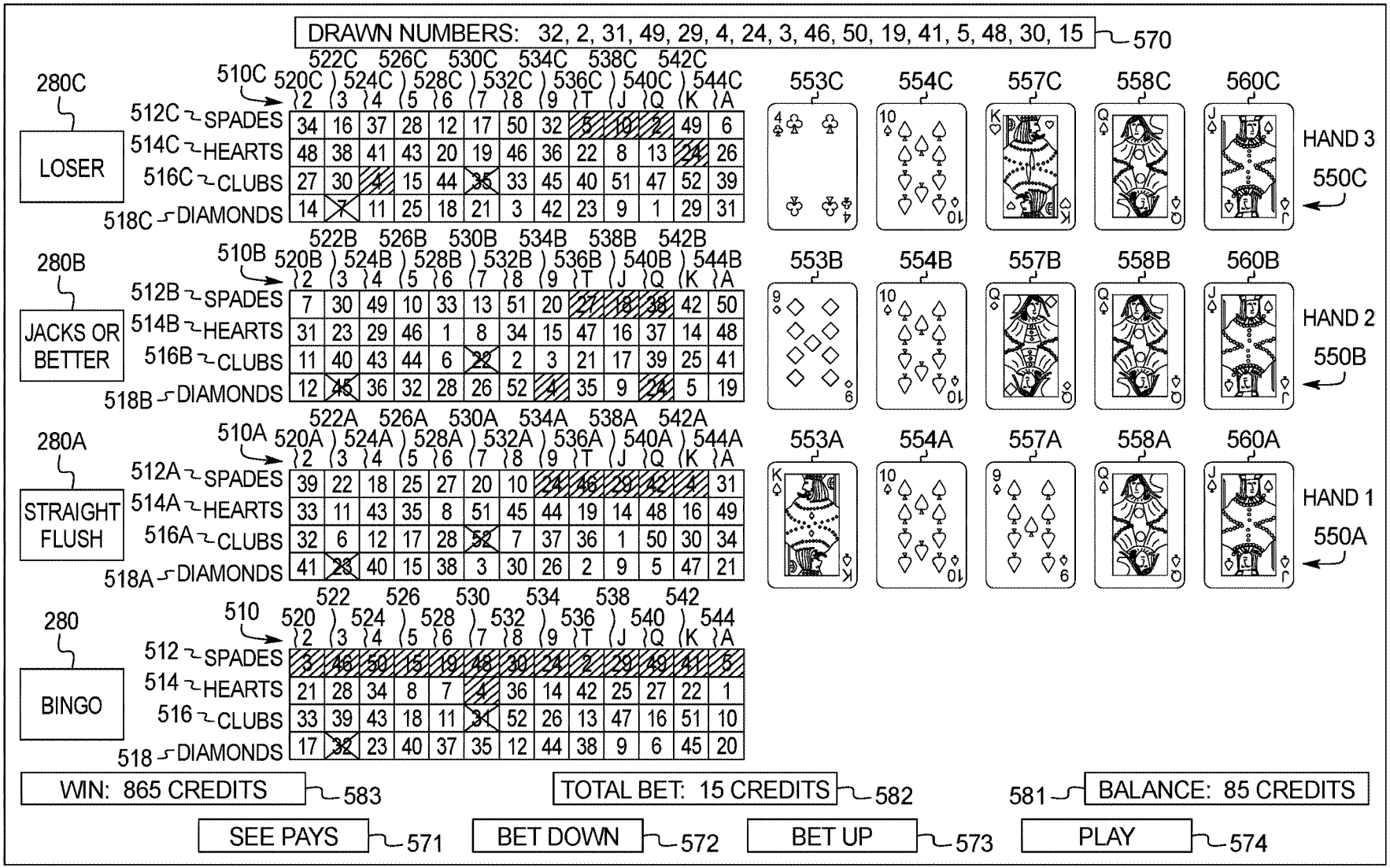

As shown in FIG. 5H, the gaming system drew the following additional bingo numbers from the set of bingo numbers 1-52 before the gaming system determined that a game-winning pattern was satisfied: 3, 46, 50, 19, 41, 5, 48, 30, and 15. In this example embodiment, the primary bingo card 510 satisfies the game-winning pattern when the gaming system daubed each bingo spot of the Spades row 512 of the primary bingo card 510 with the first daubing pattern based on the drawn bingo numbers.

In this example embodiment, once the gaming system determines a primary bingo card satisfies a game-winning pattern, the gaming system determines whether to issue any awards to the players of the bingo game. In this example embodiment, the gaming system determines (1) whether to issue any first awards for the bingo game, and (2) whether to issue any second awards for the interim poker game.

The gaming system issues or provides the player any awards for the bingo game. In this example embodiment, the game-winning pattern is associated with a 100 credit award. It should be appreciated that other credit awards may additionally or alternatively by issued or provided to the player for the game-winning pattern and/or additional game-winning patterns.

To determine whether to issue any second awards for the interim poker game, the gaming system compares the bingo spots of each of the poker bingo cards 510A, 510B, and 510C that are daubed using the first daubing pattern to interim bingo patterns that represent wins in the poker game, such as some of the example interim bingo patterns illustrated in FIGS. 3A to 3I and disclosed above. In this example embodiment, the gaming system determines that the bingo spots of the first poker bingo card 510A daubed using the first daubing pattern satisfy an interim bingo pattern corresponding to a Straight Flush winning hand. In particular, the bingo spots of the first poker bingo card 510A daubed using the first daubing pattern (e.g., the bingo spots associated with the bingo numbers "24," "46," "29," "49" and "4") satisfy a Straight Flush (e.g., a five-spot pattern covering five consecutive playing cards of a single suit (e.g., five consecutive bingo spots in the Spades row 512A of the first poker bingo card 510A)).

The first poker hand 550A including the K♠ card 553A, the 10♠ card 554A, the 9♠ card 557A, the Q♠ card 458A and the J♠ card 560 also represents a Straight Flush winning hand for the player. In this example embodiment, the gaming system issues the player a credit award in accordance with a poker paytable. The poker paytable is determined based on the wager (or in other embodiments, the wagering game's denomination). Table 1 (reproduced below) includes an example paytable for a 15 credit wager on the bingo game. The example paytable of Table 1 includes different example winning hand categories, example winning hands associated with the different winning hand categories, and example awards associated with the wining hand categories. The winning hand categories are listed from highest to lowest ranking. Although not shown in Table 1, winning hands are also ranked within the different winning hand categories as is known in the art. In this example embodiment, the winning hands of the "Jacks or Better" winning hand category include a pair of Jacks, a pair of Queens, a pair of Kings, and a pair of Aces. In this example embodiment, using the poker paytable shown in Table 1, the gaming system issues the player a 750 credit award for their first poker bingo card 510A matching the Straight Flush interim bingo pattern.

TABLE 1

Winning hand categories, example winning hands, and awards for example Jacks or Better Five Card Draw Poker (15 credit wager)

| Winning Hand Category | Example Winning Hand | Award (15 credit bet) |
|---|---|---|
| Royal Flush | A♣K♣Q♣J♣10♣ | 12000 |
| Straight Flush | 10♣9♣8♣7♣6♣ | 750 |
| Four of a Kind | J♣J♥ J♦ J♠3♣ | 375 |
| Full House | A♥ A♦ A♣6♦ 6♣ | 135 |
| Flush | A♣J♣8♣6♣2♣ | 90 |
| Straight | 8♦ 7♣6♠5♠4♣ | 60 |
| Three of a Kind | Q♠Q♥ Q♦ 6♦ 2♠ | 45 |
| Two Pair | 8♦ 8♥ 5♥ 5♣2♠ | 30 |
| Jacks or Better | K♦ K♠8♣7♣2♥ | 15 |

The gaming system then repeats the determining of any interim bingo awards based on the respective additional poker bingo cards.

In this example embodiment, the gaming system determines that the bingo spots of the second poker bingo card 510B daubed using the first daubing pattern satisfy an interim bingo pattern corresponding to a Jacks or Better (Queens) winning hand. In particular, the bingo spots of the second poker bingo card 510B daubed using the first daubing pattern (e.g., the bingo spots associated with the bingo numbers "4," "27," "18," "38" and "24") satisfy a Jacks or Better (Queens) (e.g., a two-spot pattern covering five consecutive playing cards of a single suit (e.g., a two-spot pattern covering two playing cards with the same face value, such as Jack, Queen, King or Ace of the second poker bingo card 510B)).

The second poker hand 550B including the 9♦ card 553B, the 10♠ card 554B, the Q♦ card 557B, the Q♠ card 458B and the J♠ card 560B also represents a Jacks or Better (Queens) winning hand for the player. In this example embodiment, using the poker paytable shown in Table 1, the gaming system issues the player a 15 credit award for their second poker bingo card 510B matching the Jacks or Better interim bingo pattern.

In this example embodiment, the gaming system determines that the bingo spots of the third poker bingo card 510C daubed using the first daubing pattern do not satisfy an interim bingo pattern (e.g., is a Losing card). In particular, the bingo spots of the third poker bingo card 510C daubed using the first daubing pattern (e.g., the bingo spots associated with the bingo numbers "4," "5," "10," "2" and "24") do not satisfy an interim bingo pattern.

The third poker hand 550C including the 4♣ card 553C, the 10♠ card 554C, the K♥ card 557C, the Q♠ card 458C and the J♠ card 560C also represents a losing hand. The gaming system issues or awards the player no credit awards for their third poker bingo card 510C.

In this example embodiment, the gaming system determines to award the player associated with the bingo cards 510, 510A, 510B, and 510C 865 credits (e.g., 100 credits for the game-winning pattern, 750 credits for their first poker bingo card, and 15 credits for their second poker bingo card) and displays the 865 credit award in the award meter 583.

It should be appreciated from the above that the present disclosure provides that, in various embodiments, the gaming system and method of the present disclosure provides a Class II bingo game with an interim multi-hand video poker game. In an illustrative example, the gaming system displays a primary bingo card that is associated with a game-winning award and a plurality of poker bingo cards that are associated with any interim awards. Each bingo spot on the bingo cards corresponds to a respective column and a respective row, and is assigned a different playing card of a standard 52-card deck. Each playing card is static so that the same playing card appears in the same position (e.g., same column position and same row position) on all primary bingo cards and all poker bingo cards for the play of the bingo game. In this example embodiment, the gaming system randomly draws five bingo numbers from the set of bingo numbers 1-52 and displays the playing cards that map to those initially drawn bingo numbers on the primary bingo card as a deal hand. The gaming system then enables the player to choose which, if any, of the playing cards of the deal hand to hold. The gaming system then daubs the bingo spots on the primary bingo card that correspond to the selected playing cards of the deal hand using a first daubing pattern. If a playing card of the deal hand is not selected for holding (e.g., is designated as a non-held card), the gaming system does not daub the corresponding bingo spot on the primary bingo card (or, alternatively, the gaming system marks the corresponding bingo spot using a second daubing pattern).

The gaming system then overlaps the primary bingo card with each of the poker bingo cards so that the bingo spots and playing cards align. The gaming system then marks any bingo spots on each of the poker bingo cards that were also marked on the primary bingo card. In this manner, the gaming system duplicates any held cards from the deal hand to the poker hands. Additionally, in this example embodiment, the gaming system marks any bingo spots corresponding to non-held playing cards of the deal hand using a second daubing pattern on the primary bingo card and each of the poker bingo cards. The gaming system then randomly draws additional bingo numbers from the set of bingo numbers 1-52 until: (1) five bingo spots are daubed using the first daubing pattern on each of the poker bingo cards, and (2) a game-winning pattern is identified on a primary bingo card of the play of the bingo game. When the gaming system daubs a bingo spot on a poker bingo card using the first daubing pattern, the gaming system also adds a poker card to the associated poker hand that maps to the daubed bingo spot until each of the poker hands contains five poker cards. Thus, the five bingo spots that are daubed using the first daubing pattern for each poker bingo card are also the same poker cards of the poker hand associated with that poker bingo card. In this example embodiment, the gaming system then issues any first awards to the first player for hitting the game-winning pattern. The gaming system then issues any second awards to each player for the highest interim bingo pattern that matches the first five bingo spots daubed by the gaming system on their respective bingo cards.

7. Variations

In various embodiments, the interim bingo patterns may include jokers, deuces, or any other cards as wild cards.

While examples disclosed herein include five-card poker hands, it should be appreciated that other embodiments may include any number of cards in the poker hand (e.g., a six-card hand).

In various embodiments, the interim bingo patterns may include multiple decks of cards.

In various embodiments, the size of the bingo card (e.g., the number of bingo spots included in the bingo card) may change based on the corresponding poker game. For example, a bingo card may include a $53^{rd}$ bingo spot and a $54^{th}$ bingo spot to represent inclusion of jokers in the corresponding poker game. In various embodiments, the size of the bingo card may be doubled to represent a deal from two decks of cards shuffled together.

In various embodiments, the 52 playing cards on a bingo card are mapped to a subset of bingo numbers (e.g., 75 bingo numbers). In some such examples, if a bingo number is drawn that is not displayed on a particular bingo card, that drawn bingo number is classified as a "miss" for that particular bingo card. Additionally, in some such examples, before a player is given the opportunity to select playing cards for holding and/or discarding, the gaming system determines that the quantity of "hit" bingo numbers (e.g., drawn bingo numbers that are displayed on a particular bingo card) satisfies a threshold quantity of bingo numbers (e.g., a minimum quantity of "hit" bingo numbers). If the quantity of "hit" bingo numbers does not satisfy the threshold quantity of bingo numbers, the gaming system does not enable the player to select playing cards to hold and/or discard.

In various embodiments, the bingo numbers associated with the bingo spot are visible to the player once the play of the bingo game is initiated.

In various embodiments, the bingo numbers on the bingo cards are obscured until (all) players have selected their poker cards for holding/discarding. By obscuring the bingo cards until the players have completed making their hold/discard choices, a first player is prevented from using the outcome of a second player positioned next (or near) the first player to "look ahead" and know what numbers will be drawn next.

In various embodiments, a new bingo card, including randomly assigned bingo numbers, is distributed for each play of the bingo game.

In various embodiments, the gaming system may not initiate a play of the bingo game until (a) the designated period of time has expired, and (b) the minimum quantity of players has been enrolled in the play of the bingo game.

In various embodiments, the gaming system may automatically daub (using the first daubing pattern or the third daubing pattern) bingo spots after the initial bingo number draw until the interim pattern threshold quantity of bingo spots is satisfied. In various embodiments, the gaming system may reveal all the bingo numbers drawn (e.g., until a game-winning pattern is satisfied) at once (or nearly at the same-time) and keep track internally of the order of the bingo numbers drawn.

In various embodiments, the gaming system may prompt the player to provide user input to daub bingo spots by pressing or actuating a "daub" button associated with a bingo number and/or a bingo spot. In some examples, the gaming system may prompt the player to "daub" each bingo number one at a time. In some examples, the gaming system may prompt the player to "daub" all of the bingo numbers drawn with a single "daub" button.

In various embodiments, the bingo game ends when a player has hit (e.g., satisfied) the game-winning pattern. In various jurisdictions, the players of the play of the bingo game may continue to play to win any interim awards after the game-winning pattern has been satisfied.

It should be appreciated that depending on the embodiment, either a bingo server or the player's gaming machine will make the above-referenced determinations.

In one example embodiment, players' gaming machines receive enrollment requests and transmit them to the bingo server. In response, the bingo server enrolls players in a play of the bingo game and randomly determines the players' bingo cards. The bingo server sends data representing each player's bingo card to that player's gaming machine to enable that player's gaming machine to display that player's bingo card.

After the bingo server initiates the play of the bingo game, the bingo server begins randomly drawing bingo numbers from the set of bingo numbers. As the bingo server draws bingo numbers, it sends data representing each drawn bingo number to the players' gaming machines to enable the players' gaming machines to display the drawn bingo numbers. The bingo server also determines whether to mark spots of the players' bingo cards as it draws bingo numbers. For each player, the bingo server sends data representing any marked spots to that player's gaming machine to enable that player's gaming machine to display any marked spots. As spots are marked, the bingo server monitors for the formation of a game-winning pattern. In various embodiments, the bingo server stops drawing bingo numbers once the game-winning pattern is marked on one of the players' bingo cards.

The bingo server then determines, for each player, whether a winning pattern is formed by the marked spots on that player's bingo card. If a winning pattern is formed by the marked spots on that player's bingo card, the bingo server instructs that player's gaming machine to display a corresponding winning game outcome presentation.

Although the above-described examples focus on Class II bingo games, the present disclosure contemplates embodiments in which the interim poker game feature is employed on any suitable bingo game, including those without the Class II designation. Additionally, the present disclosure contemplates embodiments in which the interim poker game feature is employed on any suitable game that draws indicia to match player assigned or selected indicia (e.g., casino games such as keno or lottery games).

The present disclosure contemplates that:

(a) the quantity of spots in each bingo card;

(b) the arrangement of spots in each bingo card; and/or (c) any other variables or determinations described herein may be: (1) predetermined; (2) randomly determined; (3) randomly determined based on one or more weighted percentages (such as according to a weighted table); (4) determined based on a generated symbol or symbol combination; (5) determined independent of a generated symbol or symbol combination; (6) determined based on a random determination by a central controller (described below); (7) determined independent of a random determination by the central controller; (8) determined based on a random determination at an EGM; (9) determined independent of a random determination at the EGM; (10) determined based on at least one play of at least one game; (11) determined independent of at least one play of at least one game; (12) determined based on a player's selection; (13) determined independent of a player's selection; (14) determined based on one or more side wagers placed; (15) determined independent of one or more side wagers placed; (16) determined based on the player's primary game wager or wager level; (17) determined independent of the player's primary game wager or wager level; (18) determined based on time (such as the time of day); (19) determined independent of time (such as the time of day); (20) determined based on an amount of coin-in accumulated in one or more pools; (21) determined independent of an amount of coin-in accumulated in one or more pools; (22) determined based on a status of the player (i.e., a player tracking status); (23) determined independent of a status of the player (i.e., a player tracking status); (24) determined based on one or more other determinations disclosed herein; (25) determined independent of any other determination disclosed herein; or (26) determined in any other suitable manner or based on or independent of any other suitable factor(s).

8. Gaming Systems

The above-described embodiments of the present disclosure may be implemented in accordance with or in conjunction with one or more of a variety of different types of gaming systems, such as, but not limited to, those described below.

The present disclosure contemplates a variety of different gaming systems each having one or more of a plurality of different features, attributes, or characteristics. A "gaming system" as used herein refers to various configurations of: (a) one or more central servers, central controllers, or remote hosts; (b) one or more electronic gaming machines such as those located on a casino floor; and/or (c) one or more personal gaming devices, such as desktop computers, laptop computers, tablet computers or computing devices, personal digital assistants, mobile phones, and other mobile computing devices.

Thus, in various embodiments, the gaming system of the present disclosure includes: (a) one or more electronic gaming machines in combination with one or more central servers, central controllers, or remote hosts; (b) one or more personal gaming devices in combination with one or more central servers, central controllers, or remote hosts; (c) one or more personal gaming devices in combination with one or more electronic gaming machines; (d) one or more personal gaming devices, one or more electronic gaming machines, and one or more central servers, central controllers, or remote hosts in combination with one another; (e) a single electronic gaming machine; (f) a plurality of electronic gaming machines in combination with one another; (g) a single personal gaming device; (h) a plurality of personal gaming devices in combination with one another; (I) a single central server, central controller, or remote host; and/or (j) a plurality of central servers, central controllers, or remote hosts in combination with one another.

For brevity and clarity and unless specifically stated otherwise, the term "EGM" is used herein to refer to an electronic gaming machine (such as a slot machine, a video poker machine, a video lottery terminal (VLT), a video keno machine, or a video bingo machine located on a casino floor). Additionally, for brevity and clarity and unless specifically stated otherwise, "EGM" as used herein represents one EGM or a plurality of EGMs, "personal gaming device" as used herein represents one personal gaming device or a plurality of personal gaming devices, and "central server, central controller, or remote host" as used herein represents one central server, central controller, or remote host or a plurality of central servers, central controllers, or remote hosts.

Figure 6:
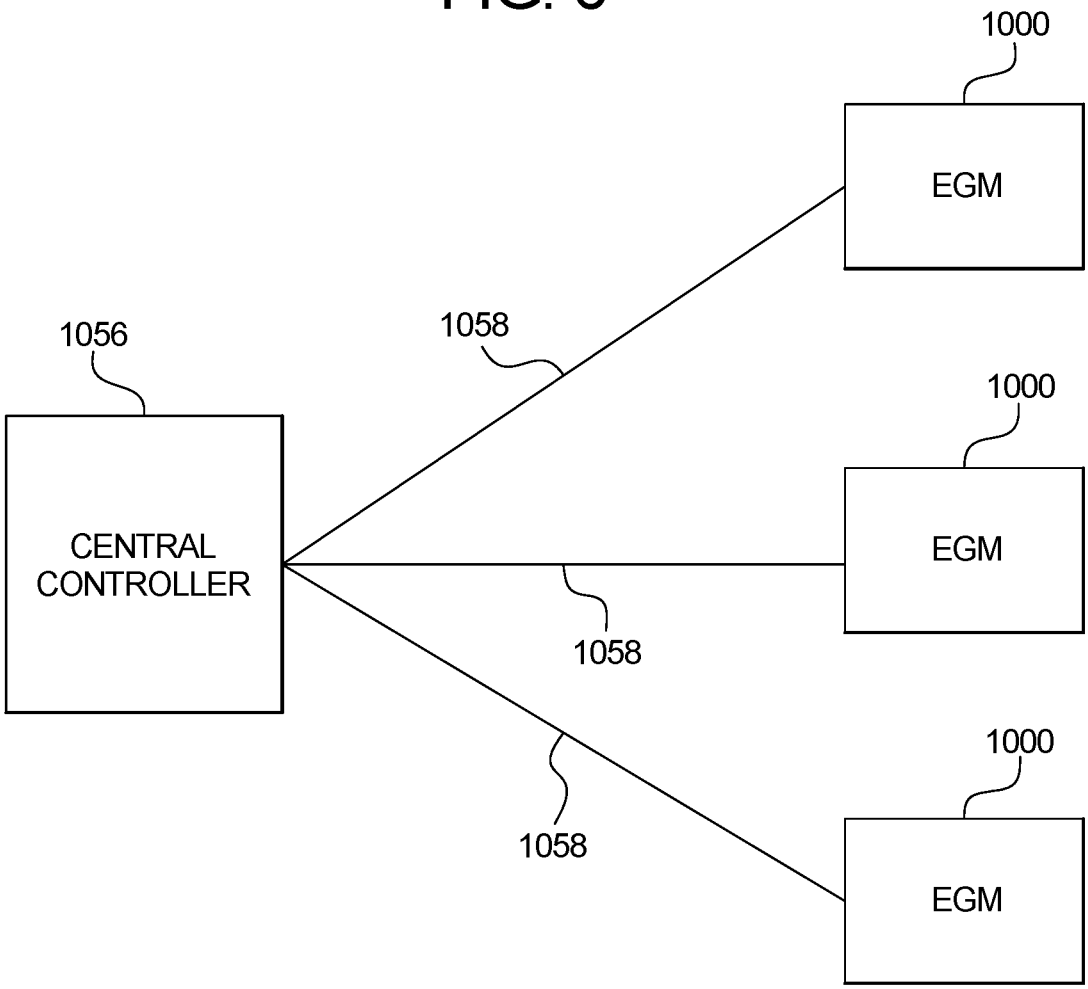
FIG. 6 is a schematic block diagram of one embodiment of a network configuration of the gaming system of the present disclosure.

As noted above, in various embodiments, the gaming system includes an EGM (or personal gaming device) in combination with a central server, central controller, or remote host. In such embodiments, the EGM (or personal gaming device) is configured to communicate with the central server, central controller, or remote host through a data network or remote communication link. In certain such embodiments, the EGM (or personal gaming device) is configured to communicate with another EGM (or personal gaming device) through the same data network or remote communication link or through a different data network or remote communication link. For example, the gaming system illustrated in FIG. 6 includes a plurality of EGMs 1000 that are each configured to communicate with a central server, central controller, or remote host 1056 through a data network 1058.

In certain embodiments in which the gaming system includes an EGM (or personal gaming device) in combination with a central server, central controller, or remote host, the central server, central controller, or remote host is any suitable computing device (such as a server) that includes at least one processor and at least one memory device or data storage device. As further described herein, the EGM (or personal gaming device) includes at least one EGM (or personal gaming device) processor configured to transmit and receive data or signals representing events, messages, commands, or any other suitable information between the EGM (or personal gaming device) and the central server, central controller, or remote host. The at least one processor of that EGM (or personal gaming device) is configured to execute the events, messages, or commands represented by such data or signals in conjunction with the operation of the EGM (or personal gaming device). Moreover, the at least one processor of the central server, central controller, or remote host is configured to transmit and receive data or signals representing events, messages, commands, or any other suitable information between the central server, central controller, or remote host and the EGM (or personal gaming device). The at least one processor of the central server, central controller, or remote host is configured to execute the events, messages, or commands represented by such data or signals in conjunction with the operation of the central server, central controller, or remote host. One, more than one, or each of the functions of the central server, central controller, or remote host may be performed by the at least one processor of the EGM (or personal gaming device). Further, one, more than one, or each of the functions of the at least one processor of the EGM (or personal gaming device) may be performed by the at least one processor of the central server, central controller, or remote host.

In certain such embodiments, computerized instructions for controlling any games (such as any primary or base games and/or any secondary or bonus games) displayed by the EGM (or personal gaming device) are executed by the central server, central controller, or remote host. In such "thin client" embodiments, the central server, central controller, or remote host remotely controls any games (or other suitable interfaces) displayed by the EGM (or personal gaming device), and the EGM (or personal gaming device) is utilized to display such games (or suitable interfaces) and to receive one or more inputs or commands. In other such embodiments, computerized instructions for controlling any games displayed by the EGM (or personal gaming device) are communicated from the central server, central controller, or remote host to the EGM (or personal gaming device) and are stored in at least one memory device of the EGM (or personal gaming device). In such "thick client" embodiments, the at least one processor of the EGM (or personal gaming device) executes the computerized instructions to control any games (or other suitable interfaces) displayed by the EGM (or personal gaming device).

In various embodiments in which the gaming system includes a plurality of EGMs (or personal gaming devices), one or more of the EGMs (or personal gaming devices) are thin client EGMs (or personal gaming devices) and one or more of the EGMs (or personal gaming devices) are thick client EGMs (or personal gaming devices). In other embodiments in which the gaming system includes one or more EGMs (or personal gaming devices), certain functions of one or more of the EGMs (or personal gaming devices) are implemented in a thin client environment, and certain other functions of one or more of the EGMs (or personal gaming devices) are implemented in a thick client environment. In one such embodiment in which the gaming system includes an EGM (or personal gaming device) and a central server, central controller, or remote host, computerized instructions for controlling any primary or base games displayed by the EGM (or personal gaming device) are communicated from the central server, central controller, or remote host to the EGM (or personal gaming device) in a thick client configuration, and computerized instructions for controlling any secondary or bonus games or other functions displayed by the EGM (or personal gaming device) are executed by the central server, central controller, or remote host in a thin client configuration.

In certain embodiments in which the gaming system includes: (a) an EGM (or personal gaming device) configured to communicate with a central server, central controller, or remote host through a data network; and/or (b) a plurality of EGMs (or personal gaming devices) configured to communicate with one another through a data network, the data network is a local area network (LAN) in which the EGMs (or personal gaming devices) are located substantially proximate to one another and/or the central server, central controller, or remote host. In one example, the EGMs (or personal gaming devices) and the central server, central controller, or remote host are located in a gaming establishment or a portion of a gaming establishment.

In other embodiments in which the gaming system includes: (a) an EGM (or personal gaming device) configured to communicate with a central server, central controller, or remote host through a data network; and/or (b) a plurality of EGMs (or personal gaming devices) configured to communicate with one another through a data network, the data network is a wide area network (WAN) in which one or more of the EGMs (or personal gaming devices) are not necessarily located substantially proximate to another one of the EGMs (or personal gaming devices) and/or the central server, central controller, or remote host. For example, one or more of the EGMs (or personal gaming devices) are located: (a) in an area of a gaming establishment different from an area of the gaming establishment in which the central server, central controller, or remote host is located; or (b) in a gaming establishment different from the gaming establishment in which the central server, central controller, or remote host is located. In another example, the central server, central controller, or remote host is not located within a gaming establishment in which the EGMs (or personal gaming devices) are located. In certain embodiments in which the data network is a WAN, the gaming system includes a central server, central controller, or remote host and an EGM (or personal gaming device) each located in a different gaming establishment in a same geographic area, such as a same city or a same state. Gaming systems in which the data network is a WAN are substantially identical to gaming systems in which the data network is a LAN, though the quantity of EGMs (or personal gaming devices) in such gaming systems may vary relative to one another.

In further embodiments in which the gaming system includes: (a) an EGM (or personal gaming device) configured to communicate with a central server, central controller, or remote host through a data network; and/or (b) a plurality of EGMs (or personal gaming devices) configured to communicate with one another through a data network, the data network is an internet (such as the Internet) or an intranet. In certain such embodiments, an Internet browser of the EGM (or personal gaming device) is usable to access an Internet game page from any location where an Internet connection is available. In one such embodiment, after the EGM (or personal gaming device) accesses the Internet game page, the central server, central controller, or remote host identifies a player before enabling that player to place any wagers on any plays of any wagering games. In one example, the central server, central controller, or remote host identifies the player by requiring a player account of the player to be logged into via an input of a unique username and password combination assigned to the player. The central server, central controller, or remote host may, however, identify the player in any other suitable manner, such as by validating a player tracking identification number associated with the player; by reading a player tracking card or other smart card inserted into a card reader (as described below); by validating a unique player identification number associated with the player by the central server, central controller, or remote host; or by identifying the EGM (or personal gaming device), such as by identifying the MAC address or the IP address of the Internet facilitator. In various embodiments, once the central server, central controller, or remote host identifies the player, the central server, central controller, or remote host enables placement of one or more wagers on one or more plays of one or more primary or base games and/or one or more secondary or bonus games, and displays those plays via the Internet browser of the EGM (or personal gaming device). Examples of implementations of Internet-based gaming are further described in U.S. Pat. No. 8,764,566, entitled "Internet Remote Game Server," and U.S. Pat. No. 8,147,334, entitled "Universal Game Server," which are incorporated herein by reference.

The central server, central controller, or remote host and the EGM (or personal gaming device) are configured to connect to the data network or remote communications link in any suitable manner. In various embodiments, such a connection is accomplished via: a conventional phone line or other data transmission line, a digital subscriber line (DSL), a T-1 line, a coaxial cable, a fiber optic cable, a wireless or wired routing device, a mobile communications network connection (such as a cellular network or mobile Internet network), or any other suitable medium. The expansion in the quantity of computing devices and the quantity and speed of Internet connections in recent years increases opportunities for players to use a variety of EGMs (or personal gaming devices) to play games from an ever-increasing quantity of remote sites. Additionally, the enhanced bandwidth of digital wireless communications may render such technology suitable for some or all communications, particularly if such communications are encrypted. Higher data transmission speeds may be useful for enhancing the sophistication and response of the display and interaction with players.

9. EGM Components

Figure 7:
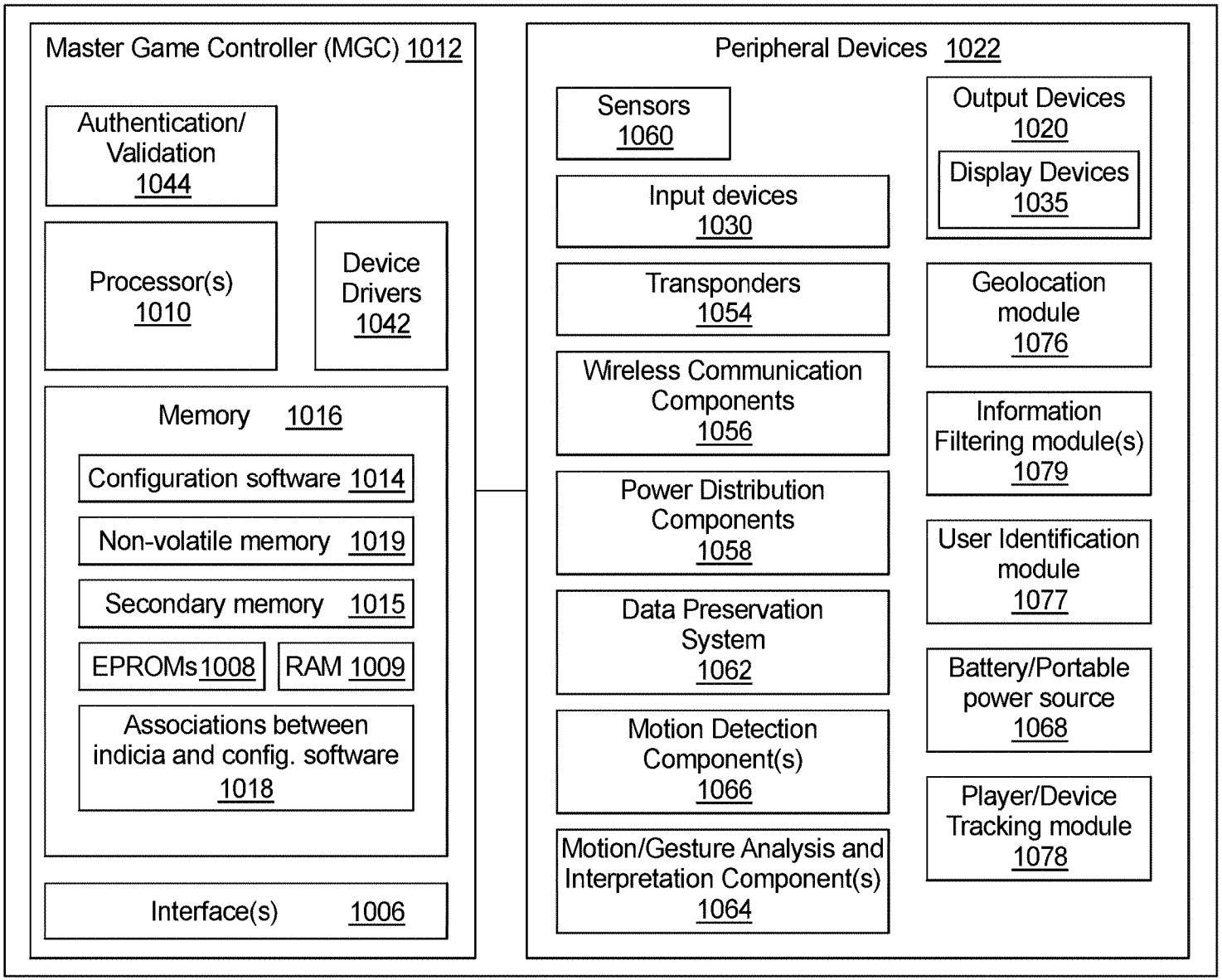
FIG. 7 is a schematic block diagram of an example electronic configuration of the gaming system of the present disclosure.
Figure 8A:
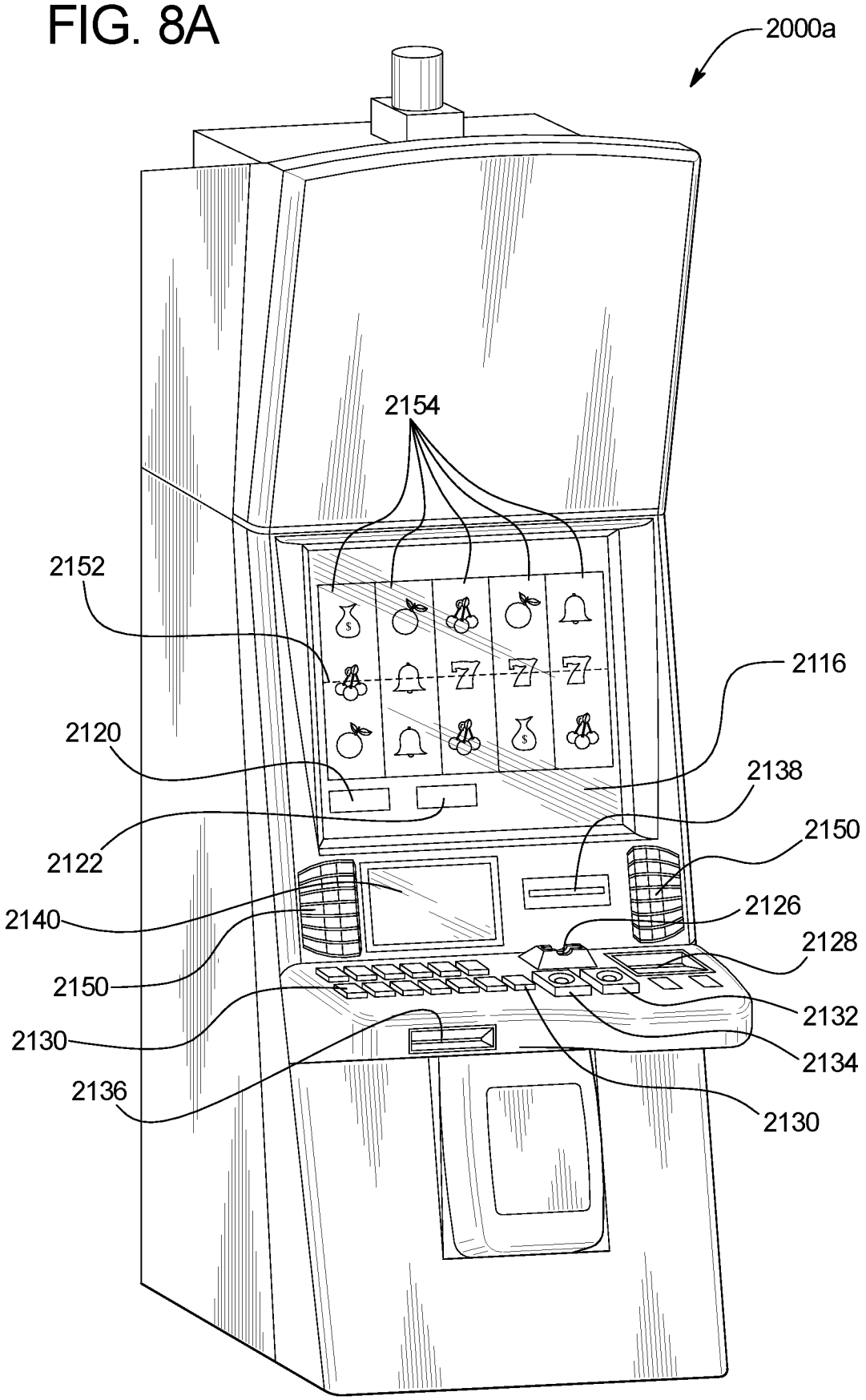
FIGS. 8A and 8B are perspective views of example alternative embodiments of the gaming system of the present disclosure.
Figure 8B:
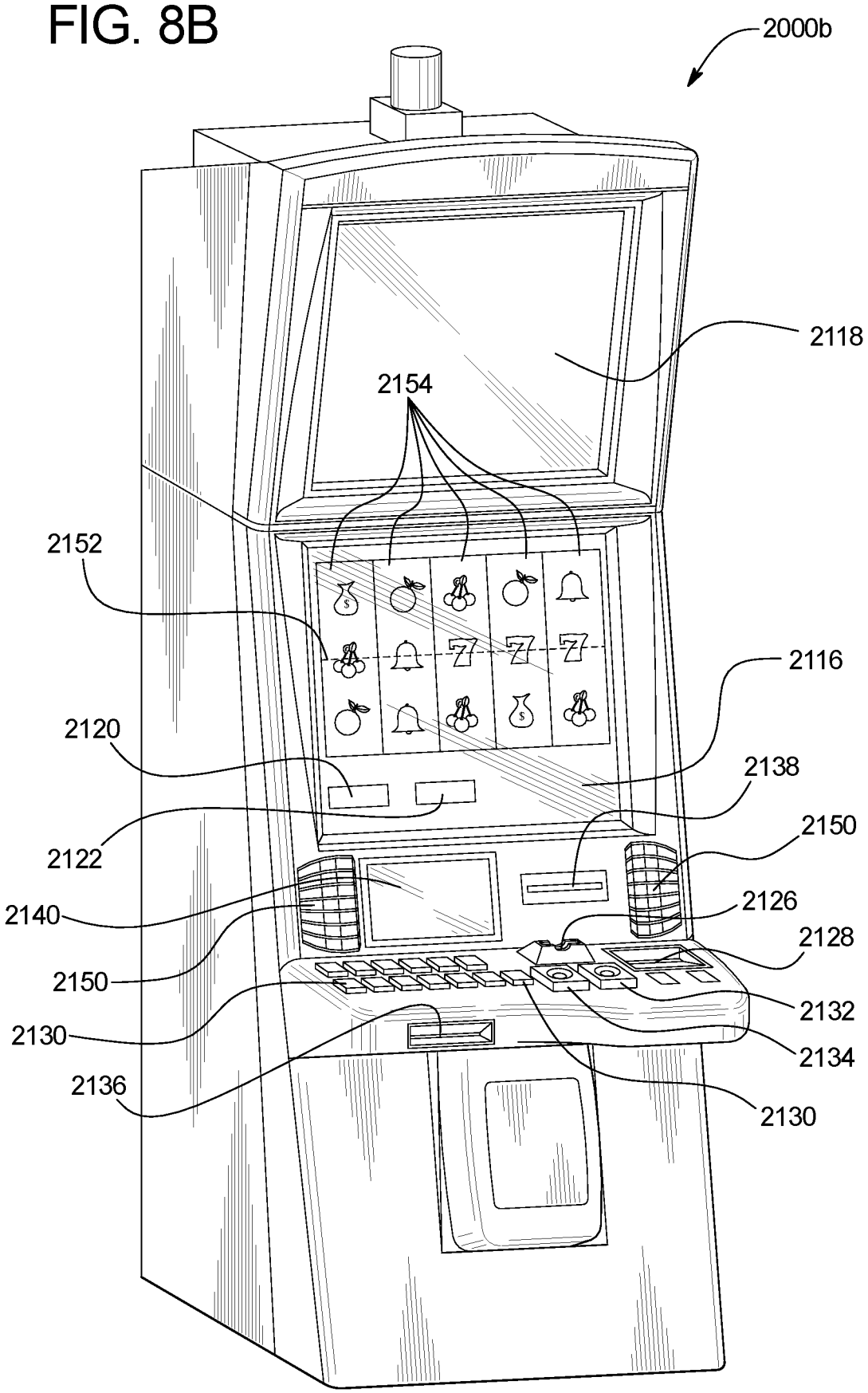
Figure 8C:
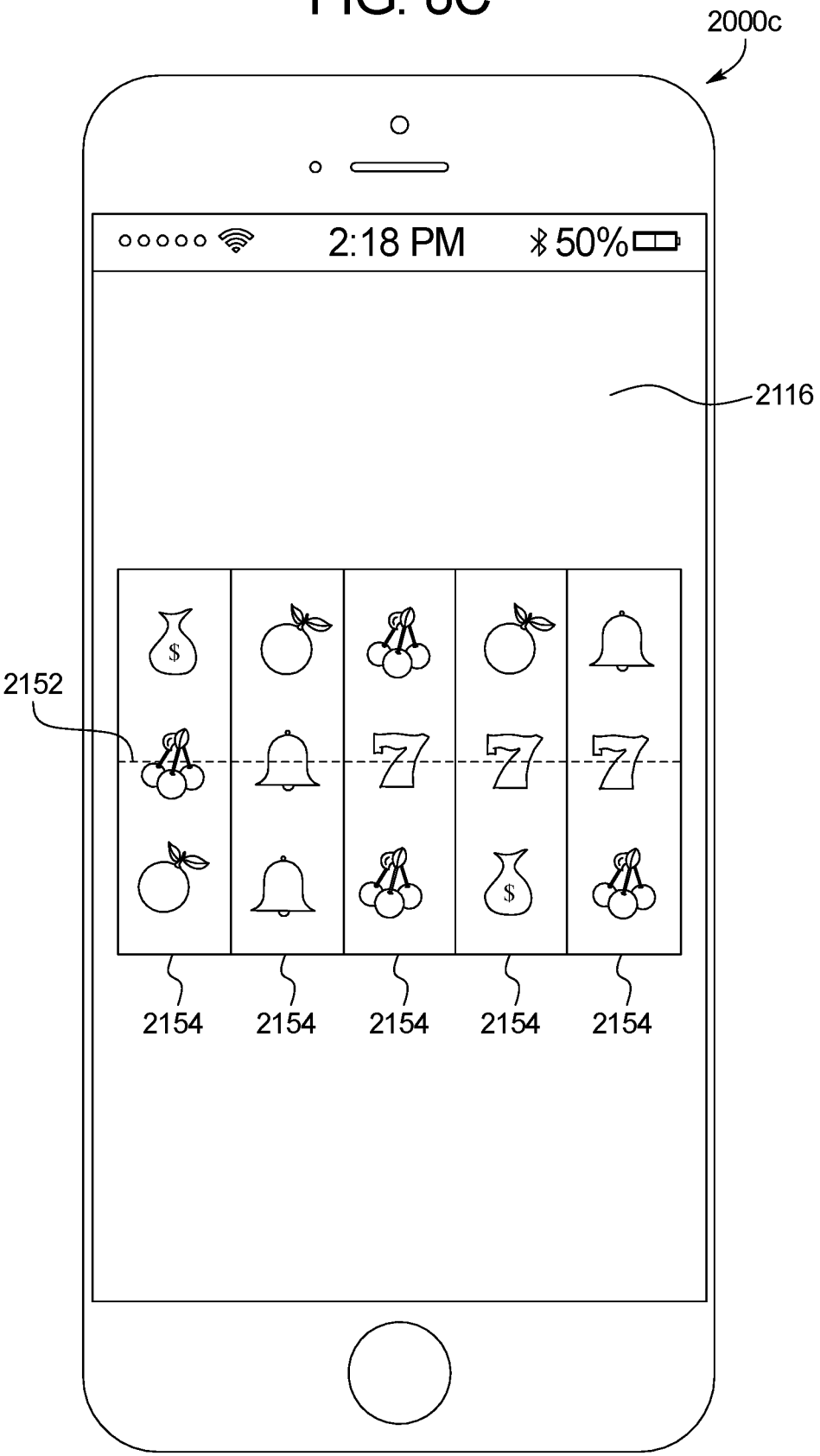
FIG. 8C is a front view of an example personal gaming device of the gaming system disclosed herein.

FIG. 7 is a block diagram of an example EGM 1000 and FIGS. 8A and 8B include two different example EGMs 2000*a* and 2000*b*. The EGMs 1000, 2000*a*, and 2000*b* are merely example EGMs, and different EGMs may be implemented using different combinations of the components shown in the EGMs 1000, 2000*a*, and 2000*b*. Although the below refers to EGMs, in various embodiments personal gaming devices (such as personal gaming device 2000*c* of FIG. 8C) may include some or all of the below components.

In these embodiments, the EGM 1000 includes a master gaming controller 1012 configured to communicate with and to operate with a plurality of peripheral devices 1022.

The master gaming controller 1012 includes at least one processor 1010. The at least one processor 1010 is any suitable processing device or set of processing devices, such as a microprocessor, a microcontroller-based platform, a suitable integrated circuit, or one or more application-specific integrated circuits (ASICs), configured to execute software enabling various configuration and reconfiguration tasks, such as: (1) communicating with a remote source (such as a server that stores authentication information or game information) via a communication interface 1006 of the master gaming controller 1012; (2) converting signals read by an interface to a format corresponding to that used by software or memory of the EGM; (3) accessing memory to configure or reconfigure game parameters in the memory according to indicia read from the EGM; (4) communicating with interfaces and the peripheral devices 1022 (such as input/output devices); and/or (5) controlling the peripheral devices 1022. In certain embodiments, one or more components of the master gaming controller 1012 (such as the at least one processor 1010) reside within a housing of the EGM (described below), while in other embodiments at least one component of the master gaming controller 1012 resides outside of the housing of the EGM.

The master gaming controller 1012 also includes at least one memory device 1016, which includes: (1) volatile memory (e.g., RAM 1009, which can include non-volatile RAM, magnetic RAM, ferroelectric RAM, and any other suitable forms); (2) non-volatile memory 1019 (e.g., disk memory, FLASH memory, EPROMs, EEPROMs, memristor-based non-volatile solid-state memory, etc.); (3) unalterable memory (e.g., EPROMs 1008); (4) read-only memory; and/or (5) a secondary memory storage device 1015, such as a non-volatile memory device, configured to store gaming software related information (the gaming software related information and the memory may be used to store various audio files and games not currently being used and invoked in a configuration or reconfiguration). Any other suitable magnetic, optical, and/or semiconductor memory may operate in conjunction with the EGM disclosed herein. In certain embodiments, the at least one memory device 1016 resides within the housing of the EGM (described below), while in other embodiments at least one component of the at least one memory device 1016 resides outside of the housing of the EGM.

The at least one memory device 1016 is configured to store, for example: (1) configuration software 1014, such as all the parameters and settings for a game playable on the EGM; (2) associations 1018 between configuration indicia read from an EGM with one or more parameters and settings; (3) communication protocols configured to enable the at least one processor 1010 to communicate with the peripheral devices 1022; and/or (4) communication transport protocols (such as TCP/IP, USB, Firewire, IEEE1394, Bluetooth, IEEE 802.11x (IEEE 802.11 standards), hiperlan/2, HomeRF, etc.) configured to enable the EGM to communicate with local and non-local devices using such protocols. In one implementation, the master gaming controller 1012 communicates with other devices using a serial communication protocol. A few non-limiting examples of serial communication protocols that other devices, such as peripherals (e.g., a bill validator or a ticket printer), may use to communicate with the master game controller 1012 include USB, RS-232, and Netplex (a proprietary protocol developed by IGT).

In certain embodiments, the at least one memory device 1016 is configured to store program code and instructions executable by the at least one processor of the EGM to control the EGM. The at least one memory device 1016 of the EGM also stores other operating data, such as image data, event data, input data, random number generators (RNGs) or pseudo-RNGs, paytable data or information, and/or applicable game rules that relate to the play of one or more games on the EGM. In various embodiments, part or all of the program code and/or the operating data described above is stored in at least one detachable or removable memory device including, but not limited to, a cartridge, a disk, a CD ROM, a DVD, a USB memory device, or any other suitable non-transitory computer readable medium. In certain such embodiments, an operator (such as a gaming establishment operator) and/or a player uses such a removable memory device in an EGM to implement at least part of the present disclosure. In other embodiments, part or all of the program code and/or the operating data is downloaded to the at least one memory device of the EGM through any suitable data network described above (such as an Internet or intranet).

The at least one memory device 1016 also stores a plurality of device drivers 1042. Examples of different types of device drivers include device drivers for EGM components and device drivers for the peripheral components 1022. Typically, the device drivers 1042 utilize various communication protocols that enable communication with a particular physical device. The device driver abstracts the hardware implementation of that device. For example, a device driver may be written for each type of card reader that could potentially be connected to the EGM. Non-limiting examples of communication protocols used to implement the device drivers include Netplex, USB, Serial, Ethernet 175, Firewire, I/O debouncer, direct memory map, serial, PCI, parallel, RF, Bluetooth™' near-field communications (e.g., using near-field magnetics), 802.11 (WiFi), etc. In one embodiment, when one type of a particular device is exchanged for another type of the particular device, the at least one processor of the EGM loads the new device driver from the at least one memory device to enable communication with the new device. For instance, one type of card reader in the EGM can be replaced with a second different type of card reader when device drivers for both card readers are stored in the at least one memory device.

In certain embodiments, the software units stored in the at least one memory device 1016 can be upgraded as needed. For instance, when the at least one memory device 1016 is a hard drive, new games, new game options, new parameters, new settings for existing parameters, new settings for new parameters, new device drivers, and new communication protocols can be uploaded to the at least one memory device 1016 from the master game controller 1012 or from some other external device. As another example, when the at least one memory device 1016 includes a CD/DVD drive including a CD/DVD configured to store game options, parameters, and settings, the software stored in the at least one memory device 1016 can be upgraded by replacing a first CD/DVD with a second CD/DVD. In yet another example, when the at least one memory device 1016 uses flash memory 1019 or EPROM 1008 units configured to store games, game options, parameters, and settings, the software stored in the flash and/or EPROM memory units can be upgraded by replacing one or more memory units with new memory units that include the upgraded software. In another embodiment, one or more of the memory devices, such as the hard drive, may be employed in a game software download process from a remote software server.

In some embodiments, the at least one memory device 1016 also stores authentication and/or validation components 1044 configured to authenticate/validate specified EGM components and/or information, such as hardware components, software components, firmware components, peripheral device components, user input device components, information received from one or more user input devices, information stored in the at least one memory device 1016, etc. Examples of various authentication and/or validation components are described in U.S. Pat. No. 6,620,047, entitled "Electronic Gaming Apparatus Having Authentication Data Sets," which is incorporated herein by reference.

In certain embodiments, the peripheral devices 1022 include several device interfaces, such as: (1) at least one output device 1020 including at least one display device 1035; (2) at least one input device 1030 (which may include contact and/or non-contact interfaces); (3) at least one transponder 1054; (4) at least one wireless communication component 1056; (5) at least one wired/wireless power distribution component 1058; (6) at least one sensor 1060; (7) at least one data preservation component 1062; (8) at least one motion/gesture analysis and interpretation component 1064; (9) at least one motion detection component 1066; (10) at least one portable power source 1068; (11) at least one geolocation module 1076; (12) at least one user identification module 1077; (13) at least one player/device tracking module 1078; and (14) at least one information filtering module 1079.

The at least one output device 1020 includes at least one display device 1035 configured to display any game(s) displayed by the EGM and any suitable information associated with such game(s). In certain embodiments, the display devices are connected to or mounted on a housing of the EGM (described below). In various embodiments, the display devices serve as digital glass configured to advertise certain games or other aspects of the gaming establishment in which the EGM is located. In various embodiments, the EGM includes one or more of the following display devices: (a) a central display device; (b) a player tracking display configured to display various information regarding a player's player tracking status (as described below); (c) a secondary or upper display device in addition to the central display device and the player tracking display; (d) a credit display configured to display a current quantity of credits, amount of cash, account balance, or the equivalent; and (e) a bet display configured to display an amount wagered for one or more plays of one or more games. The example EGM 2000*a* illustrated in FIG. 8A includes a central display device 2116, a player tracking display 2140, a credit display 2120, and a bet display 2122. The example EGM 2000*b* illustrated in FIG. 8B includes a central display device 2116, an upper display device 2118, a player tracking display 2140, a credit display 2120, and a bet display 2122.

In various embodiments, the display devices include, without limitation: a monitor, a television display, a plasma display, a liquid crystal display (LCD), a display based on light emitting diodes (LEDs), a display based on a plurality of organic light-emitting diodes (OLEDs), a display based on polymer light-emitting diodes (PLEDs), a display based on a plurality of surface-conduction electron-emitters (SEDs), a display including a projected and/or reflected image, or any other suitable electronic device or display mechanism. In certain embodiments, as described above, the display device includes a touch-screen with an associated touch-screen controller. The display devices may be of any suitable sizes, shapes, and configurations.

The display devices of the EGM are configured to display one or more game and/or non-game images, symbols, and indicia. In certain embodiments, the display devices of the EGM are configured to display any suitable visual representation or exhibition of the movement of objects; dynamic lighting; video images; images of people, characters, places, things, and faces of cards; and the like. In certain embodiments, the display devices of the EGM are configured to display one or more video reels, one or more video wheels, and/or one or more video dice. In other embodiments, certain of the displayed images, symbols, and indicia are in mechanical form. That is, in these embodiments, the display device includes any electromechanical device, such as one or more rotatable wheels, one or more reels, and/or one or more dice, configured to display at least one or a plurality of game or other suitable images, symbols, or indicia.

In various embodiments, the at least one output device 1020 includes a payout device. In these embodiments, after the EGM receives an actuation of a cashout device (described below), the EGM causes the payout device to provide a payment to the player. In one embodiment, the payout device is one or more of: (a) a ticket printer and dispenser configured to print and dispense a ticket or credit slip associated with a monetary value, wherein the ticket or credit slip may be redeemed for its monetary value via a cashier, a kiosk, or other suitable redemption system; (b) a bill dispenser configured to dispense paper currency; (c) a coin dispenser configured to dispense coins or tokens (such as into a coin payout tray); and (d) any suitable combination thereof. The example EGMs 2000*a* and 2000*b* illustrated in FIGS. 8A and 8B each include a ticket printer and dispenser 2136. Examples of ticket-in ticket-out (TITO) technology are described in U.S. Pat. No. 5,429,361, entitled "Gaming Machine Information, Communication and Display System"; U.S. Pat. No. 5,470,079, entitled "Gaming Machine Accounting and Monitoring System"; U.S. Pat. No. 5,265,874, entitled "Cashless Gaming Apparatus and Method"; U.S. Pat. No. 6,729,957, entitled "Gaming Method and Host Computer with Ticket-In/Ticket-Out Capability"; U.S. Pat. No. 6,729,958, entitled "Gaming System with Ticket-In/Ticket-Out Capability"; U.S. Pat. No. 6,736,725, entitled "Gaming Method and Host Computer with Ticket-In/Ticket-Out Capability"; U.S. Pat. No. 7,275,991, entitled "Slot Machine with Ticket-In/Ticket-Out Capability"; U.S. Pat. No. 6,048,269, entitled "Coinless Slot Machine System and Method"; and U.S. Pat. No. 5,290,003, entitled "Gaming Machine and Coupons," which are incorporated herein by reference.

In certain embodiments, rather than dispensing bills, coins, or a physical ticket having a monetary value to the player following receipt of an actuation of the cashout device, the payout device is configured to cause a payment to be provided to the player in the form of an electronic funds transfer, such as via a direct deposit into a bank account, a casino account, or a prepaid account of the player; via a transfer of funds onto an electronically recordable identification card or smart card of the player; or via sending a virtual ticket having a monetary value to an electronic device of the player. Examples of providing payment using virtual tickets are described in U.S. Pat. No. 8,613,659, entitled "Virtual Ticket-In and Ticket-Out on a Gaming Machine," which is incorporated herein by reference.

While any credit balances, any wagers, any values, and any awards are described herein as amounts of monetary credits or currency, one or more of such credit balances, such wagers, such values, and such awards may be for non-monetary credits, promotional credits, of player tracking points or credits.

In certain embodiments, the at least one output device 1020 is a sound generating device controlled by one or more sound cards. In one such embodiment, the sound generating device includes one or more speakers or other sound generating hardware and/or software configured to generate sounds, such as by playing music for any games or by playing music for other modes of the EGM, such as an attract mode. The example EGMs 2000*a* and 2000*b* illustrated in FIGS. 8A and 8B each include a plurality of speakers 2150. In another such embodiment, the EGM provides dynamic sounds coupled with attractive multimedia images displayed on one or more of the display devices to provide an audio-visual representation or to otherwise display full-motion video with sound to attract players to the EGM. In certain embodiments, the EGM displays a sequence of audio and/or visual attraction messages during idle periods to attract potential players to the EGM. The videos may be customized to provide any appropriate information.

The at least one input device 1030 may include any suitable device that enables an input signal to be produced and received by the at least one processor 1010 of the EGM.

In one embodiment, the at least one input device 1030 includes a payment device configured to communicate with the at least one processor of the EGM to fund the EGM. In certain embodiments, the payment device includes one or more of: (a) a bill acceptor into which paper money is inserted to fund the EGM; (b) a ticket acceptor into which a ticket or a voucher is inserted to fund the EGM; (c) a coin slot into which coins or tokens are inserted to fund the EGM; (d) a reader or a validator for credit cards, debit cards, or credit slips into which a credit card, debit card, or credit slip is inserted to fund the EGM; (e) a player identification card reader into which a player identification card is inserted to fund the EGM; or (f) any suitable combination thereof. The example EGMs 2000*a* and 2000*b* illustrated in FIGS. 8A and 8B each include a combined bill and ticket acceptor 2128 and a coin slot 2126.

In one embodiment, the at least one input device 1030 includes a payment device configured to enable the EGM to be funded via an electronic funds transfer, such as a transfer of funds from a bank account. In another embodiment, the EGM includes a payment device configured to communicate with a mobile device of a player, such as a mobile phone, a radio frequency identification tag, or any other suitable wired or wireless device, to retrieve relevant information associated with that player to fund the EGM. Examples of funding an EGM via communication between the EGM and a mobile device (such as a mobile phone) of a player are described in U.S. Patent Application Publication No. 2013/0344942, entitled "Avatar as Security Measure for Mobile Device Use with Electronic Gaming Machine," which is incorporated herein by reference. When the EGM is funded, the at least one processor determines the amount of funds entered and displays the corresponding amount on a credit display or any other suitable display as described below.

In certain embodiments, the at least one input device 1030 includes at least one wagering or betting device. In various embodiments, the one or more wagering or betting devices are each: (1) a mechanical button supported by the housing of the EGM (such as a hard key or a programmable soft key), or (2) an icon displayed on a display device of the EGM (described below) that is actuatable via a touch screen of the EGM (described below) or via use of a suitable input device of the EGM (such as a mouse or a joystick). One such wagering or betting device is as a maximum wager or bet device that, when actuated, causes the EGM to place a maximum wager on a play of a game. Another such wagering or betting device is a repeat bet device that, when actuated, causes the EGM to place a wager that is equal to the previously-placed wager on a play of a game. A further such wagering or betting device is a bet one device that, when actuated, causes the EGM to increase the wager by one credit. Generally, upon actuation of one of the wagering or betting devices, the quantity of credits displayed in a credit meter (described below) decreases by the amount of credits wagered, while the quantity of credits displayed in a bet display (described below) increases by the amount of credits wagered.

In various embodiments, the at least one input device 1030 includes at least one game play activation device. In various embodiments, the one or more game play initiation devices are each: (1) a mechanical button supported by the housing of the EGM (such as a hard key or a programmable soft key), or (2) an icon displayed on a display device of the EGM (described below) that is actuatable via a touch screen of the EGM (described below) or via use of a suitable input device of the EGM (such as a mouse or a joystick). After a player appropriately funds the EGM and places a wager, the EGM activates the game play activation device to enable the player to actuate the game play activation device to initiate a play of a game on the EGM (or another suitable sequence of events associated with the EGM). After the EGM receives an actuation of the game play activation device, the EGM initiates the play of the game. The example EGMs 2000*a* and 2000*b* illustrated in FIGS. 8A and 8B each include a game play activation device in the form of a game play initiation button 2132. In other embodiments, the EGM begins game play automatically upon appropriate funding rather than upon utilization of the game play activation device.

In other embodiments, the at least one input device 1030 includes a cashout device. In various embodiments, the cashout device is: (1) a mechanical button supported by the housing of the EGM (such as a hard key or a programmable soft key), or (2) an icon displayed on a display device of the EGM (described below) that is actuatable via a touch screen of the EGM (described below) or via use of a suitable input device of the EGM (such as a mouse or a joystick). When the EGM receives an actuation of the cashout device from a player and the player has a positive (i.e., greater-than-zero) credit balance, the EGM initiates a payout associated with the player's credit balance. The example EGMs 2000*a* and 2000*b* illustrated in FIGS. 8A and 8B each include a cashout device in the form of a cashout button 2134.

In various embodiments, the at least one input device 1030 includes a plurality of buttons that are programmable by the EGM operator to, when actuated, cause the EGM to perform particular functions. For instance, such buttons may be hard keys, programmable soft keys, or icons icon displayed on a display device of the EGM (described below) that are actuatable via a touch screen of the EGM (described below) or via use of a suitable input device of the EGM (such as a mouse or a joystick). The example EGMs 2000*a* and 2000*b* illustrated in FIGS. 8A and 8B each include a plurality of such buttons 2130.

In certain embodiments, the at least one input device 1030 includes a touch-screen coupled to a touch-screen controller or other touch-sensitive display overlay to enable interaction with any images displayed on a display device (as described below). One such input device is a conventional touch-screen button panel. The touch-screen and the touch-screen controller are connected to a video controller. In these embodiments, signals are input to the EGM by touching the touch screen at the appropriate locations.

In embodiments including a player tracking system, as further described below, the at least one input device 1030 includes a card reader in communication with the at least one processor of the EGM. The example EGMs 2000*a* and 2000*b* illustrated in FIGS. 8A and 8B each include a card reader 2138. The card reader is configured to read a player identification card inserted into the card reader.

The at least one wireless communication component 1056 includes one or more communication interfaces having different architectures and utilizing a variety of protocols, such as (but not limited to) 802.11 (WiFi); 802.15 (including Bluetooth™); 802.16 (WiMax); 802.22; cellular standards such as CDMA, CDMA2000, and WCDMA; Radio Frequency (e.g., RFID); infrared; and Near Field Magnetic communication protocols. The at least one wireless communication component 1056 transmits electrical, electromagnetic, or optical signals that carry digital data streams or analog signals representing various types of information.

The at least one wired/wireless power distribution component 1058 includes components or devices that are configured to provide power to other devices. For example, in one embodiment, the at least one power distribution component 1058 includes a magnetic induction system that is configured to provide wireless power to one or more user input devices near the EGM. In one embodiment, a user input device docking region is provided, and includes a power distribution component that is configured to recharge a user input device without requiring metal-to-metal contact. In one embodiment, the at least one power distribution component 1058 is configured to distribute power to one or more internal components of the EGM, such as one or more rechargeable power sources (e.g., rechargeable batteries) located at the EGM.

In certain embodiments, the at least one sensor 1060 includes at least one of: optical sensors, pressure sensors, RF sensors, infrared sensors, image sensors, thermal sensors, and biometric sensors. The at least one sensor 1060 may be used for a variety of functions, such as: detecting movements and/or gestures of various objects within a predetermined proximity to the EGM; detecting the presence and/or identity of various persons (e.g., players, casino employees, etc.), devices (e.g., user input devices), and/or systems within a predetermined proximity to the EGM.

The at least one data preservation component 1062 is configured to detect or sense one or more events and/or conditions that, for example, may result in damage to the EGM and/or that may result in loss of information associated with the EGM. Additionally, the data preservation system 1062 may be operable to initiate one or more appropriate action(s) in response to the detection of such events/conditions.

The at least one motion/gesture analysis and interpretation component 1064 is configured to analyze and/or interpret information relating to detected player movements and/or gestures to determine appropriate player input information relating to the detected player movements and/or gestures. For example, in one embodiment, the at least one motion/gesture analysis and interpretation component 1064 is configured to perform one or more of the following functions: analyze the detected gross motion or gestures of a player; interpret the player's motion or gestures (e.g., in the context of a casino game being played) to identify instructions or input from the player; utilize the interpreted instructions/input to advance the game state; etc. In other embodiments, at least a portion of these additional functions may be implemented at a remote system or device.

The at least one portable power source 1068 enables the EGM to operate in a mobile environment. For example, in one embodiment, the EGM 300 includes one or more rechargeable batteries.

The at least one geolocation module 1076 is configured to acquire geolocation information from one or more remote sources and use the acquired geolocation information to determine information relating to a relative and/or absolute position of the EGM. For example, in one implementation, the at least one geolocation module 1076 is configured to receive GPS signal information for use in determining the position or location of the EGM. In another implementation, the at least one geolocation module 1076 is configured to receive multiple wireless signals from multiple remote devices (e.g., EGMs, servers, wireless access points, etc.) and use the signal information to compute position/location information relating to the position or location of the EGM.

The at least one user identification module 1077 is configured to determine the identity of the current user or current owner of the EGM. For example, in one embodiment, the current user is required to perform a login process at the EGM in order to access one or more features. Alternatively, the EGM is configured to automatically determine the identity of the current user based on one or more external signals, such as an RFID tag or badge worn by the current user and that provides a wireless signal to the EGM that is used to determine the identity of the current user. In at least one embodiment, various security features are incorporated into the EGM to prevent unauthorized users from accessing confidential or sensitive information.

The at least one information filtering module 1079 is configured to perform filtering (e.g., based on specified criteria) of selected information to be displayed at one or more displays 1035 of the EGM.

In various embodiments, the EGM includes a plurality of communication ports configured to enable the at least one processor of the EGM to communicate with and to operate with external peripherals, such as: accelerometers, arcade sticks, bar code readers, bill validators, biometric input devices, bonus devices, button panels, card readers, coin dispensers, coin hoppers, display screens or other displays or video sources, expansion buses, information panels, keypads, lights, mass storage devices, microphones, motion sensors, motors, printers, reels, SCSI ports, solenoids, speakers, thumbsticks, ticket readers, touch screens, trackballs, touchpads, wheels, and wireless communication devices. U.S. Pat. No. 7,290,072 describes a variety of EGMs including one or more communication ports that enable the EGMs to communicate and operate with one or more external peripherals.

As generally described above, in certain embodiments, such as the example EGMs 2000*a* and 2000*b* illustrated in FIGS. 8A and 8B, the EGM has a support structure, housing, or cabinet that provides support for a plurality of the input devices and the output devices of the EGM. Further, the EGM is configured such that a player may operate it while standing or sitting. In various embodiments, the EGM is positioned on a base or stand, or is configured as a pub-style tabletop game (not shown) that a player may operate typically while sitting. As illustrated by the different example EGMs 2000*a* and 2000*b* shown in FIGS. 8A and 8B, EGMs may have varying housing and display configurations.

In certain embodiments, the EGM is a device that has obtained approval from a regulatory gaming commission, and in other embodiments, the EGM is a device that has not obtained approval from a regulatory gaming commission.

The EGMs described above are merely three examples of different types of EGMs. Certain of these example EGMs may include one or more elements that may not be included in all gaming systems, and these example EGMs may not include one or more elements that are included in other gaming systems. For example, certain EGMs include a coin acceptor while others do not.

10. Operation of Primary or Base Games and/or Secondary or Bonus Games

In various embodiments, an EGM may be implemented in one of a variety of different configurations. In various embodiments, the EGM may be implemented as one of: (a) a dedicated EGM in which computerized game programs executable by the EGM for controlling any primary or base games (referred to herein as "primary games") and/or any secondary or bonus games or other functions (referred to herein as "secondary games") displayed by the EGM are provided with the EGM before delivery to a gaming establishment or before being provided to a player; and (b) a changeable EGM in which computerized game programs executable by the EGM for controlling any primary games and/or secondary games displayed by the EGM are downloadable or otherwise transferred to the EGM through a data network or remote communication link; from a USB drive, flash memory card, or other suitable memory device; or in any other suitable manner after the EGM is physically located in a gaming establishment or after the EGM is provided to a player.

As generally explained above, in various embodiments in which the gaming system includes a central server, central controller, or remote host and a changeable EGM, the at least one memory device of the central server, central controller, or remote host stores different game programs and instructions executable by the at least one processor of the changeable EGM to control one or more primary games and/or secondary games displayed by the changeable EGM. More specifically, each such executable game program represents a different game or a different type of game that the at least one changeable EGM is configured to operate. In one example, certain of the game programs are executable by the changeable EGM to operate games having the same or substantially the same game play but different paytables. In different embodiments, each executable game program is associated with a primary game, a secondary game, or both. In certain embodiments, an executable game program is executable by the at least one processor of the at least one changeable EGM as a secondary game to be played simultaneously with a play of a primary game (which may be downloaded to or otherwise stored on the at least one changeable EGM), or vice versa.

In operation of such embodiments, the central server, central controller, or remote host is configured to communicate one or more of the stored executable game programs to the at least one processor of the changeable EGM. In different embodiments, a stored executable game program is communicated or delivered to the at least one processor of the changeable EGM by: (a) embedding the executable game program in a device or a component (such as a microchip to be inserted into the changeable EGM); (b) writing the executable game program onto a disc or other media; or (c) uploading or streaming the executable game program over a data network (such as a dedicated data network). After the executable game program is communicated from the central server, central controller, or remote host to the changeable EGM, the at least one processor of the changeable EGM executes the executable game program to enable the primary game and/or the secondary game associated with that executable game program to be played using the display device(s) and/or the input device(s) of the changeable EGM. That is, when an executable game program is communicated to the at least one processor of the changeable EGM, the at least one processor of the changeable EGM changes the game or the type of game that may be played using the changeable EGM.

In certain embodiments, the gaming system randomly determines any game outcome(s) (such as a win outcome) and/or award(s) (such as a quantity of credits to award for the win outcome) for a play of a primary game and/or a play of a secondary game based on probability data. In certain such embodiments, this random determination is provided through utilization of an RNG, such as a true RNG or a pseudo RNG, or any other suitable randomization process. In one such embodiment, each game outcome or award is associated with a probability, and the gaming system generates the game outcome(s) and/or the award(s) to be provided based on the associated probabilities. In these embodiments, since the gaming system generates game outcomes and/or awards randomly or based on one or more probability calculations, there is no certainty that the gaming system will ever provide any specific game outcome and/or award.

In certain embodiments, the gaming system maintains one or more predetermined pools or sets of predetermined game outcomes and/or awards. In certain such embodiments, upon generation or receipt of a game outcome and/or award request, the gaming system independently selects one of the predetermined game outcomes and/or awards from the one or more pools or sets. The gaming system flags or marks the selected game outcome and/or award as used. Once a game outcome or an award is flagged as used, it is prevented from further selection from its respective pool or set; that is, the gaming system does not select that game outcome or award upon another game outcome and/or award request. The gaming system provides the selected game outcome and/or award. Examples of this type of award evaluation are described in U.S. Pat. No. 7,470,183, entitled "Finite Pool Gaming Method and Apparatus"; U.S. Pat. No. 7,563,163, entitled "Gaming Device Including Outcome Pools for Providing Game Outcomes"; U.S. Pat. No. 7,833,092, entitled "Method and System for Compensating for Player Choice in a Game of Chance"; U.S. Pat. No. 8,070,579, entitled "Bingo System with Downloadable Common Patterns"; and U.S. Pat. No. 8,398,472, entitled "Central Determination Poker Game," which are incorporated herein by reference.

In certain embodiments, the gaming system determines a predetermined game outcome and/or award based on the results of a bingo, keno, or lottery game. In certain such embodiments, the gaming system utilizes one or more bingo, keno, or lottery games to determine the predetermined game outcome and/or award provided for a primary game and/or a secondary game. The gaming system is provided or associated with a bingo card. Each bingo card consists of a matrix or array of elements, wherein each element is designated with separate indicia. After a bingo card is provided, the gaming system randomly selects or draws a plurality of the elements. As each element is selected, a determination is made as to whether the selected element is present on the bingo card. If the selected element is present on the bingo card, that selected element on the provided bingo card is marked or flagged. This process of selecting elements and marking any selected elements on the provided bingo cards continues until one or more predetermined patterns are marked on one or more of the provided bingo cards. After one or more predetermined patterns are marked on one or more of the provided bingo cards, game outcome and/or award is determined based, at least in part, on the selected elements on the provided bingo cards. Examples of this type of award determination are described in U.S. Pat. No. 7,753,774, entitled "Using Multiple Bingo Cards to Represent Multiple Slot Paylines and Other Class III Game Options"; U.S. Pat. No. 7,731,581, entitled "Multi-Player Bingo Game with Multiple Alternative Outcome Displays"; U.S. Pat. No. 7,955,170, entitled "Providing Non-Bingo Outcomes for a Bingo Game"; U.S. Pat. No. 8,070,579, entitled "Bingo System with Downloadable Common Patterns"; and U.S. Pat. No. 8,500,538, entitled "Bingo Gaming System and Method for Providing Multiple Outcomes from Single Bingo Pattern," which are incorporated herein by reference.

In certain embodiments in which the gaming system includes a central server, central controller, or remote host and an EGM, the EGM is configured to communicate with the central server, central controller, or remote host for monitoring purposes only. In such embodiments, the EGM determines the game outcome(s) and/or award(s) to be provided in any of the manners described above, and the central server, central controller, or remote host monitors the activities and events occurring on the EGM. In one such embodiment, the gaming system includes a real-time or online accounting and gaming information system configured to communicate with the central server, central controller, or remote host. In this embodiment, the accounting and gaming information system includes: (a) a player database configured to store player profiles, (b) a player tracking module configured to track players (as described below), and (c) a credit system configured to provide automated transactions. Examples of such accounting systems are described in U.S. Pat. No. 6,913,534, entitled "Gaming Machine Having a Lottery Game and Capability for Integration with Gaming Device Accounting System and Player Tracking System," and U.S. Pat. No. 8,597,116, entitled "Virtual Player Tracking and Related Services," which are incorporated herein by reference.

As noted above, in various embodiments, the gaming system includes one or more executable game programs executable by at least one processor of the gaming system to provide one or more primary games and one or more secondary games. The primary game(s) and the secondary game(s) may comprise any suitable games and/or wagering games, such as, but not limited to: electro-mechanical or video slot or spinning reel type games; video card games such as video draw poker, multi-hand video draw poker, other video poker games, video blackjack games, and video baccarat games; video keno games; video bingo games; and video selection games.

In certain embodiments in which the primary game is a slot or spinning reel type game, the gaming system includes one or more reels in either an electromechanical form with mechanical rotating reels or in a video form with simulated reels and movement thereof. Each reel displays a plurality of indicia or symbols, such as bells, hearts, fruits, numbers, letters, bars, or other images that typically correspond to a theme associated with the gaming system. In certain such embodiments, the gaming system includes one or more paylines associated with the reels. The example EGM 2000*b* shown in FIG. 8B includes a payline 1152 and a plurality of reels 1154. In certain embodiments, one or more of the reels are independent reels or unisymbol reels. In such embodiments, each independent reel generates and displays one symbol.

In various embodiments, one or more of the paylines is horizontal, vertical, circular, diagonal, angled, or any suitable combination thereof. In other embodiments, each of one or more of the paylines is associated with a plurality of adjacent symbol display areas on a requisite number of adjacent reels. In one such embodiment, one or more paylines are formed between at least two symbol display areas that are adjacent to each other by either sharing a common side or sharing a common corner (i.e., such paylines are connected paylines). The gaming system enables a wager to be placed on one or more of such paylines to activate such paylines. In other embodiments in which one or more paylines are formed between at least two adjacent symbol display areas, the gaming system enables a wager to be placed on a plurality of symbol display areas, which activates those symbol display areas.

In various embodiments, the gaming system provides one or more awards after a spin of the reels when specified types and/or configurations of the indicia or symbols on the reels occur on an active payline or otherwise occur in a winning pattern, occur on the requisite number of adjacent reels, and/or occur in a scatter pay arrangement.

In certain embodiments, the gaming system employs a ways to win award determination. In these embodiments, any outcome to be provided is determined based on a number of associated symbols that are generated in active symbol display areas on the requisite number of adjacent reels (i.e., not on paylines passing through any displayed winning symbol combinations). If a winning symbol combination is generated on the reels, one award for that occurrence of the generated winning symbol combination is provided. Examples of ways to win award determinations are described in U.S. Pat. No. 8,012,011, entitled "Gaming Device and Method Having Independent Reels and Multiple Ways of Winning"; U.S. Pat. No. 8,241,104, entitled "Gaming Device and Method Having Designated Rules for Determining Ways To Win"; and U.S. Pat. No. 8,430,739, entitled "Gaming System and Method Having Wager Dependent Different Symbol Evaluations," which are incorporated herein by reference.

In various embodiments, the gaming system includes a progressive award. Typically, a progressive award includes an initial amount and an additional amount funded through a portion of each wager placed to initiate a play of a primary game. When one or more triggering events occurs, the gaming system provides at least a portion of the progressive award. After the gaming system provides the progressive award, an amount of the progressive award is reset to the initial amount and a portion of each subsequent wager is allocated to the next progressive award. Examples of progressive gaming systems are described in U.S. Pat. No. 7,585,223, entitled "Server Based Gaming System Having Multiple Progressive Awards"; U.S. Pat. No. 7,651,392, entitled "Gaming Device System Having Partial Progressive Payout"; U.S. Pat. No. 7,666,093, entitled "Gaming Method and Device Involving Progressive Wagers"; U.S. Pat. No. 7,780,523, entitled "Server Based Gaming System Having Multiple Progressive Awards"; and U.S. Pat. No. 8,337,298, entitled "Gaming Device Having Multiple Different Types of Progressive Awards," which are incorporated herein by reference As generally noted above, in addition to providing winning credits or other awards for one or more plays of the primary game(s), in various embodiments the gaming system provides credits or other awards for one or more plays of one or more secondary games. The secondary game typically enables an award to be obtained addition to any award obtained through play of the primary game(s). The secondary game(s) typically produces a higher level of player excitement than the primary game(s) because the secondary game(s) provides a greater expectation of winning than the primary game(s) and is accompanied with more attractive or unusual features than the primary game(s). The secondary game(s) may be any type of suitable game, either similar to or completely different from the primary game.

In various embodiments, the gaming system automatically provides or initiates the secondary game upon the occurrence of a triggering event or the satisfaction of a qualifying condition. In other embodiments, the gaming system initiates the secondary game upon the occurrence of the triggering event or the satisfaction of the qualifying condition and upon receipt of an initiation input. In certain embodiments, the triggering event or qualifying condition is a selected outcome in the primary game(s) or a particular arrangement of one or more indicia on a display device for a play of the primary game(s), such as a "BONUS" symbol appearing on three adjacent reels along a payline following a spin of the reels for a play of the primary game. In other embodiments, the triggering event or qualifying condition occurs based on a certain amount of game play (such as number of games, number of credits, amount of time) being exceeded, or based on a specified number of points being earned during game play. Any suitable triggering event or qualifying condition or any suitable combination of a plurality of different triggering events or qualifying conditions may be employed.

In other embodiments, at least one processor of the gaming system randomly determines when to provide one or more plays of one or more secondary games. In one such embodiment, no apparent reason is provided for providing the secondary game. In this embodiment, qualifying for a secondary game is not triggered by the occurrence of an event in any primary game or based specifically on any of the plays of any primary game. That is, qualification is provided without any explanation or, alternatively, with a simple explanation. In another such embodiment, the gaming system determines qualification for a secondary game at least partially based on a game triggered or symbol triggered event, such as at least partially based on play of a primary game.

In various embodiments, after qualification for a secondary game has been determined, the secondary game participation may be enhanced through continued play on the primary game. Thus, in certain embodiments, for each secondary game qualifying event, such as a secondary game symbol, that is obtained, a given number of secondary game wagering points or credits is accumulated in a "secondary game meter" configured to accrue the secondary game wagering credits or entries toward eventual participation in the secondary game. In one such embodiment, the occurrence of multiple such secondary game qualifying events in the primary game results in an arithmetic or exponential increase in the number of secondary game wagering credits awarded. In another such embodiment, any extra secondary game wagering credits may be redeemed during the secondary game to extend play of the secondary game.

In certain embodiments, no separate entry fee or buy-in for the secondary game is required. That is, entry into the secondary game cannot be purchased; rather, in these embodiments entry must be won or earned through play of the primary game, thereby encouraging play of the primary game. In other embodiments, qualification for the secondary game is accomplished through a simple "buy-in." For example, qualification through other specified activities is unsuccessful, payment of a fee or placement of an additional wager "buys-in" to the secondary game. In certain embodiments, a separate side wager must be placed on the secondary game or a wager of a designated amount must be placed on the primary game to enable qualification for the secondary game. In these embodiments, the secondary game triggering event must occur and the side wager (or designated primary game wager amount) must have been placed for the secondary game to trigger.

In various embodiments in which the gaming system includes a plurality of EGMs, the EGMs are configured to communicate with one another to provide a group gaming environment. In certain such embodiments, the EGMs enable players of those EGMs to work in conjunction with one another, such as by enabling the players to play together as a team or group, to win one or more awards. In other such embodiments, the EGMs enable players of those EGMs to compete against one another for one or more awards. In one such embodiment, the EGMs enable the players of those EGMs to participate in one or more gaming tournaments for one or more awards. Examples of group gaming systems are described in U.S. Pat. No. 8,070,583, entitled "Server Based Gaming System and Method for Selectively Providing One or More Different Tournaments"; U.S. Pat. No. 8,500,548, entitled "Gaming System and Method for Providing Team Progressive Awards"; and U.S. Pat. No. 8,562,423, entitled "Method and Apparatus for Rewarding Multiple Game Players for a Single Win," which are incorporated herein by reference.

In various embodiments, the gaming system includes one or more player tracking systems. Such player tracking systems enable operators of the gaming system (such as casinos or other gaming establishments) to recognize the value of customer loyalty by identifying frequent customers and rewarding them for their patronage. Such a player tracking system is configured to track a player's gaming activity. In one such embodiment, the player tracking system does so through the use of player tracking cards. In this embodiment, a player is issued a player identification card that has an encoded player identification number that uniquely identifies the player. When the player's playing tracking card is inserted into a card reader of the gaming system to begin a gaming session, the card reader reads the player identification number off the player tracking card to identify the player. The gaming system timely tracks any suitable information or data relating to the identified player's gaming session. The gaming system also timely tracks when the player tracking card is removed to conclude play for that gaming session. In another embodiment, rather than requiring insertion of a player tracking card into the card reader, the gaming system utilizes one or more portable devices, such as a mobile phone, a radio frequency identification tag, or any other suitable wireless device, to track when a gaming session begins and ends. In another embodiment, the gaming system utilizes any suitable biometric technology or ticket technology to track when a gaming session begins and ends.

In such embodiments, during one or more gaming sessions, the gaming system tracks any suitable information or data, such as any amounts wagered, average wager amounts, and/or the time at which these wagers are placed. In different embodiments, for one or more players, the player tracking system includes the player's account number, the player's card number, the player's first name, the player's surname, the player's preferred name, the player's player tracking ranking, any promotion status associated with the player's player tracking card, the player's address, the player's birthday, the player's anniversary, the player's recent gaming sessions, or any other suitable data. In various embodiments, such tracked information and/or any suitable feature associated with the player tracking system is displayed on a player tracking display. In various embodiments, such tracked information and/or any suitable feature associated with the player tracking system is displayed via one or more service windows that are displayed on the central display device and/or the upper display device. Examples of player tracking systems are described in U.S. Pat. No. 6,722,985, entitled "Universal Player Tracking System"; U.S. Pat. No. 6,908,387, entitled "Player Tracking Communication Mechanisms in a Gaming Machine"; U.S. Pat. No. 7,311,605, entitled "Player Tracking Assembly for Complete Patron Tracking for Both Gaming and Non-Gaming Casino Activity"; U.S. Pat. No. 7,611,411, entitled "Player Tracking Instruments Having Multiple Communication Modes"; U.S. Pat. No. 7,617,151, entitled "Alternative Player Tracking Techniques"; and U.S. Pat. No. 8,057,298, entitled "Virtual Player Tracking and Related Services," which are incorporated herein by reference.

11. Web-Based Gaming

In various embodiments, the gaming system includes one or more servers configured to communicate with a personal gaming device—such as a smartphone, a tablet computer, a desktop computer, or a laptop computer—to enable web-based game play using the personal gaming device. In various embodiments, the player must first access a gaming website via an Internet browser of the personal gaming device or execute an application (commonly called an "app") installed on the personal gaming device before the player can use the personal gaming device to participate in web-based game play. In certain embodiments, the one or more servers and the personal gaming device operate in a thin-client environment. In these embodiments, the personal gaming device receives inputs via one or more input devices (such as a touch screen and/or physical buttons), the personal gaming device sends the received inputs to the one or more servers, the one or more servers make various determinations based on the inputs and determine content to be displayed (such as a randomly determined game outcome and corresponding award), the one or more servers send the content to the personal gaming device, and the personal gaming device displays the content.

In certain such embodiments, the one or more servers must identify the player before enabling game play on the personal gaming device (or, in some embodiments, before enabling monetary wager-based game play on the personal gaming device). In these embodiments, the player must identify herself to the one or more servers, such as by inputting the player's unique username and password combination, providing an input to a biometric sensor (e.g., a fingerprint sensor, a retinal sensor, a voice sensor, or a facial-recognition sensor), or providing any other suitable information.

Once identified, the one or more servers enable the player to establish an account balance from which the player can draw credits usable to wager on plays of a game. In certain embodiments, the one or more servers enable the player to initiate an electronic funds transfer to transfer funds from a bank account to the player's account balance. In other embodiments, the one or more servers enable the player to make a payment using the player's credit card, debit card, or other suitable device to add money to the player's account balance. In other embodiments, the one or more servers enable the player to add money to the player's account balance via a peer-to-peer type application, such as PayPal or Venmo. The one or more servers also enable the player to cash out the player's account balance (or part of it) in any suitable manner, such as via an electronic funds transfer, by initiating creation of a paper check that is mailed to the player, or by initiating printing of a voucher at a kiosk in a gaming establishment.

In certain embodiments, the one or more servers include a payment server that handles establishing and cashing out players' account balances and a separate game server configured to determine the outcome and any associated award for a play of a game. In these embodiments, the game server is configured to communicate with the personal gaming device and the payment device, and the personal gaming device and the payment device are not configured to directly communicate with one another. In these embodiments, when the game server receives data representing a request to start a play of a game at a desired wager, the game server sends data representing the desired wager to the payment server. The payment server determines whether the player's account balance can cover the desired wager (i.e., includes a monetary balance at least equal to the desired wager).

If the payment server determines that the player's account balance cannot cover the desired wager, the payment server notifies the game server, which then instructs the personal gaming device to display a suitable notification to the player that the player's account balance is too low to place the desired wager. If the payment server determines that the player's account balance can cover the desired wager, the payment server deducts the desired wager from the account balance and notifies the game server. The game server then determines an outcome and any associated award for the play of the game. The game server notifies the payment server of any nonzero award, and the payment server increases the player's account balance by the nonzero award. The game server sends data representing the outcome and any award to the personal gaming device, which displays the outcome and any award.

In certain embodiments, the one or more servers enable web-based game play using a personal gaming device only if the personal gaming device satisfies one or more jurisdictional requirements. In one embodiment, the one or more servers enable web-based game play using the personal gaming device only if the personal gaming device is located within a designated geographic area (such as within certain state or county lines or within the boundaries of a gaming establishment). In this embodiment, the geolocation module of the personal gaming device determines the location of the personal gaming device and sends the location to the one or more servers, which determine whether the personal gaming device is located within the designated geographic area. In various embodiments, the one or more servers enable non-monetary wager-based game play if the personal gaming device is located outside of the designated geographic area.

In various embodiments, the gaming system includes an EGM configured to communicate with a personal gaming device—such as a smartphone, a tablet computer, a desktop computer, or a laptop computer—to enable tethered mobile game play using the personal gaming device. Generally, in these embodiments, the EGM establishes communication with the personal gaming device and enables the player to play games on the EGM remotely via the personal gaming device. In certain embodiments, the gaming system includes a geo-fence system that enables tethered game play within a particular geographic area but not outside of that geographic area. Examples of tethering an EGM to a personal gaming device and geo-fencing are described in U.S. Patent Appl. Pub. No. 2013/0267324, entitled "Remote Gaming Method Allowing Temporary Inactivation Without Terminating Playing Session Due to Game Inactivity," which is incorporated herein by reference.

12. Social Network Integration

In certain embodiments, the gaming system is configured to communicate with a social network server that hosts or partially hosts a social networking website via a data network (such as the Internet) to integrate a player's gaming experience with the player's social networking account. This enables the gaming system to send certain information to the social network server that the social network server can use to create content (such as text, an image, and/or a video) and post it to the player's wall, newsfeed, or similar area of the social networking website accessible by the player's connections (and in certain cases the public) such that the player's connections can view that information. This also enables the gaming system to receive certain information from the social network server, such as the player's likes or dislikes or the player's list of connections. In certain embodiments, the gaming system enables the player to link the player's player account to the player's social networking account(s). This enables the gaming system to, once it identifies the player and initiates a gaming session (such as via the player logging in to a website (or an application) on the player's personal gaming device or via the player inserting the player's player tracking card into an EGM), link that gaming session to the player's social networking account(s). In other embodiments, the gaming system enables the player to link the player's social networking account(s) to individual gaming sessions when desired by providing the required login information.

For instance, in one embodiment, if a player wins a particular award (e.g., a progressive award or a jackpot award) or an award that exceeds a certain threshold (e.g., an award exceeding $1,000), the gaming system sends information about the award to the social network server to enable the server to create associated content (such as a screenshot of the outcome and associated award) and to post that content to the player's wall (or other suitable area) of the social networking website for the player's connections to see (and to entice them to play). In another embodiment, if a player joins a multiplayer game and there is another seat available, the gaming system sends that information to the social network sever to enable the server to create associated content (such as text indicating a vacancy for that particular game) and to post that content to the player's wall (or other suitable area) of the social networking website for the player's connections to see (and to entice them to fill the vacancy). In another embodiment, if the player consents, the gaming system sends advertisement information or offer information to the social network server to enable the social network server to create associated content (such as text or an image reflecting an advertisement and/or an offer) and to post that content to the player's wall (or other suitable area) of the social networking website for the player's connections to see. In another embodiment, the gaming system enables the player to recommend a game to the player's connections by posting a recommendation to the player's wall (or other suitable area) of the social networking website.

13. Differentiating Certain Gaming Systems from General Purpose Computing Devices Certain of the gaming systems described herein, such as EGMs located in a casino or another gaming establishment, include certain components and/or are configured to operate in certain manners that differentiate these systems from general purpose computing devices, i.e., certain personal gaming devices such as desktop computers and laptop computers.

For instance, EGMs are highly regulated to ensure fairness and, in many cases, EGMs are configured to award monetary awards up to multiple millions of dollars. To satisfy security and regulatory requirements in a gaming environment, hardware and/or software architectures are implemented in EGMs that differ significantly from those of general purpose computing devices. For purposes of illustration, a description of EGMs relative to general purpose computing devices and some examples of these additional (or different) hardware and/or software architectures found in EGMs are described below.

At first glance, one might think that adapting general purpose computing device technologies to the gaming industry and EGMs would be a simple proposition because both general purpose computing devices and EGMs employ processors that control a variety of devices. However, due to at least: (1) the regulatory requirements placed on EGMs, (2) the harsh environment in which EGMs operate, (3) security requirements, and (4) fault tolerance requirements, adapting general purpose computing device technologies to EGMs can be quite difficult. Further, techniques and methods for solving a problem in the general purpose computing device industry, such as device compatibility and connectivity issues, might not be adequate in the gaming industry. For instance, a fault or a weakness tolerated in a general purpose computing device, such as security holes in software or frequent crashes, is not tolerated in an EGM because in an EGM these faults can lead to a direct loss of funds from the EGM, such as stolen cash or loss of revenue when the EGM is not operating properly or when the random outcome determination is manipulated.

Certain differences between general purpose computing devices and EGMs are described below. A first difference between EGMs and general purpose computing devices is that EGMs are state-based systems. A state-based system stores and maintains its current state in a non-volatile memory such that, in the event of a power failure or other malfunction, the state-based system can return to that state when the power is restored or the malfunction is remedied. For instance, for a state-based EGM, if the EGM displays an award for a game of chance but the power to the EGM fails before the EGM provides the award to the player, the EGM stores the pre-power failure state in a non-volatile memory, returns to that state upon restoration of power, and provides the award to the player. This requirement affects the software and hardware design on EGMs. General purpose computing devices are not state-based machines, and a majority of data is usually lost when a malfunction occurs on a general purpose computing device.

A second difference between EGMs and general purpose computing devices is that, for regulatory purposes, the software on the EGM utilized to operate the EGM has been designed to be static and monolithic to prevent cheating by the operator of the EGM. For instance, one solution that has been employed in the gaming industry to prevent cheating and to satisfy regulatory requirements has been to manufacture an EGM that can use a proprietary processor running instructions to provide the game of chance from an EPROM or other form of non-volatile memory. The coding instructions on the EPROM are static (non-changeable) and must be approved by a gaming regulators in a particular jurisdiction and installed in the presence of a person representing the gaming jurisdiction. Any changes to any part of the software required to generate the game of chance, such as adding a new device driver used to operate a device during generation of the game of chance, can require burning a new EPROM approved by the gaming jurisdiction and reinstalling the new EPROM on the EGM in the presence of a gaming regulator. Regardless of whether the EPROM solution is used, to gain approval in most gaming jurisdictions, an EGM must demonstrate sufficient safeguards that prevent an operator or a player of an EGM from manipulating the EGM's hardware and software in a manner that gives him an unfair, and in some cases illegal, advantage.

A third difference between EGMs and general purpose computing devices is authentication—EGMs storing code are configured to authenticate the code to determine if the code is unaltered before executing the code. If the code has been altered, the EGM prevents the code from being executed. The code authentication requirements in the gaming industry affect both hardware and software designs on EGMs. Certain EGMs use hash functions to authenticate code. For instance, one EGM stores game program code, a hash function, and an authentication hash (which may be encrypted). Before executing the game program code, the EGM hashes the game program code using the hash function to obtain a result hash and compares the result hash to the authentication hash. If the result hash matches the authentication hash, the EGM determines that the game program code is valid and executes the game program code. If the result hash does not match the authentication hash, the EGM determines that the game program code has been altered (i.e., may have been tampered with) and prevents execution of the game program code. Examples of EGM code authentication are described in U.S. Pat. No. 6,962,530, entitled "Authentication in a Secure Computerized Gaming System"; U.S. Pat. No. 7,043,641, entitled "Encryption in a Secure Computerized Gaming System"; U.S. Pat. No. 7,201,662, entitled "Method and Apparatus for Software Authentication"; and U.S. Pat. No. 8,627,097, entitled "System and Method Enabling Parallel Processing of Hash Functions Using Authentication Checkpoint Hashes," which are incorporated herein by reference.

A fourth difference between EGMs and general purpose computing devices is that EGMs have unique peripheral device requirements that differ from those of a general purpose computing device, such as peripheral device security requirements not usually addressed by general purpose computing devices. For instance, monetary devices, such as coin dispensers, bill validators, and ticket printers and computing devices that are used to govern the input and output of cash or other items having monetary value (such as tickets) to and from an EGM have security requirements that are not typically addressed in general purpose computing devices. Therefore, many general purpose computing device techniques and methods developed to facilitate device connectivity and device compatibility do not address the emphasis placed on security in the gaming industry.

To address some of the issues described above, a number of hardware/software components and architectures are utilized in EGMs that are not typically found in general purpose computing devices. These hardware/software components and architectures, as described below in more detail, include but are not limited to watchdog timers, voltage monitoring systems, state-based software architecture and supporting hardware, specialized communication interfaces, security monitoring, and trusted memory.

Certain EGMs use a watchdog timer to provide a software failure detection mechanism. In a normally-operating EGM, the operating software periodically accesses control registers in the watchdog timer subsystem to "re-trigger" the watchdog. Should the operating software fail to access the control registers within a preset timeframe, the watchdog timer will timeout and generate a system reset. Typical watchdog timer circuits include a loadable timeout counter register to enable the operating software to set the timeout interval within a certain range of time. A differentiating feature of some circuits is that the operating software cannot completely disable the function of the watchdog timer. In other words, the watchdog timer always functions from the time power is applied to the board.

Certain EGMs use several power supply voltages to operate portions of the computer circuitry. These can be generated in a central power supply or locally on the computer board. If any of these voltages falls out of the tolerance limits of the circuitry they power, unpredictable operation of the EGM may result. Though most modern general purpose computing devices include voltage monitoring circuitry, these types of circuits only report voltage status to the operating software. Out of tolerance voltages can cause software malfunction, creating a potential uncontrolled condition in the general purpose computing device. Certain EGMs have power supplies with relatively tighter voltage margins than that required by the operating circuitry. In addition, the voltage monitoring circuitry implemented in certain EGMs typically has two thresholds of control. The first threshold generates a software event that can be detected by the operating software and an error condition then generated. This threshold is triggered when a power supply voltage falls out of the tolerance range of the power supply, but is still within the operating range of the circuitry. The second threshold is set when a power supply voltage falls out of the operating tolerance of the circuitry. In this case, the circuitry generates a reset, halting operation of the EGM.

As described above, certain EGMs are state-based machines. Different functions of the game provided by the EGM (e.g., bet, play, result, points in the graphical presentation, etc.) may be defined as a state. When the EGM moves a game from one state to another, the EGM stores critical data regarding the game software in a custom non-volatile memory subsystem. This ensures that the player's wager and credits are preserved and to minimize potential disputes in the event of a malfunction on the EGM. In general, the EGM does not advance from a first state to a second state until critical information that enables the first state to be reconstructed has been stored. This feature enables the EGM to recover operation to the current state of play in the event of a malfunction, loss of power, etc. that occurred just before the malfunction. In at least one embodiment, the EGM is configured to store such critical information using atomic transactions.

Generally, an atomic operation in computer science refers to a set of operations that can be combined so that they appear to the rest of the system to be a single operation with only two possible outcomes: success or failure. As related to data storage, an atomic transaction may be characterized as series of database operations which either all occur, or all do not occur. A guarantee of atomicity prevents updates to the database occurring only partially, which can result in data corruption.

To ensure the success of atomic transactions relating to critical information to be stored in the EGM memory before a failure event (e.g., malfunction, loss of power, etc.), memory that includes one or more of the following criteria be used: direct memory access capability; data read/write capability which meets or exceeds minimum read/write access characteristics (such as at least 5.08 Mbytes/sec (Read) and/or at least 38.0 Mbytes/sec (Write)). Memory devices that meet or exceed the above criteria may be referred to as "fault-tolerant" memory devices.

Typically, battery-backed RAM devices may be configured to function as fault-tolerant devices according to the above criteria, whereas flash RAM and/or disk drive memory are typically not configurable to function as fault-tolerant devices according to the above criteria. Accordingly, battery-backed RAM devices are typically used to preserve EGM critical data, although other types of non-volatile memory devices may be employed. These memory devices are typically not used in typical general purpose computing devices.

Thus, in at least one embodiment, the EGM is configured to store critical information in fault-tolerant memory (e.g., battery-backed RAM devices) using atomic transactions. Further, in at least one embodiment, the fault-tolerant memory is able to successfully complete all desired atomic transactions (e.g., relating to the storage of EGM critical information) within a time period of 200 milliseconds or less. In at least one embodiment, the time period of 200 milliseconds represents a maximum amount of time for which sufficient power may be available to the various EGM components after a power outage event has occurred at the EGM.

As described previously, the EGM may not advance from a first state to a second state until critical information that enables the first state to be reconstructed has been atomically stored. After the state of the EGM is restored during the play of a game of chance, game play may resume and the game may be completed in a manner that is no different than if the malfunction had not occurred. Thus, for example, when a malfunction occurs during a game of chance, the EGM may be restored to a state in the game of chance just before when the malfunction occurred. The restored state may include metering information and graphical information that was displayed on the EGM in the state before the malfunction. For example, when the malfunction occurs during the play of a card game after the cards have been dealt, the EGM may be restored with the cards that were previously displayed as part of the card game. As another example, a bonus game may be triggered during the play of a game of chance in which a player is required to make a number of selections on a video display screen. When a malfunction has occurred after the player has made one or more selections, the EGM may be restored to a state that shows the graphical presentation just before the malfunction including an indication of selections that have already been made by the player. In general, the EGM may be restored to any state in a plurality of states that occur in the game of chance that occurs while the game of chance is played or to states that occur between the play of a game of chance.

Game history information regarding previous games played such as an amount wagered, the outcome of the game, and the like may also be stored in a non-volatile memory device. The information stored in the non-volatile memory may be detailed enough to reconstruct a portion of the graphical presentation that was previously presented on the EGM and the state of the EGM (e.g., credits) at the time the game of chance was played. The game history information may be utilized in the event of a dispute. For example, a player may decide that in a previous game of chance that they did not receive credit for an award that they believed they won. The game history information may be used to reconstruct the state of the EGM before, during, and/or after the disputed game to demonstrate whether the player was correct or not in the player's assertion. Examples of a state-based EGM, recovery from malfunctions, and game history are described in U.S. Pat. No. 6,804,763, entitled "High Performance Battery Backed RAM Interface"; U.S. Pat. No. 6,863,608, entitled "Frame Capture of Actual Game Play"; U.S. Pat. No. 7,111,141, entitled "Dynamic NV-RAM"; and U.S. Pat. No. 7,384,339, entitled, "Frame Capture of Actual Game Play," which are incorporated herein by reference.

Another feature of EGMs is that they often include unique interfaces, including serial interfaces, to connect to specific subsystems internal and external to the EGM. The serial devices may have electrical interface requirements that differ from the "standard" EIA serial interfaces provided by general purpose computing devices. These interfaces may include, for example, Fiber Optic Serial, optically coupled serial interfaces, current loop style serial interfaces, etc. In addition, to conserve serial interfaces internally in the EGM, serial devices may be connected in a shared, daisy-chain fashion in which multiple peripheral devices are connected to a single serial channel.

The serial interfaces may be used to transmit information using communication protocols that are unique to the gaming industry. For example, IGT's Netplex is a proprietary communication protocol used for serial communication between EGMs. As another example, SAS is a communication protocol used to transmit information, such as metering information, from an EGM to a remote device. Often SAS is used in conjunction with a player tracking system.

Certain EGMs may alternatively be treated as peripheral devices to a casino communication controller and connected in a shared daisy chain fashion to a single serial interface. In both cases, the peripheral devices are assigned device addresses. If so, the serial controller circuitry must implement a method to generate or detect unique device addresses. General purpose computing device serial ports are not able to do this.

Security monitoring circuits detect intrusion into an EGM by monitoring security switches attached to access doors in the EGM cabinet. Access violations result in suspension of game play and can trigger additional security operations to preserve the current state of game play. These circuits also function when power is off by use of a battery backup. In power-off operation, these circuits continue to monitor the access doors of the EGM. When power is restored, the EGM can determine whether any security violations occurred while power was off, e.g., via software for reading status registers. This can trigger event log entries and further data authentication operations by the EGM software.

Trusted memory devices and/or trusted memory sources are included in an EGM to ensure the authenticity of the software that may be stored on less secure memory subsystems, such as mass storage devices. Trusted memory devices and controlling circuitry are typically designed to not enable modification of the code and data stored in the memory device while the memory device is installed in the EGM. The code and data stored in these devices may include authentication algorithms, random number generators, authentication keys, operating system kernels, etc. The purpose of these trusted memory devices is to provide gaming regulatory authorities a root trusted authority within the computing environment of the EGM that can be tracked and verified as original. This may be accomplished via removal of the trusted memory device from the EGM computer and verification of the secure memory device contents is a separate third party verification device. Once the trusted memory device is verified as authentic, and based on the approval of the verification algorithms included in the trusted device, the EGM is enabled to verify the authenticity of additional code and data that may be located in the gaming computer assembly, such as code and data stored on hard disk drives. Examples of trusted memory devices are described in U.S. Pat. No. 6,685,567, entitled "Process Verification," which is incorporated herein by reference.

In at least one embodiment, at least a portion of the trusted memory devices/sources may correspond to memory that cannot easily be altered (e.g., "unalterable memory") such as EPROMS, PROMS, Bios, Extended Bios, and/or other memory sources that are able to be configured, verified, and/or authenticated (e.g., for authenticity) in a secure and controlled manner.

According to one embodiment, when a trusted information source is in communication with a remote device via a network, the remote device may employ a verification scheme to verify the identity of the trusted information source. For example, the trusted information source and the remote device may exchange information using public and private encryption keys to verify each other's identities. In another embodiment, the remote device and the trusted information source may engage in methods using zero knowledge proofs to authenticate each of their respective identities.

EGMs storing trusted information may utilize apparatuses or methods to detect and prevent tampering. For instance, trusted information stored in a trusted memory device may be encrypted to prevent its misuse. In addition, the trusted memory device may be secured behind a locked door. Further, one or more sensors may be coupled to the memory device to detect tampering with the memory device and provide some record of the tampering. In yet another example, the memory device storing trusted information might be designed to detect tampering attempts and clear or erase itself when an attempt at tampering has been detected. Examples of trusted memory devices/sources are described in U.S. Pat. No. 7,515,718, entitled "Secured Virtual Network in a Gaming Environment," which is incorporated herein by reference.

Mass storage devices used in a general purpose computing devices typically enable code and data to be read from and written to the mass storage device. In a gaming environment, modification of the gaming code stored on a mass storage device is strictly controlled and would only be enabled under specific maintenance type events with electronic and physical enablers required. Though this level of security could be provided by software, EGMs that include mass storage devices include hardware level mass storage data protection circuitry that operates at the circuit level to monitor attempts to modify data on the mass storage device and will generate both software and hardware error triggers should a data modification be attempted without the proper electronic and physical enablers being present. Examples of using a mass storage device are described in U.S. Pat. No. 6,149,522, entitled "Method of Authenticating Game Data Sets in an Electronic Casino Gaming System," which is incorporated herein by reference.

Various changes and modifications to the present embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A gaming system comprising:

a processor;

an acceptor configured to communicate with the processor and receive a physical item associated with a monetary value; and a memory device comprising instructions that, when executed, cause the processor to at least:

establish a credit balance responsive to receipt, by the acceptor, of the physical item;

initiate a play of a bingo game responsive to receipt of a game-initiation input;

cause a decrease in the credit balance by an amount associated with a wager placed to initiate the play of the bingo game;

responsive to receipt of the game-initiation input for the play of the bingo game, cause a display device to:

display a primary bingo card including a plurality of bingo spots; and display a poker bingo card including a plurality of bingo spots, wherein each bingo spot of the primary bingo card and the poker bingo card is associated with a different randomly assigned bingo number of a set of different bingo numbers, and a different playing card of a set of different playing cards;

for an initial bingo number draw including a subset of the set of different bingo numbers:

map, via the primary bingo card, each of the bingo numbers of the initial bingo number draw to respective ones of the playing cards;

populate a deal hand based on the playing cards mapped from the bingo numbers;

cause the display device to display the deal hand including the mapped playing cards;

for each playing card of the deal hand:

in response to detecting a hold input for the playing card of the deal hand, cause the display device to:

mark a bingo spot of the primary bingo card corresponding to the playing card using a first daubing pattern;

mark a bingo spot of the poker bingo card corresponding to the playing card using the first daubing pattern; and display the playing card in a poker hand associated with the poker bingo card; and in response to determining the playing card of the deal hand is a non-held card, causing the display device to:

mark a bingo spot of the primary bingo card corresponding to the non-held card using a second daubing pattern; and mark a bingo spot of the poker bingo card corresponding to the non-held card using the second daubing pattern;

conduct a plurality of additional bingo number draws from remaining numbers of the set of different bingo numbers, and, for each additional bingo number drawn:

cause the display device to mark a bingo spot of the primary bingo card corresponding to the additional bingo number drawn using the first daubing pattern;

determine whether a number of bingo spots on the poker bingo card marked using the first daubing pattern satisfies an interim pattern threshold;

responsive to determining that the number of bingo spots on the poker bingo card does not satisfy the interim pattern threshold, cause the display device to mark a bingo spot on the poker bingo card corresponding to the additional bingo number drawn using the first daubing pattern, and add a playing card corresponding to the marked bingo spot to the poker hand associated with the poker bingo card, wherein the plurality of additional bingo numbers are drawn from the remaining numbers of the set of different bingo numbers until the primary bingo card of the play of the bingo game matches a game-winning pattern; and responsive to the game-winning pattern being detected:

determine any first award based on the game-winning pattern;

determine any second awards for each player of the play of the bingo game based on their respective poker hands;

cause the display device to display any first award and any second awards; and cause an increase in the credit balance by an amount associated with any displayed first award and any displayed second awards;

responsive to detecting a cashout input, initiate a payout associated with the credit balance.

2. The gaming system of claim 1, wherein:

the plurality of bingo spots of the primary bingo card is a 4 by 13 array; and the plurality of bingo spots of the poker bingo card is a 4 by 13 array.

3. The gaming system of claim 2, wherein each row of the primary bingo card corresponds to a different card suit and each column of the primary bingo card corresponds to a different card value.

4. The gaming system of claim 1, wherein the set of different bingo numbers includes 52 different numbers.

5. The gaming system of claim 1, wherein the instructions, when executed, cause the processor to determine when the primary bingo card matches the game-winning pattern by comparing bingo spots marked on the primary bingo card using the first daubing pattern to the game-winning pattern.

6. The gaming system of claim 5, wherein the instructions, when executed, cause the processor to determine a game-winning award for the primary bingo card when the primary bingo card matches the game-winning pattern.

7. The gaming system of claim 6, wherein the instructions, when executed, cause the processor to determine whether the poker bingo card matches an interim bingo pattern by comparing the bingo spots on the poker bingo card that are marked using the first daubing pattern to the interim bingo pattern.

8. The gaming system of claim 7, wherein the interim bingo pattern is included in a set of interim bingo patterns.

9. The gaming system of claim 8, wherein each interim bingo pattern of the set of interim bingo patterns corresponds to a poker winning hand.

10. The gaming system of claim 7, wherein the instructions, when executed, cause the processor to determine an interim bingo pattern award for the poker bingo card when the poker bingo card matches the interim bingo pattern.

11. The gaming system of claim 1, wherein the deal hand includes a quantity of playing cards that corresponds to a quantity of bingo numbers drawn in the initial bingo number draw.

12. The gaming system of claim 1, wherein the poker bingo card is a first poker bingo card of a plurality of poker bingo cards.

13. The gaming system of claim 12, wherein each of the plurality of poker bingo cards is associated with a respective poker hand.

14. The gaming system of claim 13, wherein the instructions, when executed, cause the processor to determine any second awards for each of the respective poker hands associated with the plurality of poker bingo cards.

15. The gaming system of claim 1, wherein when the primary bingo card of the play of the bingo game matches the game-winning pattern, the poker bingo card includes a total of five bingo spots marked using the first daubing pattern.

16. A method of operating a gaming system, the method comprising:

receiving, by an acceptor, a physical item associated with a monetary value;

establishing, by a processor, a credit balance based on receipt of the physical item by the acceptor;

initiating, by the processor, a play of a bingo game responsive to receipt of a game-initiation input;

decreasing, by the processor, the credit balance by an amount of a wager placed associated with the game-initiation input;

responsive to receipt of the game-initiation input for the play of the bingo game, causing, by the processor, a display device to:

display a primary bingo card including a plurality of bingo spots; and display a poker bingo card including a plurality of bingo spots, wherein each bingo spot of the primary bingo card and the poker bingo card is associated with a different randomly assigned bingo number of a set of different bingo numbers, and a different playing card of a set of different playing cards;

for an initial bingo number draw including a subset of the set of different bingo numbers:

mapping, by the processor, via the primary bingo card, each of the bingo numbers of the initial bingo number draw to respective ones of the playing cards;

populating, by the processor, a deal hand based on the playing cards mapped from the bingo numbers;

causing, by the processor, the display device to display the deal hand including the mapped playing cards;

for each playing card of the deal hand:

in response to detecting a hold input for the playing card of the deal hand, causing, by the processor, the display device to:

mark a bingo spot of the primary bingo card corresponding to the playing card using a first daubing pattern;

mark a bingo spot of the poker bingo card corresponding to the playing card using the first daubing pattern; and display the playing card in a poker hand associated with the poker bingo card; and in response to determining the playing card of the deal hand is a non-held card, causing, by the processor, the display device to:

mark a bingo spot of the primary bingo card corresponding to the non-held card using a second daubing pattern; and mark a bingo spot of the poker bingo card corresponding to the non-held card using the second daubing pattern;

conducting, by the processor, a plurality of additional bingo number draws from remaining numbers of the set of different bingo numbers, and, for each additional bingo number drawn:

causing, by the processor, the display device to mark a bingo spot of the primary bingo card corresponding to the additional bingo number drawn using the first daubing pattern;

determining, by the processor, whether a number of bingo spots on the poker bingo card marked using the first daubing pattern satisfies an interim pattern threshold;

responsive to determining that the number of bingo spots on the poker bingo card does not satisfy the interim pattern threshold, causing, by the processor, the display device to mark a bingo spot on the poker bingo card corresponding to the additional bingo number drawn using the first daubing pattern, and add a playing card corresponding to the marked bingo spot to the poker hand associated with the poker bingo card, wherein the plurality of additional bingo numbers are drawn from the remaining numbers of the set of different bingo numbers until the primary bingo card of the play of the bingo game matches a game-winning pattern; and responsive to the game-winning pattern being detected:

determining, by the processor, any first award based on the game-winning pattern;

determining, by the processor, any second awards for each player of the play of the bingo game based on their respective poker hands;

causing, by the processor, the display device to display any first award and any second awards; and increasing, by the processor, the credit balance by an amount associated with any displayed first award and any displayed second awards; and responsive to detecting a cashout input, initiating, by the processor, a payout associated with the credit balance.

17. The method of claim 16, wherein:

the plurality of bingo spots of the primary bingo card is a 4 by 13 array; and the plurality of bingo spots of the poker bingo card is a 4 by 13 array.

18. The method of claim 17, wherein each row of the primary bingo card corresponds to a different card suit and each column of the primary bingo card corresponds to a different card value.

19. The method of claim 16, wherein the set of different bingo numbers includes 52 different numbers.

20. The method of claim 16, which includes determining, by the processor, when the primary bingo card matches the game-winning pattern by comparing bingo spots marked on the primary bingo card using the first daubing pattern to the game-winning pattern.

21. The method of claim 20, which includes determining, by the processor, a game-winning award for the primary bingo card when the primary bingo card matches the game-winning pattern.

22. The method of claim 21, which includes determining, by the processor, whether the poker bingo card matches an interim bingo pattern by comparing the bingo spots on the poker bingo card that are marked using the first daubing pattern to the interim bingo pattern.

23. The method of claim 22, wherein the interim bingo pattern is included in a set of interim bingo patterns.

24. The method of claim 23, wherein each interim bingo pattern of the set of interim bingo patterns corresponds to a poker winning hand.

25. The method of claim 22, which includes determining, by the processor, an interim bingo pattern award for the poker bingo card when the poker bingo card matches the interim bingo pattern.

26. The method of claim 16, wherein the deal hand includes a quantity of playing cards that corresponds to a quantity of bingo numbers drawn in the initial bingo number draw.

27. The method of claim 16, wherein the poker bingo card is a first poker bingo card of a plurality of poker bingo cards.

28. The method of claim 27, wherein each of the plurality of poker bingo cards is associated with a respective poker hand.

29. The method of claim 28, which includes determining, by the processor, any second awards for each of the respective poker hands associated with the plurality of poker bingo cards.

30. The method of claim 16, wherein when the primary bingo card of the play of the bingo game matches the game-winning pattern, the poker bingo card includes a total of five bingo spots marked using the first daubing pattern.

31. A gaming system comprising:

a processor;

an acceptor configured to communicate with the processor and receive a physical item associated with a monetary value; and a memory storing instructions that, when executed, cause the processor to at least:

establish a credit balance responsive to receipt, by the acceptor, of the physical item;

initiate a play of a bingo game responsive to receipt of a game-initiation input;

cause a decrease in the credit balance by an amount associated with a wager placed to initiate the play of the bingo game;

responsive to receipt of the game initiation input, conduct an initial draw of a plurality of different bingo numbers of a set of different bingo numbers, wherein each bingo number of the set of different bingo numbers maps to a different bingo spot on a primary bingo card;

responsive to the initial draw, cause a display device to display a deal hand of playing cards, wherein each of the playing cards of the deal hand maps, via the primary bingo card, to a respective drawn bingo number of the plurality of different bingo numbers;

identify a subset of held cards of the deal hand and a subset of non-held cards of the deal hand;

for each held card of the deal hand, cause the display device to mark a bingo spot on the primary bingo card corresponding to the held card via a first daubing pattern, mark a bingo spot on a poker bingo card corresponding to the held card via the first daubing pattern, the poker bingo card including a plurality of bingo spots that are associated with a different bingo number of the set of different bingo numbers and a different playing card of a set of different playing cards, and display the held card in a poker hand associated with the poker bingo card; and for each additional bingo number drawn from remaining bingo numbers of the set of different bingo numbers:

determine whether a quantity of bingo spots on the poker bingo card marked using the first daubing pattern satisfies an interim pattern threshold;

responsive to a determination that the quantity of bingo spots does not satisfy the interim pattern threshold, cause the display device to mark on the primary bingo card, using the first daubing pattern, the bingo spot corresponding to the drawn bingo number, cause the display device to mark on the poker bingo card, using the first daubing pattern, the bingo spot corresponding to the drawn bingo number, identify a playing card that maps, via the poker bingo card, to the drawn bingo number, and cause the display device to display the identified playing card; and responsive to a determination that the quantity of bingo spots satisfies the interim pattern threshold, cause the display device to mark on the primary bingo card, using the first daubing pattern, the bingo spot corresponding to the drawn bingo number, determine any interim award based on the poker hand, cause the display device to display any interim award, and cause an increase in the credit balance by an amount associated with any displayed interim award; and responsive to detecting a cashout input, initiate a payout associated with the credit balance.

* * * * *